US005860304A

United States Patent [19]

Anbe et al.

[11] Patent Number: 5,860,304

[45] Date of Patent: Jan. 19, 1999

[54] STRIP CROWN MEASURING METHOD AND CONTROL METHOD FOR CONTINUOUS ROLLING MACHINES

[75] Inventors: Yoshiharu Anbe, Kodaira; Noriyasu Okitani, Urawa; Taichi Hatashita, Fuchu; Tomoyuki Tezuka, Ome; Yoshito Goto; Yoshimitsu Fukui, both of Chiba; Nobuaki Nomura, Ichikawa, all of Japan

[73] Assignees: Kabushiki Kaisha Toshiba, Kawasaki; Kawasaki Steel Corporation, Kobe, both of Japan

[21] Appl. No.: 772,573

[22] Filed: Dec. 26, 1996

[30] Foreign Application Priority Data

Dec. 26, 1995 [JP] Japan ..... 7-351576

[51] Int. Cl.[6] ..... B21B 37/28

[52] U.S. Cl. ..... 72/9.1; 72/9.2; 72/11.7; 72/11.8

[58] Field of Search ..... 72/241.8, 8.3, 72/8.9, 9.1, 9.2, 11.2, 11.6, 11.7, 11.8, 12.7

[56] References Cited

U.S. PATENT DOCUMENTS

| | | | |
|---|---|---|---|
| 5,126,947 | 6/1992 | Koyama | 72/11.7 |
| 5,267,170 | 11/1993 | Anbe | 72/11.7 |
| 5,493,885 | 2/1996 | Nomura et al. | 72/11.7 |
| 5,495,735 | 3/1996 | Nishimura | 72/11.8 |
| 5,546,779 | 8/1996 | Ginzburg | 72/11.7 |
| 5,651,281 | 7/1997 | Seidel | 72/11.8 |
| 5,653,137 | 8/1997 | Takakura et al. | 72/241.8 |

OTHER PUBLICATIONS

*Nishiyama, et al.*, Memorial Symposium of 100$^{th}$ Rolling Theory Committee, Development and Prospect of Theory and Technology of Steel Rolling, pp. 79–90, Jun. 1994, "Hot Rolling Technology For Improvement Of Dimensional Accuracy".

*Primary Examiner*—Joseph J. Hail, III
*Assistant Examiner*—Ed Tolan
*Attorney, Agent, or Firm*—Oblon, Spivak, McClelland, Maier & Neustadt, P.C.

[57] ABSTRACT

In the continuous rolling mills, the strip crown and the strip flatness of a strip can be controlled to any desired value. In the strip crown measuring method, the strip crown of the first stage rolling mill can be obtained by adding the set target strip crown value and a value obtained by multiplying the deviation in mechanical strip crown between the predicted value and the actually measured value by a imprinting ratio. Further, the strip crowns of the second and after rolling mills can be obtained by adding the set target strip crown, a value obtained by multiplying the deviation in mechanical strip crown between the predicted value and the actually measured value by a imprinting ratio, and a value obtained by multiplying the deviation in entry strip crown between the target value and the calculated measurement value by an inheritance coefficient, for each rolling mill. Further, in the control method of the continuous rolling mills, the rolling mill is controlled in correspondence to the deviation in strip crown between the value actually measured by the profile gauge and the previously calculated value, in such a way that the manipulated variables of the actuators of the rolling mills arranged on the upstream side of the rolling mill having the profile gauge are equal to each other or determined to a predetermined proportion by use of imprinting ratios and inheritance coefficients.

44 Claims, 34 Drawing Sheets

STRIP CROWN MEASURING METHOD AND CONTROL METHOD FOR CONTINUOUS ROLLING MACHINES

BACKGROUND OF THE INVENTION

1. Field of the Invention

The present invention relates to continuous rolling mills for rolling a strip (e.g., metal strip), and more specifically to a method of measuring strip crown in order to control both the strip thickness distribution (i.e., strip crown) in the strip lateral direction and the strip wave (i.e., flatness) of the strip longitudinal direction to desired values, respectively and a method of controlling the continuous rolling mills on the basis of the measuring method.

2. Description of the Prior Art

A hot finish rolling mill for controlling strip crown and flatness is disclosed by [Hot rolling technology for improvement of dimensional accuracy] by Yasuyuki NISHIYAMA, on pages 81 to 90, Rolling Theory Committee Journal of Memorial Symposium of 100th Meeting of The Iron and Steel Institute of Japan, June 1994, for instance. In particular, on page 87, there are disclosed a crown and/or shape control system of a hot strip mill which composes of six stands, a profile gauge and a strip flatness sensor at the exit of the last stand. This system controls bendings on the bases of outputs of those sensors.

In this rolling mill, the work roll bendings are installed for only the last three stands, so that the rest are not feedback controlled. As a result, it is impossible to control both the strip crown and the flatness to desired values, respectively and satisfactorily. In addition, since nothing is explained of the practical operation of the work roll bendings, it is difficult to realize the control method in practice.

Further, the relationship among the virtual strip crown (referred to as mechanical strip crown, hereinafter) obtained when the rolling force distribution is uniform in the width direction of the rolled strip, the imprinting ratio, the inheritance coefficient from the entry strip crown to the delivery strip crown, etc. are explained in detail in [Development in Shape and Crown Control Theory for Thin Sheet rolling] by Hiromi MATSUMOTO, on pages 155 to 176, Rolling Theory Committee Journal of Memorial Symposium of 30th Meeting of The Iron and Steel Institute of Japan, March 1985, for instance.

In this case, however, nothing is explained of the method of controlling the strip crown and the flatness to desired values, respectively, so that it is difficult to realize the control method in practice.

SUMMARY OF THE INVENTION

With these problems in mind, therefor, it is the object of the present invention to provide a method of measuring strip crown in order to control both the strip thickness distribution (i.e., strip crown) in the strip lateral direction and the strip wave (i.e., flatness) of the strip longitudinal direction to desired values, respectively and a method of controlling the continuous rolling mills on the basis of the measuring method.

To achieve the above-mentioned object, the present invention provides a first method (shown in FIGS. 7A and 7B) according to the present invention provides a method of calculating and measuring strip crowns of any desired rolling mills of a plurality of tandem-arranged continuous rolling mills each provided with at least one actuator for controlling each strip crown, comprising the steps of: calculating and setting a target strip crown of the rolling mill from a first stand to another rolling mill at which strip crown is to be measured, for each rolling mill; predicting a rolling force, an state value of the actuator, and a work roll crown, for each rolling mill; actually measuring the rolling force, the state value of the actuator, and the work roll crown, for each rolling mill; calculating deviations in rolling force, state value of the actuator, and work roll crown between the predicted value and the actually measured value, for each rolling mill from the first stand to the rolling mill at which the strip crown is to be measured; multiplying each of the calculated deviations by an influence coefficient upon a mechanical strip crown, respectively; adding all the obtained multiplication results to obtain a total deviation in mechanical strip crown between the predicted value and the actually measured value, for each rolling mill; for the first stand, adding the target strip crown value calculated by set up calculation function to a value obtained by multiplying the deviation in mechanical strip crown between the predicted value and the actually measured value by a imprinting ratio, to obtain a calculated measurement value of the strip crown; and for the second and after rolling mills, adding the target strip crown calculated by set up calculation function, a value obtained by multiplying the deviation in mechanical strip crown between the predicted value and the actually measured value by a imprinting ratio, and a value obtained by multiplying the deviation in entry strip crown between the target value and the calculated measurement value by an inheritance coefficient, to obtain calculated measurement values of the strip crowns, the strip crowns of the rolling mills at which the strip crowns are to be measured being obtained by repeating the above-mentioned calculations from an upstream side rolling mill to the rolling mill at which the strip crown is to be measured.

Further, it is preferable that a profile gauge is equipped on an delivery side of the most downstream side rolling mill of the rolling mills at each of which the strip crown is to be measured; and that the method further comprises the step of multiplying the calculated deviation in strip crown between the calculated measurement value and the actually measured value on an delivery side of the most downstream side rolling mill, by a ratio of a strip thickness obtained on the delivery side of the rolling mill at which the strip crown is to be measured and a strip thickness obtained on the delivery side of the most downstream side rolling mill for each rolling mill, to correct the calculated measurement value of the strip crown of the rolling mill at which the strip crown is to be measured.

Further, a second method (shown in FIGS. 8A to 8C) according to the present invention provides a method of controlling tandem-arranged continuous rolling mills each provided with at least one actuator for controlling each strip crown and having a profile gauge installed between stands or at the delivery side of the last stand to reduce a deviation in strip crown between a value actually measured by the profile gauge and a previously calculated target value to zero, wherein a controlled variable of the actuator is obtained in correspondence to the deviation of the strip crown for each rolling mill, by use of a imprinting ratio and an inheritance coefficient for each rolling mill, in such a way that the manipulated variables of the actuators of the rolling mills arranged on the upstream side of the rolling mill at which the profile gauge is equipped are equal to each other or determined to a predetermined proportion.

Further, It is preferable that the method further comprises the steps of: multiplying the manipulated variable of the actuator by a imprinting ratio and an influence coefficient upon the mechanical strip crown, to obtain the controlled variable of the delivery strip crown, for each rolling mill; and adding the controlled variable of the delivery strip crown, a value obtained by multiplying the controlled variable of the delivery strip crown of the adjacent upstream side rolling mill by the inheritance coefficient, and the previously calculated and measured strip crown value, to obtain the total controlled variable of the strip crown for each rolling mill, the added total controlled variable of the strip crown being used to correct the manipulated variable of the actuator for each rolling mill.

Further, it is preferable that the method further comprises the steps of: dividing the total controlled variable of the delivery strip crown by an delivery side strip thickness, to obtain a strip crown ratio for each rolling mill; multiplying a difference in strip crown ratio between the adjacent downstream side rolling mill and the adjacent upstream side rolling mill by a shape disturbing coefficient, to obtain a flatness for each rolling mill; when the obtained flatness exceeds an allowable range, calculating a modified control value of the delivery strip crown from the downstream side rolling mill to the upstream side rolling mill in sequence, so that the obtained flatness lies within the allowable range; and correcting the manipulated variable of the actuator on the basis of the modified control value of the delivery strip crown, for each related rolling mill.

Further, it is preferable that the continuous rolling mills are provided with a first actuator and a second actuator, respectively and that the method further comprises the steps of: when the manipulated variable of the first actuator exceeds an capability of the actuator, calculating a manipulated variable of the second actuator corresponding to an excessive value of the first actuator beyond the capability of the actuator; controlling the first actuator on the basis of the controlled variable limited within the capability of the actuator; and controlling the second actuator on the basis of the calculated manipulated variable of the second actuator, for each rolling mill.

Further, a third method (shown in FIGS. 9A to 9C) according to the present invention provides a method of controlling tandem-arranged continuous rolling mills each provided with at least one actuator for controlling each strip crown and having a profile gauge installed between stands or at the delivery side of the last stand to reduce a deviation in strip crown between a value actually measured by the profile gauge and a previously calculated target strip crown to zero, wherein a manipulated variable of the actuator is obtained in correspondence to the deviation of the strip crown for each rolling mill, by use of a imprinting ratio, an inheritance coefficient and a strip thickness of each rolling mill, in such a way that the controlled variables of ratio crowns of the rolling mills arranged on the upstream side of the rolling mill at which the profile gauge is equipped are equal to each other or determined to a predetermined proportion.

Further, it is preferable that the method further comprises the steps of: multiplying the manipulated variable of the actuator by a imprinting ratio and an influence coefficient upon the mechanical strip crown, to obtain the controlled variable of the delivery strip crown, for each rolling mill; and adding the controlled variable of the delivery strip crown, a value obtained by multiplying the controlled variable of the delivery strip crown of the adjacent upstream side rolling mill by the inheritance coefficient, and the previously calculated and measured strip crown value, to obtain the total controlled variable of the strip crown for each rolling mill, the added total controlled variable of the strip crown being used to correct the manipulated variable of the actuator for each rolling mill.

Further, it is preferable that the method further comprises the steps of: dividing the total controlled variable of the delivery strip crown by an delivery side strip thickness, to obtain a strip crown ratio for each rolling mill; multiplying a difference in strip crown ratio between the adjacent downstream side rolling mill and the adjacent upstream side rolling mill by a shape disturbing-coefficient, to obtain a flatness for each rolling mill; when the obtained flatness exceeds an allowable range, calculating a modified control value of the delivery strip crown from the downstream side rolling mill to the upstream side rolling mill in sequence, so that the obtained flatness lies within the allowable range; and correcting the manipulated variable of the actuator on the basis of the modified control value of the delivery strip crown, for each related rolling mill.

Further, it is preferable that the continuous rolling mills are provided with a first actuator and a second actuator, respectively; and that the method further comprises the steps of: when the manipulated variable of the first actuator exceeds an capability of the actuator, calculating a manipulated variable of the second actuator corresponding to an excessive value of the first actuator beyond the capability of the actuator; controlling the first actuator on the basis of the controlled variable limited within the capability of the actuator; and controlling the second actuator on the basis of the calculated manipulated variable of the second actuator, for each rolling mill.

Further, a fourth method (shown in FIGS. 10A and 10B) according to the present invention provides a method of controlling tandem-arranged continuous rolling mills each provided with a first actuator and a second actuator both for controlling each strip crown and having a profile gauge installed between stands or at the delivery side of the last stand to reduce a deviation in strip crown between a value actually measured by the profile gauge and a previously calculated target strip crown to zero, which comprises the steps of: obtaining a manipulated variable of the first actuator of the rolling mill arranged on an upstream side from a position at which the profile gauge is equipped, on the basis of the deviation in strip crown, for each rolling mill; when the obtained controlled variable exceeds an capability of the actuator, obtaining the first actuator manipulated variable limited within the capability of the actuator and the second actuator manipulated variable corresponding to an excessive value of the first actuator beyond the capability of the actuator, for each rolling mill; when the manipulated variable of the first actuator does not exceed the capability of the actuator, simultaneously controlling only the first actuators of the rolling mills arranged on the upstream side of the position at which the profile gauge is equipped, on the basis of the corresponding controlled variable; when the manipulated variable of the first actuator exceeds the capability of the actuator, simultaneously controlling both the first and second actuators of the rolling mill arranged on the upstream side of which the profile gauge is arranged, on the basis of the two corresponding controlled variables, respectively; and repeating the simultaneous output control whenever a control position on a strip controlled by the most upstream side rolling mill reaches the position at which the profile gauge is equipped.

Further, a fifth method (shown in FIGS. 11A and 11B) according to the present invention provides a method of controlling tandem-arranged continuous rolling mills each provided with at least one actuator for controlling each strip crown and a profile gauge installed between stands or at the delivery side of the last stand to reduce a deviation in strip crown between a value actually measured by the profile gauge and a previously calculated target strip to zero, which comprises the steps of: calculating a first manipulated variable of the actuator of the rolling mill, on the basis of a imprinting ratio and an inheritance coefficient for each rolling mill, in such a way that the calculated manipulated variables of the actuators of the rolling mills arranged at and on an upstream side from the rolling mill on the delivery side of which the profile gauge is equipped are equal to each other or determined to a predetermined proportion; obtaining second manipulated variable of the actuator required when the strip crown is controlled by only the rolling mill on the delivery side of which the profile gauge is equipped; manipulating the actuator of the rolling mill on the delivery side of which the profile gauge is equipped, on the basis of the second controlled variable; and simultaneously controlling the actuators of the rolling mills arranged on the upstream side of the rolling mill on the delivery side of which the profile gauge is equipped, on the basis of the first controlled variables; whenever a control point on a strip by the upstream side rolling mill reaches the rolling mill at which the profile gauge is equipped, inversely compensating for the manipulated variable of the actuator of the rolling mill on the delivery side of which the profile gauge is equipped, by a value corresponding to the first controlled variables of the respective upstream side rolling mills; and whenever the control point of the strip by the most upstream side rolling mill is passed through the rolling mill on the delivery side of which the profile gauge is equipped, repeating the calculation of the control variables, the control, and the inverse compensation, respectively.

Further, it is preferable that when the strip crown is controlled by only the rolling mill on the delivery side of which the profile gauge is equipped and further when the second manipulated variable of the actuator exceeds an capability of the actuator, the strip crown is controlled on the basis of the second manipulated variable limited within the capability of the actuator.

Further, a modification of the fifth method (shown in FIGS. 12A and 12B) according to the present invention provides a method of controlling tandem-arranged continuous rolling mills, which further comprises the step of: obtaining the control variable of the actuator of the rolling mill in such a way the controlled variables of strip crown ratios of the rolling mills at and on the upstream side of the rolling mill on the delivery side of which the profile gauge is equipped are equal to each other or determined in a predetermined proportion, instead of obtaining the control variable of the actuator of the rolling mill in such a way the manipulated variables of the actuators of the rolling mills at and on the upstream side of the rolling mill on the delivery side of which the profile gauge is equipped are equal to each other or determined in a predetermined proportion.

Further, it is preferable that when the strip crown is controlled by only the rolling mill on the delivery side of which the profile gauge is equipped and further when the second manipulated variable of the actuator exceeds an capability of the actuator, the strip crown is controlled on the basis of the second manipulated variable limited within the capability of the actuator.

Further, a sixth method (shown in FIGS. 13A and 13B) according to the present invention provides a method of controlling tandem-arranged continuous rolling mills each provided with at least one actuator for controlling each strip crown and having a profile gauge installed between stands or at the delivery side of the last stand to reduce a deviation in strip crown between a value actually measured by the profile gauge and a previously calculated target strip to zero, which comprises the steps of: obtaining a first manipulated variable of the actuator of the rolling mill on the basis of an imprinting ratio and an inheritance coefficient for each rolling mill, in such a way that the calculated controlled variables of the rolling mills arranged at and on an upstream side of the rolling mill on the delivery side of which the profile gauge is equipped are equal to each other or determined to a predetermined proportion; obtaining second manipulated variables of the actuators of the second and after rolling mills from the most upstream side rolling mill, to control all the strip crown deviations of the upstream side rolling mills; manipulating the actuator of the most upstream side rolling mill on the basis of the first manipulated variable; and simultaneously controlling the actuators of the second and after rolling mills from the most upstream side rolling mill on the basis of the second controlled variables; whenever a control point on a strip by the upstream side rolling mills reaches adjacent downstream side rolling mill, inversely compensating for the manipulated variable of the actuator by a value corresponding to the controlled variables of the respective upstream side rolling mill; and whenever a control point on the strip by the most upstream side rolling mill is passed through the rolling mill on the delivery side of which the profile gauge is disposed, repeating the calculation of the control variables, the control, and the inverse compensation.

Further, it is preferable that when the second controlled variable exceeds an capability of the actuator, the strip crown is controlled on the basis of the second controlled variable limited within the capability of the actuator.

Further, a modification of the sixth method (shown in FIGS. 14A and 14B) according to the present invention provides a method of controlling tandem-arranged continuous rolling mills, which further comprises the step of: obtaining the control variable of the actuator of the rolling mill in such a way the controlled variables of strip crown ratios of the rolling mills at and on the upstream side of the rolling mill on the delivery side of which the profile gauge is equipped are equal to each other or determined in a predetermined proportion, instead of obtaining the control variable of the actuator of the rolling mill in such a way the manipulated variables of the actuators of the rolling mills at and on the upstream side of the rolling mill on the delivery side of which the profile gauge is equipped are equal to each other or determined in a predetermined proportion.

Further, it is preferable that when the second controlled variable exceeds an capability of the actuator, the strip crown is controlled on the basis of the second controlled variable limited within the capability of the actuator.

Further, a seventh method (shown in FIGS. 15A and 15B) according to the present invention provides a method of controlling tandem-arranged continuous rolling mills each provided with at least one actuator for controlling each strip crown and a profile gauge installed between stands or at the delivery side of the last stand to reduce a deviation in strip crown between a value actually measured by the profile gauge and a previously calculated target strip to zero, which comprises the steps of: calculating the deviation of the rolling mill on the delivery side of which the profile gauge is equipped; and dividing the calculated deviation by a product of an influence coefficient of manipulated variable of the actuator upon a strip crown and a imprinting ratio, for each rolling mill; and obtaining a manipulated variable of the actuator in proportion to the divided value, to control the corresponding actuator, for each rolling mill.

Further, it is preferable that the continuous rolling mills are each provided with a first actuator and a second actuator;

and that the method comprises the steps of: when the manipulated variable of the first actuator exceeds an capability of the actuator, maintaining the manipulated variable of the first actuator within the capability of the actuator, and calculating a manipulated variable of the second actuator corresponding to an excessive value of the first actuator beyond the capability of the actuator; and controlling the second actuator on the basis of the calculated manipulated variable.

Further, a first modification of the method (shown in FIG. 16) according to the present invention provides a method of calculating and measuring strip crowns of any desired rolling mills of a plurality of tandem-arranged continuous rolling mills, wherein both a flatness sensor and a profile gauge are provided between the stands, and which further comprises the steps of: when a flatness value measured by the flatness sensor exceeds an allowable range, stopping control executed on the basis of the measurement value of the strip crown; and controlling any one of work roll bending force and leveling of the rolling mill on an delivery side of which the flatness sensor is equipped, on the basis of the measurement value of the flatness sensor.

Further, a second modification of the control method (shown in FIG. 17) according to the present invention provides a method of calculating and measuring strip crowns of any desired rolling mills of a plurality of tandem-arranged continuous rolling mills, which comprises the steps of: measuring an operator-side flatness, a drive-side flatness, and a flatness at the center in strip width direction by the flatness sensor, to control a work roll bending force; obtaining a difference in flatness between an average value of both the operator-side flatness and the drive-side flatness, and a flatness at the center; executing PI calculation for a deviation between the obtained difference and a target flatness; and obtaining a controlled variable of the roller bending force inversely proportional to the imprinting ratio, the influence coefficient and a shape disturbing-coefficient, and proportional to a strip thickness.

Further, a third modification of the method (shown in FIG. 18) according to the present invention provides a method of calculating and measuring strip crowns of any desired rolling mills of a plurality of tandem-arranged continuous rolling mills, which further comprises the steps of: measuring an operator-side flatness and a drive-side flatness by the flatness sensor, to control the leveling; obtaining a difference in flatness between the operator-side flatness and the drive-side flatness; executing PI calculation for the obtained difference; and obtaining a controlled variable of leveling inversely proportional to the imprinting ratio, the influence coefficient, and a shape disturbing-coefficient, and proportional to a strip thickness.

Further, an eighth method (shown in FIG. 19) according to the present invention provides a method of controlling tandem-arranged continuous rolling mills each provided with an actuator for controlling each strip crown, which comprises the steps of: obtaining a deviation in rolling force between a predicted value and a measured value or a deviation in rolling force between lead end position and the other strip position, for each rolling mill; multiplying the obtained deviation by a coefficient proportional to an influence coefficient of the strip crown upon the rolling force and inversely proportional to an influence coefficient of manipulated variable of the actuator upon the strip crown, to obtain a manipulated variable of the actuator; and manipulating the actuator on the basis of the obtained manipulated variable.

Further, a ninth method (shown in FIG. 20) according to the present invention provides a method of controlling tandem-arranged continuous rolling mills each provided with an actuator for controlling each strip crown and having a profile gauge installed between stands or at the delivery side of the last stand, by feed-forward controlling the actuators arranged on the downstream side of the rolling mill having the profile gauge on the basis of a deviation in strip crown between a value actually measured by the profile gauge and a previously calculated target value, which comprises the steps of: when an end of a strip reaches a position at which the profile gauge is equipped, obtaining a deviation in strip crown between a target value and a measured value; multiplying the obtained deviation by a coefficient proportional to an inheritance coefficient and inversely proportional to a product of an influence coefficient of the manipulated variable of the actuator to be controlled upon the strip crown and a imprinting ratio, for each rolling mill arranged on the downstream side of the rolling mill at which the profile gauge is equipped; and manipulating the actuator on the basis of the obtained manipulated variable.

In the first method of measuring the strip crown according to the present invention, it is possible to measure the strip crowns of the tandem-arranged rolling mills, respectively, irrespective of the presence or absence of the profile gauge. Further, when only a single profile gauge is equipped, it is possible to measure the strip crowns of the rolling mills, in the same way as with the case where the profile gauge is equipped for each rolling mill.

In the second method of controlling the strip crown according to the present invention, it is possible to uniformalize the load upon each actuator of each rolling mill on the basis of the manipulated variable of the actuator. Further, it is possible to increase the control precision of the strip crown. Further, it is possible to control the strip crown under consideration of the flatness. Further, it is possible to control the strip crown securely and safely even if the controlled variable of the strip crown is large.

In the third method of controlling the strip crown according to the present invention, it is possible to uniformalize the load upon each actuator of each rolling mill on the basis of the ratio crown. Further, it is possible to increase the control precision of the strip crown. Further, it is possible to control the strip crown under consideration of the flatness and to control the strip crown without deteriorating the flatness. Further, it is possible to control the strip crown securely and safely even if the controlled variable of the strip crown is large.

In the fourth method of controlling the strip crown according to the present invention, it is possible to control the strip crown by the actuators installed in the stands on the upstream side of the profile gauge rapidly.

In the fifth method of controlling the strip crown according to the present invention, it is possible to control the strip crown roughly all over the longitude direction of the rolling strip. Further, it is possible to suppress the manipulated variable of the actuator of the rolling mill on the delivery side of which the profile gauge is equipped, within the capability of the actuator.

In the modification of the fifth method according to the present invention, it is possible to control the strip crown on the basis of the strip crown ratio. Further, it is possible to suppress the manipulated variable of the actuator of the rolling mill on the delivery side of which the profile gauge is equipped, within the capability of the actuator.

In the sixth method of controlling the strip crown according to the present invention, it is possible to control the strip crown roughly all over longitude direction of the strip by controlling the deviation at each actuator position of each rolling mill. Further, it is possible to control the strip crown by suppressing the manipulated variable of the actuator of the rolling mill within the capability of the actuator.

In the modification of the sixth method according to the present invention, it is possible to control the strip crown on the basis of the strip crown ratio. Further, it is possible to suppress the manipulated variable of the actuator of the rolling mill, within the capability of the actuator.

In the seventh method of controlling the strip crown according to the present invention, it is possible to control the strip crown all over longitude direction of the strip at a high response speed. Further, it is possible to control the strip crown securely and safely under consideration of the allowable limit of the actuator.

In the first modification of the control method according to the present invention, it is possible to previously prevent the flatness from being deteriorated by the strip crown control, by controlling any one or both of the work roll bending force and leveling of the rolling mill having the flatness sensor.

In the second modification of the control method according to the present invention, it is possible to control the flatness securely by controlling the work roll bending force.

In the third modification of the control method according to the present invention, it is possible to control the flatness securely by controlling the work load leveling.

In the eighth method of controlling the strip crown according to the present invention, it is possible to control the strip crown caused by change of rolling force at all times.

In the ninth method of controlling the strip crown according to the present invention, it is possible to execute the feed-forward control in combination with the other control methods.

DETAILED DESCRIPTION OF THE PREFERRED EMBODIMENTS

The measuring method and the control method according to the present invention will be described hereinbelow with reference to the attached drawings.

[First embodiment]

Figure 1:
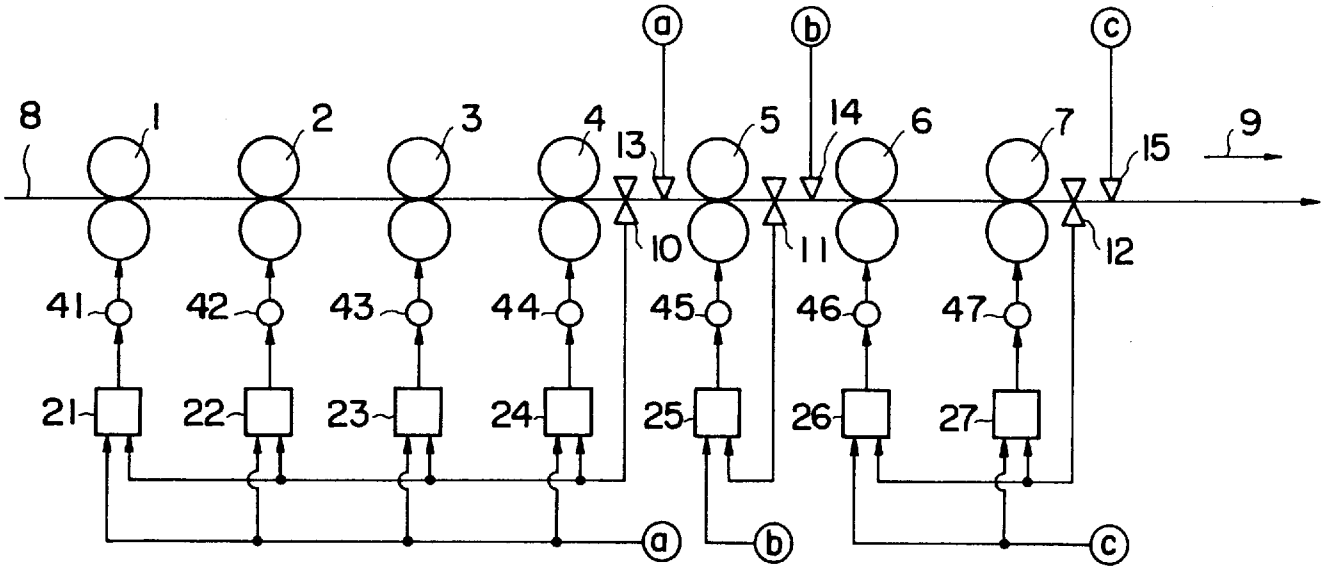
FIG. 1 is a block diagram showing a first embodiment of continuous rolling mills to which the method according to the present invention is applied.

FIG. 1 is a first embodiment of the configuration of the continuous rolling mills to which the methods according to the present inventions are applied. In FIG. 1, seven stand rolling mills (referred to as first to seventh stands, hereinafter) are arranged in tandem. Each stand is provided with an actuator (not shown) for controlling the strip crown and the flatness of a strip material to be rolled. As the actuator, there exist a cross angle controller (referred to as a pair cross), a work roll bending for applying a bending force to the work roll, a work roll shifter for shifting the work roll in the axial direction, an intermediate roller shifter for shifting the intermediate roller in the axial direction, etc. In the pair cross, an top work roll and an top backup roll are formed integral with each other; a bottom work roll and a bottom backup roll are formed integral with each other; and these two integral formed rollers are crossed in the rolling direction.

In this embodiment, although the work roll bending and the cross-angle controller are used as the actuators for brevity, without being limited only thereto, it is of course possible to apply the gist of the present invention to the continuous rolling mills each provided with the other actuators.

A strip 8 is rolled in sequence from the first to seventh stands in the arrow direction. A profile gauge 10 and a flatness sensor 13 are provided on the delivery side of the fourth stand, a profile gauge 11 and a flatness sensor 14 are provided on the delivery side of the fifth stand, and further a profile gauge 12 and a flatness sensor 15 are provided on the delivery side of the seventh stand.

Further, on the basis of the outputs of the profile gauge 10 and the flatness sensor 13 arranged on the delivery side of the fourth stand, four strip crown controllers 21 to 24 output four controlled variables to work load benders of the first to fourth strands, respectively. Here, when the controlled variable exceeds an allowable range, each of the strip crown controllers 21 to 24 outputs another controlled variable to each cross angle controller at the same time. Further, on the basis of the outputs of the profile gauge 11 and the flatness sensor 14 arranged on the delivery side of the fifth stand, a strip crown controller 25 outputs a controlled variable to a work load bender and a cross angle controller of the fifth stand. Further, on the basis of the outputs of the profile gauge 12 and the flatness sensor 15 arranged on the delivery side of the seventh stand, two strip crown controllers 26 and 27 output two controlled variable to work load benders and cross angle controllers of the sixth and seventh stands, respectively.

The operation of the continuous rolling mills constructed as described above will be described hereinbelow in association with the related rolling theory.

(Simultaneous control)

Figure 21:
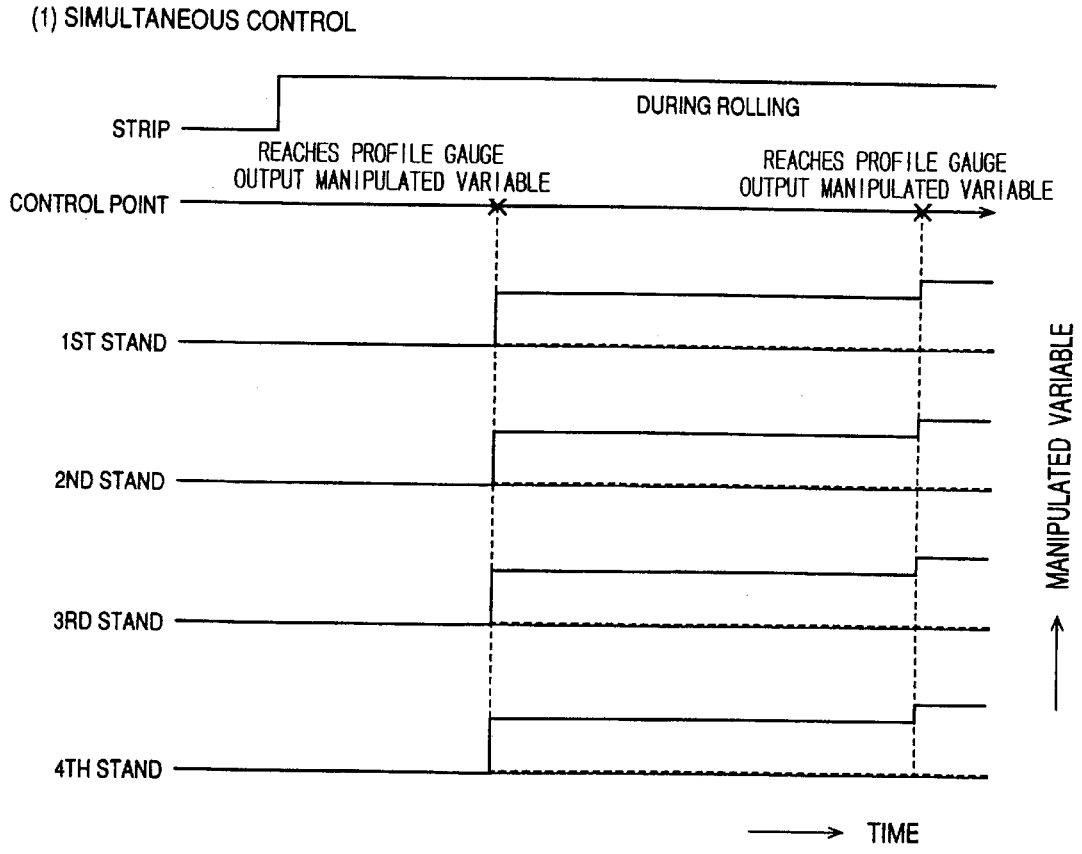
FIG. 21 is a timing chart for assistance in explaining the simultaneous output control method according to the present invention.

FIG. 21 shows a timing chart for assistance in explaining the simultaneous output control method according to the present invention.

The mechanical strip crown of the i-th stand, that is, the strip crown $C_{mi}$ obtained when the rolling force distribution in the width direction is uniform can be expressed by the following equation:

$$C_{mi}=A_i \cdot P_i+B_i \cdot \theta_{i2}+D_i \cdot F_{Bi}+E_i \cdot C_{WRi}+M_i \tag{1}$$

where $P_i$: rolling force of i-th stand $\theta_i$: cross angle of i-th stand $F_{Bi}$: work roll bending force of i-th stand $C_{WRi}$: work roll crown of i-th stand $A_i$, $B_i$, $D_i$, $E_i$, $M_i$: constants decided by rolling schedule In the above equation, the constants are referred to as influence coefficients upon the mechanical strip crown. Further, the strip crown $C_i$ on the delivery side of the i-th stand can be expressed by the following equation:

$$C_i=\alpha_i \cdot C_{mi}+\beta_i \cdot C_{i-1} \tag{2}$$

where $\alpha_i$: imprinting ratio of i-th stand $\beta_i$: inheritance coefficient of i-th stand $C_{i-1}$: strip crown on entry side of i-th stand Further, the following relationship is established among the entry strip thickness, the delivery side strip thickness, the imprinting ratio and the inheritance coefficient of the i-th stand:

$$\alpha_i+\frac{H_{ci}}{h_{ci}} \cdot \beta_i=1 \tag{3}$$

where $H_{ci}$: strip thickness at center in width direction on entry side of i-th stand $h_{ci}$: strip thickness at center in width direction on delivery side of i-th stand Further, the flatness $\delta_i$ of the i-th stand can be expressed on the basis of the entry strip crown, the delivery strip crown, the entry strip thickness and the delivery side strip thickness as follows:

$$\delta_i=\xi_i \cdot \left(\frac{C_i}{h_{ci}}-\frac{C_{i-1}}{H_{ci}}\right) \tag{4}$$

where $\xi_i$: shape disturbing-coefficient decided on stand rolling mill and rolling schedule In accordance with the above-mentioned rolling theory, the operation of the first embodiment will be described hereinbelow.

In the tandem rolling mills as shown in FIG. 1, in general, material is hot-rolled in unit of several tons or several tens of tons. Here, the strip is referred to as "one coil". In this case, the strip width and the strip thickness are both decided for each coil. Further, the cross angle and the work roll bending force of each of the first to seventh stands are both previously calculated by use of a host computer (not shown) and further set to the continuous rolling mills before rolling operation. Here, if there exists an error in each of the set values, since the strip crown and the flatness have an error on the delivery side of each stand, it is impossible to obtain the desired products. Further, since the strip is not constant with respect to the hardness, temperature, strip thickness, etc. in the rolling direction and strip width direction, the strip crown and the flatness fluctuate on the delivery side of each stand, with the result that it is also impossible to obtain the desired products.

The object of the present embodiment is to control both the strip crown and the strip thickness to desired values, respectively even under the above-mentioned conditions.

Here, the deviation $\Delta C_i$ of the strip crown and the deviation $\Delta\delta_i$ of the flatness of the i-th stand can be defined as follows:

$$\Delta C_i=C_i^{REF}-C_i^{MEAS} \tag{5}$$

$$C_i=h_{ci}-1/2 \cdot (h_{DR,i}^{Xc}+h_{OP,i}^{Xc}) \tag{5A}$$

$$\Delta\delta=\delta_i^{REF}\delta_i^{MEAS} \tag{6}$$

where $C_i^{REF}$: target value of strip crown on delivery side of i-th stand $C_i^{MEAS}$: measured value of strip crown on delivery side of i-th stand $\delta_i^{REF}$: target value of flatness on delivery side of i-th stand $\delta_i^{MEAS}$: measured value of flatness on delivery side of i-th stand $h_{ci}$: strip thickness at center in width direction on delivery side of i-th stand $h_{DR,i}^{Xc}$: strip thickness at position Xc away from drive-side strip width end on delivery side of i-th stand $h_{OP,i}^{Xc}$: strip thickness at position Xc away from operator-side strip width end on delivery side of i-th stand In general, although the target values and the measured values of both the strip crown and the flatness are obtained at respective points in the strip width direction, in the present embodiment, the strip crown is controlled at a position $X_c$ inward away from the strip width end and further the flatness is controlled at a position $X_F$ inward away from the strip width end. In this case, the case where $X_c=X_F$ is also included. However, the values of $X_c$ and $X_F$ are used in equations (1) to (4), respectively.

Now, the profile gauge 10 shown in FIG. 1 measures the strip crown on the delivery side of the fourth stand, and further the strip crown controllers 21 to 24 output controlled variables to the roll benders and the cross angle controllers of the corresponding stands on the basis of the measured values, respectively. In this case, each of the strip crown controllers 21 to 23 corresponding to the stands provided with no profile gauge on each delivery side thereof calculates the strip crown and further the controlled variables for the work roll bender and the cross angle controller on the basis of the calculated strip crown, in the same way as with the case of the strip crown controller 24 provided with the profile gauge 10.

Here, the method of obtaining the strip crown will be first explained. In the setting calculations of the strip crown and the flatness, the target strip crown value on the delivery side of the i-th stand is denoted as $C_i^{REF}$ (i=1 to 4). Further, the target rolling force value of each stand is denoted by $P_i^{REF}$; the target cross angle value of each stand is denoted by $\theta_i^{REF}$; the target work roll bending force value of each stand is denoted by $F_{Bi}^{REF}$; and the target work roll crown value of each stand is denoted by $C_{WRi}^{REF}$. Further, the measured rolling force value of each stand is denoted by $P_i^{MEAS}$; the measured cross angle value of each stand is denoted by $\theta_i^{MEAS}$; the measured work roll bending force value of each stand is denoted by $F_{Bi}^{MEAS}$; and the measured work roll crown value of each stand is denoted by $C_{WRi}^{MEAS}$.

On the basis of the above-mentioned target values and the measured values and in accordance with equation (1), the strip crown $C_i^{CAL}$ on each delivery side of the first to fourth stands are calculated, irrespective of the presence or absence of the profile gauge, as follows:

$$\begin{aligned} C_i^{CAL} = {} & C_i^{REF} + \alpha_i[A_i(P_i^{MEAS} - P_i^{REF}) + \\ & B_i\{(\theta_i^{MEAS})^2 - (\theta_i^{REF})^2\} + D_i(F_{Bi}^{MEAS} - F_{Bi}^{REF}) + \\ & E_i(C_{WRi}^{MEAS} - C_{WRi}^{REF})] + \beta_i(C_{i-1}^{CAL} - C_{i-1}^{REF}) \end{aligned} \tag{7}$$

Here, since $C_{i-1}^{CAL}=C_{i-1}^{REF}$ in the i-th stand, the delivery strip crown $C_1^{CAL}$ of the first stand can be first obtained; the delivery strip crown $C_2^{CAL}$ of the second stand can be next obtained; the delivery strip crown $C_3^{CAL}$ of the third stand can be then obtained; and the delivery strip crown $C_4^{CAL}$ of the fourth stand can be next obtained. That is, the strip crown on the delivery side of the downstream side stand can be calculated on the basis of the strip crown on the delivery side of the upstream side stand, in sequence.

Further, since the delivery strip crown of the fourth stand is measured by the profile gauge 10, when the deviation between the measured value $C_4^{MEAS}$ and the calculated value $C_4^{CAL}$ is allocated to the first to third stands, respectively, the final measured strip crown values $C_i^{MEAS}$ of the first to third stands can be obtained by the following equation:

$$C_i^{MEAS} = C_i^{CAL} - \frac{h_{ci}}{h_{cj}} \cdot (C_j^{CAL} - C_j^{MEAS}) \tag{8}$$

where i=1, 2 and 3; and j=4.

In the same way as above, on the basis of the deviation between the measured value $C_7^{MEAS}$ of the profile gauge 12 provided on the delivery side of the seventh stand and the calculated value $C_7^{CAL}$, the strip crown on the delivery side of the sixth stand provided with no profile gauge can be also obtained.

As described above, the strip crown of each i-th stand can be calculated on the basis of the difference between each target value and each measured value in the rolling force, the cross angle, the work roll bending force and the work roll crown, irrespective of the presence or absence of the strip crown. Further, on the basis of the deviation between the measured value of the profile gauge provided on the downstream side stand and the calculated value, the calculated values of the respective upstream stands can be corrected. As a result, it is possible to obtain the measured values in the same way as when the profile gauges are provided for all the stands, respectively. Further, when the strip crown controllers can correct the work roll bending forces and/or the cross angles, respectively on the basis of these measured values, it is possible to control the strip crown for each stand.

Further, in the above equation (7), although the strip crown caused by the backup roll is assumed to be small and thereby neglected, when this strip crown cannot be disregarded for each stand, it is preferable to use the equation including a term related to the strip crown caused by the backup roll.

Now, in the case where each strip crown is controlled at each of a plurality of continuously arranged stands independently, by the difference between the target value and the measured value of the profile gauge 10 provided on the delivery side of the fourth stand, it is possible to consider the simultaneous output control from the first to fourth stands. Here, the simultaneous output control implies to control all the work roll bending forces and/or the cross angles of the first to fourth stands substantially at the same time. To realize this simultaneous output control, the strip crown controllers 21 to 24 obtain the controlled variables for the roll benders and/or the cross angle controllers as follows:

First, the case where the work roll bending forces of the first to fourth stands are controlled at the same time will be explained. In this case, there are two methods. One method is to control the controlled variables for the work roll bending forces of the first to fourth stands to the same controlled variable or any predetermined proportion, and the other method is to control the controlled variables for the ratio crown (strip crown/strip thickness) of the first to fourth stands to the same controlled variable or any predetermined proportion.

The case where the controlled variables for the work roll bending forces of the first to fourth stands are controlled to the same controlled variable or any predetermined proportion will be first explained.

In accordance with equation (1), the deviation amount $\Delta C_{mi}$ of the mechanical strip crown $C_{mi}$ to the deviation amount $\Delta F_{Bi}$ of the work roll bending force $F_{Bi}$ of the i-th stand can be obtained by the following equation:

$$\Delta C_{mi}=D_i \cdot \Delta F_{Bi} \tag{9}$$

Further, in accordance with equation (2), the deviation amount $\Delta C_i$ of the strip crown $C_i$ of the i-th stand to both the deviation amount $\Delta C_{mi}$ of the mechanical strip crown $C_{mi}$ of the i-th stand and the deviation amount $\Delta C_{i-1}$ of the strip crown $C_{i-1}$ on the entry side of the i-th stand can be obtained by the following equation:

$$\Delta C_i=\alpha_i \cdot \Delta C_{mi}+\beta_i \cdot \Delta C_{i-1} \tag{10}$$

Therefore, when $\Delta C_{mi}$ of equation (9) is substituted for equation (10), the following equation can be obtained:

$$\Delta C_i=\alpha_i \cdot D_i \cdot \Delta F_{Bi}+\beta_i \cdot \Delta C_{i-1} \tag{11}$$

Therefore, the deviation amounts $C_i$ of the strip crown of the first to fourth stands can be developed as follows:

$$\begin{aligned}
\Delta C_1&=\alpha_1 \cdot D_1 \cdot \Delta F_{B1}+\beta_1 \cdot \Delta C_0\\
\Delta C_2&=\alpha_2 \cdot D_2 \cdot \Delta F_{B2}+\beta_2 \cdot \Delta C_1\\
\Delta C_3&=\alpha_3 \cdot D_3 \Delta F_{B3}+\beta_3 \cdot \Delta C_2\\
\Delta C_4&=\alpha_4 \cdot D_4 \Delta F_{B4}+\beta_4 \cdot \Delta C_3
\end{aligned} \tag{12}$$

Here, in equation (12), $\Delta C_0=0$.

Then, if $$\alpha_i \cdot D_i=\gamma_i \tag{13}$$

and further when the deviation amount $\Delta F_{Bi}$ of the work roll bending forces $F_{Bi}$ of each stand is obtained by multiplying the deviation amount $\Delta F_B$ of the work roll bending force by the proportion $W_i$ as follows: $\Delta F_{Bi}=W_i \cdot \Delta F_B$, equation (12) can be rewritten as (where $\Delta C_0=0$):

$$\begin{aligned}
\Delta C_1&=\gamma_1 \cdot W_1 \cdot \Delta F_B\\
\Delta C_2&=\gamma_2 \cdot W_2 \cdot \Delta F_B+\beta_2 \Delta C_1\\
\Delta C_3&=\gamma_3 \cdot W_3 \cdot \Delta F_B+\beta_3 \cdot \Delta C_2\\
\Delta C_4&=\gamma_4 \cdot W_4 \cdot \Delta F_B+\beta_4 \cdot \Delta C_3
\end{aligned} \tag{14A}$$

Therefore, when equation (14A) is solved for $\Delta C_4$, the following solution can be obtained:

$$\begin{aligned}
\Delta C_4 &= \gamma_4 \cdot W_4 \cdot \Delta F_B + \beta_4 \cdot (\gamma_3 \cdot W_3 \cdot \Delta F_B + \beta_3 \cdot \Delta C_2) \\
&= \gamma_4 \cdot W_4 \cdot \Delta F_B + \beta_4 \cdot (\gamma_3 \cdot W_3 \cdot \Delta F_B + \beta_3 \cdot (\gamma_2 \cdot W_2 \cdot \Delta F_B + \beta_2 \cdot \Delta C_1)) \\
&= \gamma_4 \cdot W_4 \cdot \Delta F_B + \beta_4 \cdot (\gamma_3 \cdot W_3 \cdot \Delta F_B + \beta_3 \cdot (\gamma_2 \cdot W_2 \cdot \Delta F_B + \beta_2 \cdot \gamma_1 \cdot W_1 \cdot \Delta F_B)) \\
&= \gamma_4 \cdot W_4 \cdot \Delta F_B + \beta_4 \cdot \gamma_3 \cdot W_3 \cdot \Delta F_B + \beta_4 \cdot \beta_3 \cdot \gamma_2 \cdot W_2 \cdot \Delta F_B + \beta_4 \cdot \beta_3 \cdot \beta_2 \cdot \gamma_1 \cdot W_1 \cdot \Delta F_B \\
&= \Delta F_B(\gamma_4 \cdot W_4 + \beta_4 \cdot \gamma_3 \cdot W_3 + \beta_4 \cdot \beta_3 \cdot \gamma_2 \cdot W_2 + \beta_4 \cdot \beta_3 \cdot \beta_2 \cdot \gamma_1 \cdot W_1)
\end{aligned} \tag{14B}$$

Further, when equation (14B) is solved for $\Delta F_B$, the following equation can be obtained:

$$\Delta F_B=\frac{\Delta C_4}{U} \tag{15}$$

$$U = W_1 \cdot \gamma_1 \cdot \beta_2 \cdot \beta_3 \cdot \beta_4 + W_2 \cdot \gamma_2 \cdot \beta_3 \cdot \beta_4 + W_3 \cdot \gamma_3 \cdot \beta_4 + W_4 \cdot \gamma_4$$

where $W_i$: given proportion (0 to 1.0)

Here, the fact that the controlled variables of the work roll bending force are controlled to the same value with respect to each other implies that $W_1=W_2=W_3=W_4$; and the fact that the controlled variables of the work roll bending force are controlled to any proportion implies that $W_1:W_2:W_3:W_4=a_1:a_2:a_3:a_4$($a_i$ is a predetermined value).

Therefore, the controlled variable $\Delta F_{Bi}$ of the work roll bending force of the first to fourth stands can be obtained by the following equation:

$$\Delta F_{Bi}=W_i \Delta F_B \tag{16}$$

As a result, it is possible to control the continuous rolling mills by applying a uniform load to the work roll benders of the stand rolling mills, under consideration of the bending force.

Successively, the case where the controlled variables for the ratio crown of the first to fourth stands are controlled to the same controlled variable or any predetermined proportion will be explained.

When the delivery side strip thickness of the i-th stand (i=1, 2 and 3) is denoted by $h_{ci}$; the strip crown deviation is denoted by $\Delta C_i$; the delivery side strip thickness of the fourth stand is denoted by $h_{c4}$; the strip crown deviation of the fourth stand is denoted by $\Delta C_4$; and the proportion of the controlled variable of the ratio crown of the i-th stand to the controlled variable of the ratio crown of the fourth stand is denoted by $W_i$, the following equation can be established:

$$\frac{\Delta C_i}{h_{ci}}=\frac{\Delta C_4}{h_{c4}} \cdot W_i \tag{17}$$

Therefore, when equation (17) is solved for $\Delta C_4$ and further substituted for equation (11), the following solution can be obtained:

$$\frac{h_{ci} \cdot \Delta C_4 \cdot W_i}{h_{c4}} = \alpha_i \cdot D_i \cdot \Delta F_{Bi} \frac{+\beta_i \cdot h_{ci-1} \cdot \Delta C_4 \cdot W_{i-1}}{h_{c4}} \tag{18}$$

Therefore, $$\alpha_i \cdot D_i \cdot \Delta F_{Bi}=\frac{\Delta C_4}{h_{c4}} \cdot V \tag{19}$$

where $V=h_{ci} \cdot W_i-\beta_i \cdot h_{ci-1} \cdot \Delta C_4 \cdot W_{i-1}$ Further, when equation (3) is transformed, the following equation can be obtained:

$$\beta_i \cdot h_{ci-1}=h_{ci}-\alpha_i \cdot h_{ci} \tag{20}$$

Further, when equation (20) is substituted for equation (18) and further equation (18) is solved for $\Delta F_{Bi}$, the following equation can be obtained:

$$\Delta F_{Bi}=\frac{W_i \cdot h_{ci}-W_{i-1} \cdot h_{ci}+W_{i-1} \cdot \alpha_i \cdot h_{ci}}{\alpha_i \cdot D_i \cdot h_{c4}} \cdot \Delta C_4 \tag{21}$$

Therefore, in accordance with equation (21), the controlled variables $\Delta F_{Bi}$ of the work roll bending force of the second to fourth stands can be obtained as above. Further, since the entry strip crown of the first stand is zero, the controlled variable of the work roll bending force of the first stand is calculated by use of the following equation:

$$\Delta F_{B1}=\frac{W_1 \cdot h_{c1} \cdot \Delta C_4}{\alpha_1 \cdot D_1 \cdot h_{c4}} \tag{22}$$

As a result, it is possible to control the continuous rolling mills by applying a uniform load to the roll benders of the stand rolling mills, under consideration of the strip crown ratio, without disturbing the shape of the strip.

As described above, in the case where the simultaneous output control is executed by obtaining the controlled variables of the respective work roll bending forces of the first to fourth stands, when the strip lead end is passed through the fourth stand and thereby the strip crown is measured by the profile gauge 10, the first simultaneous output control is executed. Further, when the strip to which the first simultaneous output control is executed by the first stand is passed through the fourth stand and thereby the strip crown is measured by the profile gauge 10, the second simultaneous output control is executed, and so on.

In the above description, although the controlled variables of the work roll bending forces of the first to fourth stands are calculated in accordance with equations (16) or (21) and

(22) for the simultaneous output control, it is necessary to confirm the degree of the controlled variable of the strip crown for manipulating the work roll bending force or whether the flatness obtained by the strip crown control lies within the allowable range. Here, if the strip flatness does not lie within the allowable range, the controlled variable of the work roll bending force must be changed. Therefore, the strip crown controllers 21 to 24 are provided with a function for changing the work roll bending force. Here, the method of calculating the controlled variable of the strip crown and the method of changing the controlled variable of the work roll bending force will be explained hereinbelow.

In this case, the controlled variable $\Delta C_i^{CTL}$ of the strip crown for the controlled variable $\Delta F_{Bi}$ of the work roll bending force can be expressed on the basis of the imprinting ratio $\alpha_i$ and the influence coefficient $D_i$ of the bending force upon the mechanical strip crown as follows:

$$\Delta C_i^{CTL}=\alpha_i \cdot D_i \cdot \Delta F_{Bi} \tag{23}$$

Therefore, it is possible to calculate the delivery strip crown $C_1^{CTL}$ to $C_4^{CTL}$ after the strip crowns have been controlled by applying manipulated variables to the work roll bending of the first to fourth stands, in accordance with the following equations:

$$C_1^{CTL} = C_1^{MEAS} + \Delta C_1^{CTL} \tag{24}$$

$$C_2^{CTL} = C_2^{MEAS} + \beta_2 \cdot \Delta C_1^{CTL} + \Delta C_2^{CTL} \tag{25}$$

$$C_3^{CTL} = C_3^{MEAS} + \beta_3 \cdot \beta_2 \cdot \Delta C_1^{CTL} + \beta_3 \cdot \Delta C_2^{CTL} + \Delta C_3^{CTL} \tag{26}$$

$$C_4^{CTL} = C_4^{MEAS} + \beta_4 \cdot \beta_3 \cdot \beta_2 \cdot \Delta C_1^{CTL} + \beta_4 \cdot \beta_3 \cdot \Delta C_2^{CTL} + \beta_4 \cdot \Delta C_3^{CTL} + \Delta C_4^{CTL} \tag{27}$$

where $C_i^{MEAS}$ measured strip crown value obtained by equation (8)

That is, it is possible to improve the control precision of the strip crown by correcting the controlled variables of the work roll bending forces on the basis of the total controlled variable of the strip crown, respectively.

Here, during the strip crown control, it is indispensable to control strip crown maintaining the flatness within the allowable range. To maintain the flatness within the allowable range is to maintain the flatness $\delta_i$ calculated in accordance with equation (4) between the upper and lower limits as follows:

$$a_i \leqq \delta_i \left( = \xi_i \cdot \left( \frac{C_i}{h_{ci}} - \frac{C_{i-1}}{H_{ci}} \right) \right) \leqq b_i \tag{28}$$

where $a_i$: lower limit of i-th stand $b_i$: upper limit of i-th stand

Further, $H_{ci}=h_{ci-1}$ by definition.

Therefore, it is possible to examine whether the flatness can be maintained within the allowable range by using the values $C_1^{CTL}$ to $C_4^{CTL}$ obtained after the strip crowns have been controlled in accordance with equations (24) to (27), as $C_i$ and $C_{i-1}$ in equation (28) above. Here, if the flatness lies out of the allowable range, the controlled variables $\Delta C_i^{CTL}$ of the strip crown the delivery side, that is, the controlled variables $\Delta F_{Bi}$ of the work roll bending force are changed, in the order of the fourth stand, the third stand, the second stand, and the first stand, so that each flatness lies between the upper limit value $a_i$ and the lower limit value $b_i$. By doing this, it is possible to control the strip crown under consideration of the flatness, without providing any flatness sensors.

Successively, when the work roll bending forces obtained as described above lie between the allowable limits of the work loading bending equipments, respectively, there arises no problem. However, since there exists the case where the work roll bending forces exceed the allowable limits, in the present embodiment, the cross angle is also controlled to correct the overflowed work roll bending force exceeding the allowable limits. The correction of the cross angle will be explained hereinbelow.

On the basis of equations (1) and (2), the deviation amount $\Delta C_i$ of the strip crown $C_i$ to the deviation amount $\Delta\theta_i$ of the cross angle $\theta_i$ and the deviation amount $\Delta F_{Bi}$ of the work roll bending force $F_{Bi}$ can be obtained by the following equation:

$$\Delta C_i=(B_i \cdot 2\theta_i \cdot \Delta\theta_i+D_i \cdot \Delta F_{Bi}) \cdot \alpha_i \tag{29}$$

Here, the following relationship can be established between the deviation amount $\Delta\theta_i$ and the deviation amount $\Delta F_{Bi}$, on condition that the strip crown does not change (i.e., $\Delta C_i=0$):

$$\Delta\theta_i = -\frac{D_i}{2\theta_i \cdot B_i} \cdot \Delta F_{Bi} \tag{30}$$

Here, if the overflowed work roll bending force is denoted by $\Delta F_{Bi}^{OVER}$, the cross angle variation amount $\Delta\theta_i$) for correcting this can be obtained by the following equation:

$$\Delta\theta_i = -\frac{D_i}{2\theta_i \cdot B_i} \cdot \Delta F_{Bi}^{OVER} \tag{31}$$

In the embodiment shown in FIG. 1, when the value of the flatness measured by the flatness sensor 13 lies within the allowable range, the strip crown controllers 21 to 24 calculate the controlled variables of the work roll bending forces on the basis of the measured value of the profile gauge 10 and in accordance with equations (16) or (21) and (22). The obtained controlled variables are applied to work roll bender control systems (not shown) via adders 41 to 44. respectively. Further, when the work roll bending force does not lie within the allowable range, the controlled variables of the cross angles are obtained in accordance with equation (31), and the obtained controlled variables are applied to cross angle control systems (not shown) via adders 41 to 44, respectively.

Even if the above-mentioned cross angle correction has been executed, when the value measured by the flatness sensor 13 still exceeds the allowable range, the flatness control is executed for the fourth stand as described later, without controlling the work roll bender and cross angle control systems. By doing this, even if the controlled variables for the strip crown are large, it is possible to control the strip crown securely and safely.

As described above, the simultaneous output control can be executed for the first to fourth stands. In the same way as above, the simultaneous output control can be executed for the fifth to seventh stands. In more detail, a profile gauge 11 and a flatness sensor 14 both arranged on the delivery side of the fifth stand measure the strip crown and flatness at the same points at which the profile gauge 10 and the flatness sensor 13 both arranged on the delivery side of the fourth stand measure the strip crown and the flatness. In the same way, a profile gauge 12 and a flatness sensor 15 both arranged on the delivery side of the seventh stand measure the strip crown and the flatness at the same points at which the profile gauge 10 and the flatness sensor 13 both arranged on the delivery side of the fourth stand measure the strip crown and the flatness.

Further, the strip crown controller 25 provided for the fifth stand calculates the strip crown deviation $\Delta C_5$ on the basis of the measured value of the profile gauge 11, and further calculates the controlled variable $\Delta F_{B5}$ of the work roll bending force of the fifth stand in accordance with the following equation:

$$\Delta F_{B5} = \frac{W}{\alpha_5 \cdot D_5} \tag{32}$$

$$\begin{aligned} W = {} & \Delta C_5 - \beta_5 \cdot \beta_4 \cdot \beta_3 \cdot \beta_2 \cdot \Delta C_1^{CTL} - \\ & \beta_5 \cdot \beta_4 \cdot \beta_3 \cdot \Delta C_2^{CTL} - \\ & \beta_5 \cdot \beta_4 \cdot \Delta C_3^{CTL} - \\ & \beta_5 \cdot \Delta C_4^{CTL} \end{aligned} \tag{33}$$

In other words, the strip crown controller 25 multiplies the controlled variables $C_i^{CTL}$ of the stands arranged on the upstream side from the fifth stand by the inheritance coefficients $\beta_i$, subtracts the multiplied results from the strip crown deviation $\Delta C_5$, and obtains the controlled variable $\Delta F_{B5}$ of the work roll bending force by dividing the obtained subtraction results by the product of the imprinting ratio and the influence coefficient upon the mechanical strip crown. Further, the strip crown controller 25 applies the obtained result to the work roll bender control system (not shown) via an adder 45. Here, when the work roll bending force is out of the allowable range, the strip crown controller 25 calculates the controlled variable of the cross angle in accordance with equation (31) and applies the obtained result to the cross angle control system (not shown) via the adder 45.

In the same way as above, two strip crown controllers 26 and 27 provided for the sixth and seventh stands, respectively calculate the controlled variables of the work roll bending forces for the sixth and seventh stands on the basis of the measured values of the profile gauge 12 and the flatness sensor 15, apply the obtained results to the work roll bender control systems (not shown) via two adders 46 and 47, respectively. Here, when the work roll bending force is out of the allowable range, the strip crown controllers 26 and 27 calculate the controlled variables of the cross angle in accordance with equation (31), respectively and apply the obtained results to two cross angle control systems (not shown) via the adders 46 and 47, respectively. By doing this, it is possible to control the strip crown of the strip on the upstream side from the measurement position at high speed, on the basis of all the stand rolling mills arranged on the upstream side thereof, respectively.

(Delay control)

In the above description, the case where the strip crown is controlled at the same time by the strip crown controllers 21 to 27 has been explained. On the other hand, it is possible to provide a delay function for the strip crown controllers 21 to 27, respectively. In this delay control function, when the strip crown control point reaches a downstream stand rolling mill, the controlled variable is compensated for by the downstream stand rolling mill. This delay control will be described hereinbelow by taking the case where the strip crown control is applied to the first to fourth stands in the same way as already explained.

When the controlled variables for the work roll bending forces of the first to fourth stands are controlled to the same controlled variable or any predetermined proportion, in the same way as with the case of the simultaneous output control, the controlled variables of the work roll bending forces are obtained in accordance with equations (15) and (16). Further, when the controlled variables for the ratio crowns are controlled to the same controlled variable or any predetermined proportion, in the same way as with the case of the simultaneous output control, the controlled variables of the work roll bending forces are obtained in accordance with equations (21) and (22). Further, after the strip crowns after having been controlled have been obtained in accordance with equations (24) to (27), if the obtained values exceed the allowable range as expressed by equation (28), it is possible to change the controlled variables of the work roll bending forces and to obtain the corrected value of the roll cross angle in accordance with equation (31), in the same way as with the case of the simultaneous output control.

On the basis of these controlled variables, there are two methods of executing the delay control as follows:

(First delay control)

Figure 22:
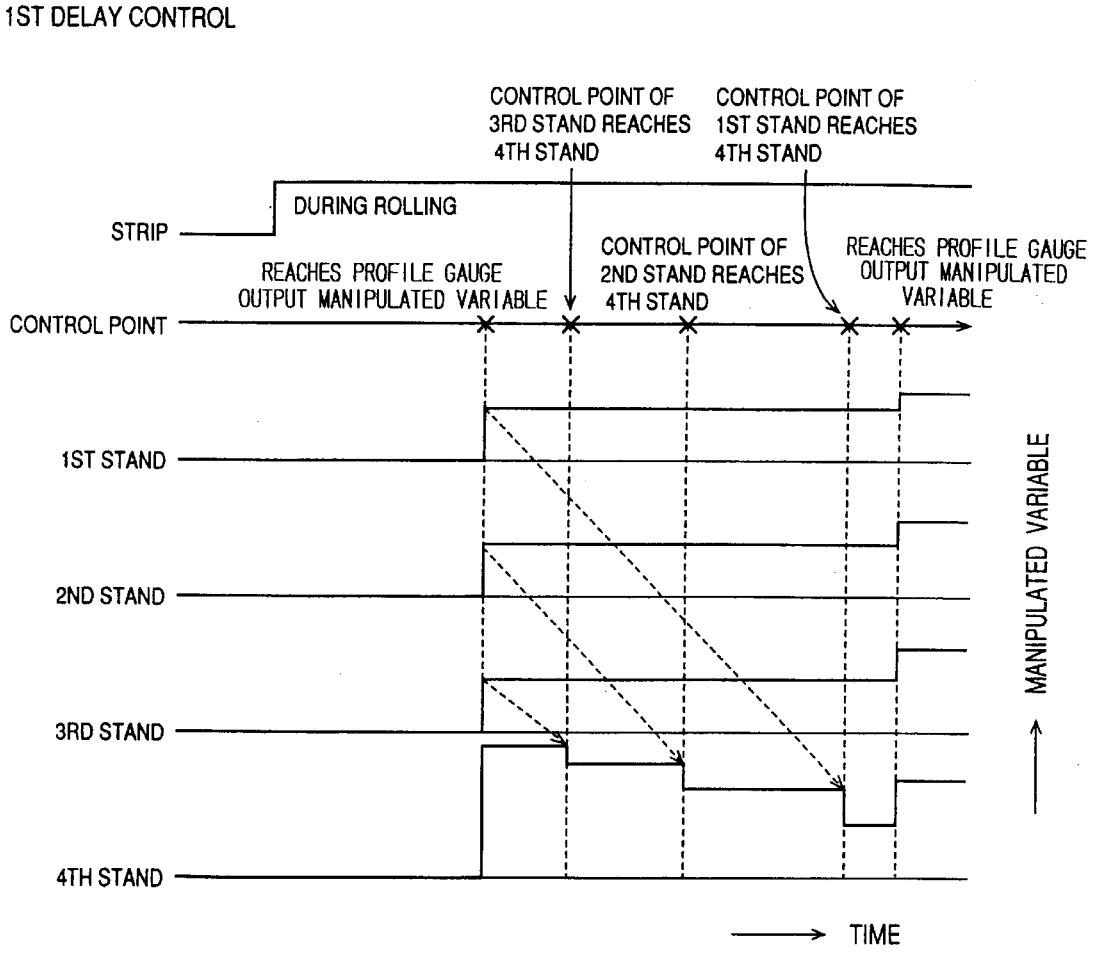
FIG. 22 is a timing chart for assistance in explaining the first delay control method according to the present invention.

FIG. 22 shows a timing chart for assistance in explaining the first delay control method according to the present invention.

In the first method, in addition to the above-mentioned controlled variables, the controlled variable $\Delta F_{B4}$ of the work roll bending force is calculated, to reduce the crown deviation $\Delta C_4$ to zero at only the fourth stand, in accordance with the following equation:

$$\Delta F_{B4} = \frac{\Delta C_4}{\alpha_4 \cdot D_4} \tag{34}$$

The controlled variable $\Delta F_{B4}$ of the work roll bending force is also checked as to whether it exceeds the flatness limit on the basis of equation (28). If it exceeds the limit, the controlled variable $\Delta C_4'$ of the strip crown corresponding to the limit value is obtained, and further the controlled variable $\Delta F_{B4}$ of the work roll bending force corresponding to this strip crown controlled variable $\Delta C_4'$ is also obtained.

Now, when the strip crown is started to be measured by the profile gauge 10 and the flatness is started to be measured by the flatness sensor 13, the strip crown controller 24 executes the control on the basis of the controlled variable $\Delta F_{B4}$ or the modified control value $\Delta F_{B4}'$ of the work roll bending force calculated in accordance with equation (34). At the same time, the strip crown controllers 21 to 23 corresponding to the first to third stands execute the control on the basis of the controlled variables $\Delta F_{Bi}$ to $\Delta FB_3$ of the work roll bending forces calculated in accordance with equations (24) to (27).

Then, when the control point of the third stand reaches the fourth stand, the strip crown controller 24 compensates inversely for the work roll bending force of the fourth stand by the controlled variable of the work roll bending force calculated in accordance with the following equation. That is, the strip crown controller adds the manipulated variable having a minus sign to the work roll bending force.

$$\Delta F_{B4} = -\frac{\beta_4 \cdot \Delta C_3^{CTL}}{\alpha_4 \cdot D_4} \tag{35}$$

Further, when the control point of the second stand reaches the fourth stand, the strip crown controller 24 compensates inversely for the work roll bending force of the fourth stand by the controlled variable of the work roll bending force calculated in accordance with the following equation:

$$\Delta F_{B4} = -\frac{\beta_4 \cdot \beta_3 \cdot \Delta C_2^{CTL}}{\alpha_4 \cdot D_4} \tag{36}$$

Finally, when the control point of the first stand reaches the fourth stand, the strip crown controller 24 compensates inversely for the work roll bending force of the fourth stand by the controlled variable of the work roll bending force calculated in accordance with the following equation:

$$\Delta F_{B4} = -\frac{\beta_4 \cdot \beta_3 \cdot \beta_2 \cdot \Delta C_1^{CTL}}{\alpha_4 \cdot D_4} \tag{37}$$

By the above calculations, it is possible to control the strip crowns at roughly all the positions of the strip on the upstream side from the measurement point.

(Second delay control)

Figure 23:
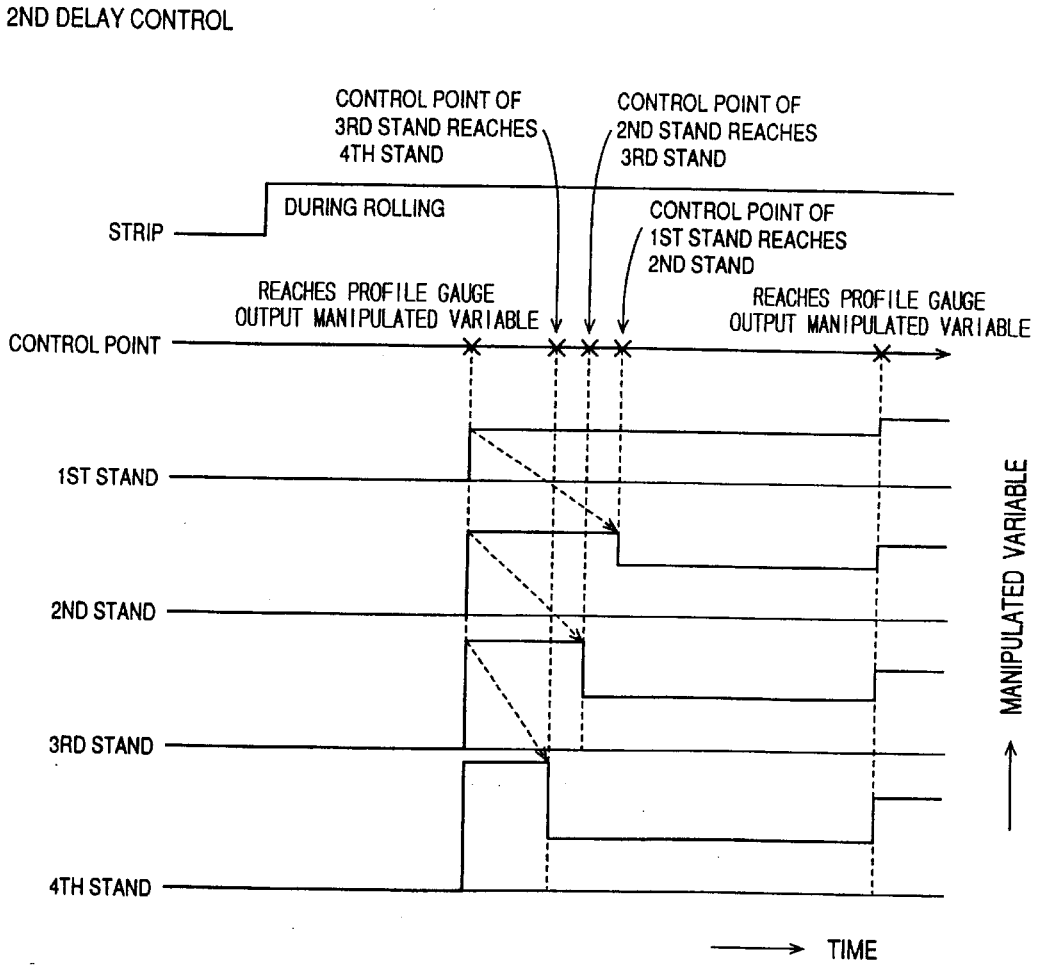
FIG. 23 is a timing chart for assistance in explaining the second delay control method according to the present invention.

FIG. 23 shows a timing chart for assistance in explaining the second delay control method according to the present invention.

In the second method, when the strip crown is started to be measured by the profile gauge 10 and the flatness is started to be measured by the flatness sensor 13 respectively, the strip crown controller 24 executes the control on the basis of the controlled variable $\Delta F_{B4}$ of the work roll bending force calculated in accordance with equation (34) or the modified control value $\Delta F_{B4}'$ In this case, the strip crown controller 23 corresponding to the third stand executes the control on the basis of the controlled variable $\Delta F_{B3}$ of the work roll bending force calculated in accordance with the following equation:

$$\Delta F_{B3} = \frac{\beta_3 \cdot \beta_2 \cdot \Delta C_1^{CTL} + \beta_3 \cdot \Delta C_2^{CTL} + \Delta C_3^{CTL}}{\alpha_3 \cdot D_3} \tag{38}$$

Further, the strip crown controller 22 corresponding to the second stand executes the control on the basis of the controlled variable $\Delta F_{B2}$ of the work roll bending force calculated in accordance with the following equation:

$$\Delta F_{B2} = \frac{\beta_2 \cdot \Delta C_1^{CTL} + \Delta C_2^{CTL}}{\alpha_2 \cdot D_2} \tag{39}$$

Further, the strip crown controller 21 corresponding to the first stand executes the control on the basis of the controlled variable $\Delta F_{B1}$ of the work roll bending force calculated in accordance with the following equation:

$$\Delta F_{B1} = \frac{\Delta C_1^{CTL}}{\alpha_1 \cdot D_1} \tag{40}$$

The strip crown controllers 21 to 23 execute these controls at the same time when the strip crown controller 24 starts to execute the control of the work roll bending force.

Then, when the control point of the third stand reaches the fourth stand, the strip crown controller 24 compensates inversely for the work roll bending force of the fourth stand by the controlled variable of the work roll bending force calculated in accordance with the following equation. That is, the strip crown controller adds the manipulated variable having a minus sign to the work roll bending force.

$$\Delta F_{B4} = -\frac{X}{\alpha_4 \cdot D_4} \tag{41}$$

-continued $$X = \beta_4 \cdot \beta_3 \cdot \beta_2 \cdot \Delta C_1^{CTL} + \beta_4 \cdot \beta_3 \cdot \Delta C_2^{CTL} + \beta_4 \cdot \Delta C_3$$

Further, when the control point of the second stand reaches the third stand, the strip crown controller 23 compensates inversely for the work roll bending force of the third stand by the controlled variable of the work roll bending force calculated in accordance with the following equation:

$$\Delta F_{B3} = -\frac{\beta_3 \cdot \beta_2 \cdot \Delta C_1^{CTL} + \beta_3 \cdot \Delta C_2^{CTL}}{\alpha_3 \cdot D_3} \tag{42}$$

Finally, when the control point of the first stand reaches the second stand, the strip crown controller 22 compensates inversely for the work roll bending force of the second stand by the controlled variable of the work roll bending force calculated in accordance with the following equation:

$$\Delta F_{B2} = \frac{\beta_2 \cdot \Delta C_1^{CTL}}{\alpha_2 \cdot D_2} \tag{43}$$

The above strip crown deviations $\Delta C_i^{CT}$ (i=1, 2, 3) of the above equations (35) to (43) are obtained by transforming the controlled variables $\Delta F_{Bi}$ of the work roll bending force obtained in accordance with equations (21) and (22) or (15) and (16), into the strip crown control values by use of equation (23).

Successively, the operation of the strip crown controllers 25 to 27 for the delay control will be described hereinbelow.

The profile gauge 11 measures, on the delivery side of the fifth stand, the point at which the strip crown has been measured by the profile gauge 10 on the delivery side of the fourth stand. Further, the strip crown controller 25 calculates the strip crown deviation $\Delta C_5$ on the basis of this measured value, and further executes the control on the basis of the controlled variable of the work roll bending force calculated in accordance with the following equation:

$$\Delta F_{B5} = \frac{\Delta C_5 - \beta_5 \cdot \Delta C_4^{CTL}}{\alpha_5 \cdot D_5} \tag{44}$$

Further, the profile gauge 12 measures, on the delivery side of the seventh stand, the point at which the strip crown has been measured by the profile gauge 10 on the delivery side of the fourth stand. Further, the strip crown controller 26 calculates the strip crown deviation $\Delta C_6$ on the basis of this measured value, and further executes the control on the basis of the controlled variable of the work roll bending force calculated in accordance with the following equation:

$$\Delta F_{B6} = \frac{\Delta C_6 - \beta_6 \cdot \beta_5 \cdot \Delta C_4 - \beta_6 \cdot \Delta C_5^{CTL}}{\alpha_6 \cdot D_6} \tag{45}$$

Further, the strip crown controller 27 calculates the strip crown deviation $\Delta C_7$ on the basis of the measured value, and executes the control by the controlled variable of the work roll bending force calculated in accordance with the following equation:

$$\Delta F_{B7} = \frac{Y}{\alpha_7 \cdot D_7} \tag{46}$$

-continued $$Y = \Delta C_7 - \beta_7 \cdot \beta_6 \cdot \beta_5 \cdot \Delta C_4 - \beta_7 \cdot \beta_6 \cdot \Delta C_5^{CTL} - \beta_7 \cdot \Delta C_6^{CTL}$$

Further, $\Delta C_6^{CTL}$ of equation (46) is the controlled variable on the delivery side of the sixth stand obtained on the basis of the controlled variable $\Delta F_{B6}$ of the work roll bending force of equation (45).

The above-mentioned delay control has been explained on the assumption that all the measured values of the flatness sensors 13, 14 and 15 lie within the allowable range, respectively. However, when the measured value of the flatness sensor 13 exceeds the allowable range, the flatness is controlled at the fourth stand; when the measured value of the flatness sensor 14 exceeds the allowable range, the flatness is controlled at the fifth stand; and when the measured value of the flatness sensor 15 exceeds the allowable range, the flatness is controlled at the seventh stand, respectively. These flatness controls will be described later.

On the other hand, as the method of controlling the strip crown and the flatness on the basis of the outputs of the profile gauges 10, 11 and 12, it is possible to execute monitor control, in addition to the simultaneous output control and the delay control. In this case, the controlled variables of the work roll benders can be decided as follows:

In the first to fourth stands, the strip crown deviation $\Delta C_4$ is obtained on the basis of the measured value of the profile gauge 10 and in accordance with equation (5), and after that the controlled variables of the work roll bending forces of the i-th stands (i=1,2,3,4) are calculated in accordance with the following equations:

$$\Delta F_{Bi} = G_{Mi} \cdot \frac{1}{\alpha_i \cdot D_i} \cdot \frac{1}{S} \cdot \Delta C_4 \tag{47}$$

where $G_{Mi}$: control gain

S: Laplace operator

During this monitor control, in the first to third stands, it is checked whether the flatness lies between the upper and lower limits a and b at each of these stands in accordance with equation (28). If the flatness exceeds the upper and lower limits, this monitor control is not executed. Further, when the work roll bending force exceeds the allowable limit of the equipment performance, the work roll bending force is reduced within the limit value. Further, in order to compensate for the excessive amount, the cross angle manipulated value $\Delta\theta_i$ is calculated in accordance with equation (31), and the cross angle is controlled on the basis of this calculated cross angle manipulated value.

Further, in the fifth stand, the strip crown deviation $\Delta C_5$ is calculated on the basis of the measured value of the profile gauge 11 and in accordance with equation (5), and after that the controlled variable of the work roll bending force of the fifth stand is calculated by the following equation:

$$\Delta F_{B5} = G_{M5} \cdot \frac{1}{\alpha_5 \cdot D_5} \cdot \frac{1}{S} \cdot \Delta C_5 \tag{48}$$

Further, the checking of the flatness as to whether the value lies between the upper and lower limits and the calculation in the case that the work roll bending force exceeds the equipment limit are both executed in the same way as already explained.

Further, in the sixth and seventh stands, the strip crown deviation $\Delta C_7$ is calculated on the basis of the measured value of the profile gauge 12 and in accordance with equation (5), and after that the controlled variables of the work roll bending force of the sixth and seventh stands are calculated by the following equation:

$$\Delta F_{Bi} = G_{Mi} \cdot \frac{1}{\alpha_i \cdot D_i} \cdot \frac{1}{S} \cdot \Delta C_7 \tag{49}$$

Further, the checking of the flatness as to whether the value lies between the upper and lower limits and the calculation in the case that the work roll bending force exceeds the equipment limit are both executed in the same way as already explained.

The above-mentioned respective controls are described on condition that all the measured values of the flatness sensors 13, 14 and 15 lie within the allowable range. However, when the measured values of the flatness sensors 13, 14 and 15 do not lie within the allowable range, the flatness is controlled directly as follows:

[Second embodiment]

Figure 2:
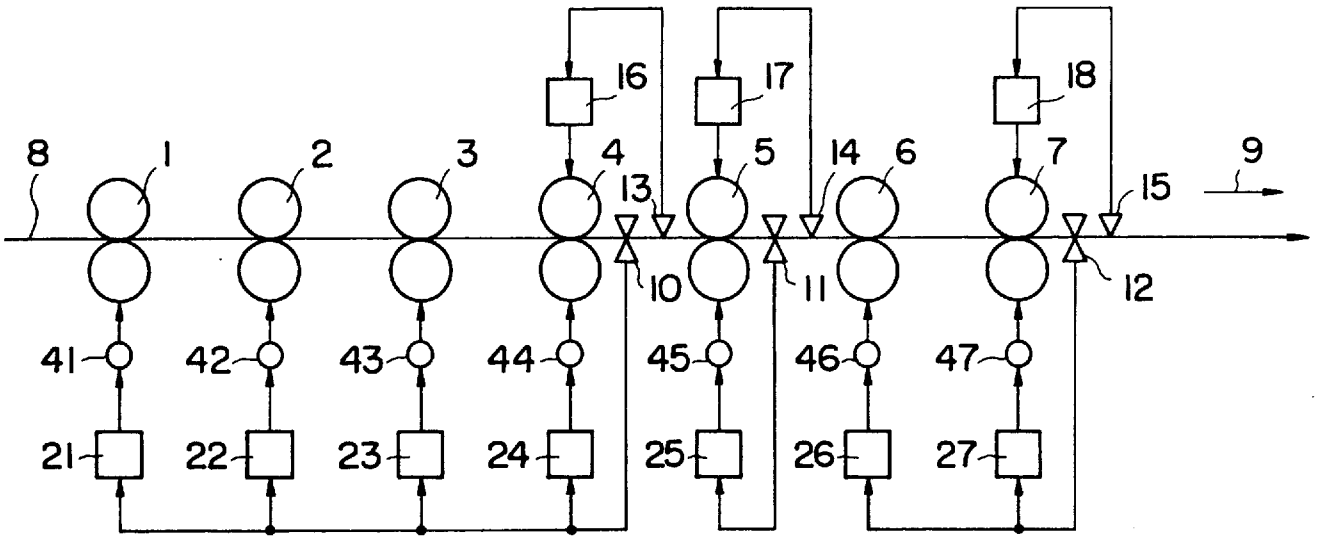
FIG. 2 is a block diagram showing a second embodiment of continuous rolling mills to which the method according to the present invention is applied.

FIG. 2 shows a second embodiment of the configuration of the continuous rolling mills, which are used when the measured values of the flatness sensors 13, 14 and 15 are out of the allowable range, respectively, In FIG. 2, the same reference numerals have been retained for similar sections having the same functions as with the case of the continuous rolling mills shown in FIG. 1.

In this second embodiment, a flatness controller 16 controls any one or both of the work roll bending force and the work roll leveling of the fourth stand on the basis of the output of the flatness sensor 13; a flatness controller 17 controls any one or both of the work roll bending force and the work roll leveling of the fifth stand on the basis of the output of the flatness sensor 14; and a flatness controller 18 controls any one or both of the work roll bending force and the work roll leveling of the seventh stand on the basis of the output of the flatness sensor 15. Further, in FIG. 2, the input routes from the flatness sensors 13 to 15 to the strip crown controllers 21 to 27 are omitted, respectively for brevity.

Here, the flatness sensor 13 measures the flatness at N points in the strip width direction, respectively. In these measured values, a measured value in the vicinity of the center in the strip width direction is denoted by $\delta_c^{MEAS}$. On the other hand, a measured value in the vicinity of a point $X_F$ away from an end in the strip width direction on the drive side is denoted by $\delta_{DR}^{NEAS}$, and a measured value in the vicinity of a point $X_F$ away from an end in the strip width direction on the operator side is denoted by $\delta_{OP}^{MEAS}$.

Figure 3:
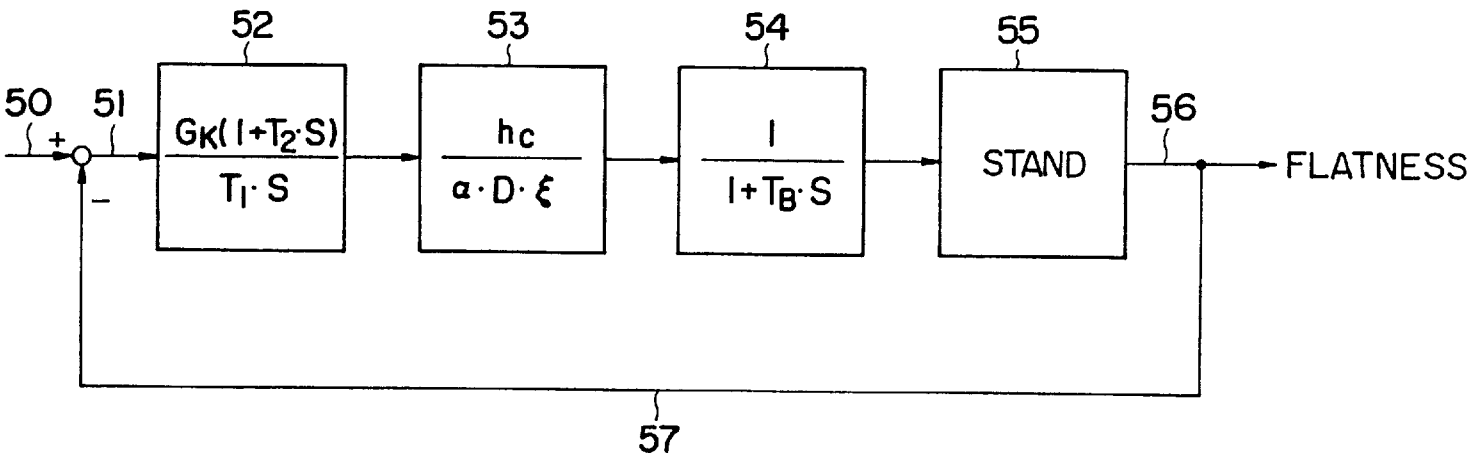
FIG. 3 is a block diagram showing a first example of a flatness controller adopted for the method according to the present invention.

FIG. 3 shows an example of the configuration of the flatness controller 16. In FIG. 3, a difference between a target flatness 50 and a measured flatness value 57 (i.e., a flatness deviation 51) is given to a PI controller 52. This PI controller 52 has a total gain $G_k$, an integral gain $1/T_1$, and a proportional gain $T_2/T_1$. The output of the PI controller 52 is given to a work roll bender 54 via a transform gain 53. The work roll bender 54 controls the bending operation of the work roll of a stand rolling mill 55. The measured flatness value 57 can be obtained by the flatness sensor 56 equipped on the delivery side of the stand rolling mill 55.

Here, the target flatness 50 can be give by the following equation:

$$\frac{\delta_{DR}^{REF} + \delta_{OP}^{REF}}{2} - \delta_c^{REF} \tag{A}$$

where $\delta_{DR}^{REF}$: target flatness value on drive side $\delta_{OP}^{REF}$: target flatness value on operator side $\delta_c^{REF}$: target flatness value at center in width direction Further, the measured flatness value 57 can be give by the following equation:

$$\frac{\delta_{DR}^{MEAS} + \delta_{OP}^{MEAS}}{2} - \delta_c^{MEAS} \quad \text{(B)}$$

As described above, the flatness controller 16 controls the work roll bending force so that the deviation between the target flatness 50 and the measured flatness value 57 can be reduced to zero. The other flatness controllers 17 and 18 control the work roll bending forces of the fifth and seventh stands, respectively in the same way as above.

Figure 4:
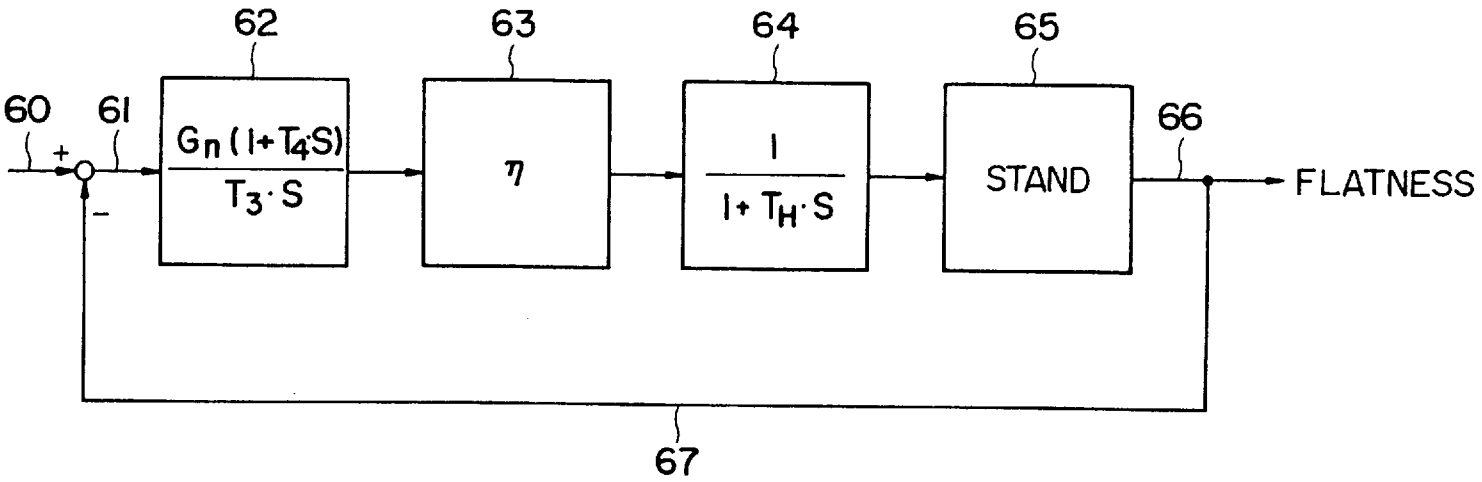
FIG. 4 is a block diagram showing a second example of a flatness controller adopted for the method according to the present invention.

FIG. 4 shows another configuration of the flatness controllers 16, 17 and 18, by which the roller gap leveling can be controlled. In FIG. 4, a difference between a target flatness 60 and a measured flatness value 67 (i.e., a flatness deviation 61) is given to a PI controller 62. This PI controller 62 has a total gain $G_n$, an integral gain $1/T_3$, and a proportional gain $T_4/T_3$. The output of the PI controller 62 is given to a roller gap leveling 64 via a transform gain 63. The roller gap leveling 64 controls the work roll leveling operation of a stand rolling mill 65. The measured flatness value 67 can be obtained by the flatness sensor 66 equipped on the delivery side of the stand rolling mill 65.

Here, the target flatness 60 can be given by the following equation:

$$\delta_{DR}^{REF} - \delta_{OP}^{REF}$$

Further, the measured flatness value 67 can be given by the following equation:

$$\delta_{DR}^{MEAS} - \delta_{OP}^{MEAS}$$

On the other hand, the transform gain 63 can be given by the following equation:

$$\eta = \frac{h_c}{\alpha \cdot \frac{\partial C_m}{\partial L} \cdot \xi} \quad (50)$$

where $\partial C_m/\partial C$: mechanical wedge change rate of roller leveling Further, the strip wedge implies a difference in strip thickness between the operator side and the drive side, which is discriminated from the mechanical strip wedge (i.e., the virtual strip wedge obtained when the rolling force distribution is uniform in the width direction). Further, $T_H$ in the roll gap leveling 64 shown in FIG. 4 denotes a time constant.

In these methods, it is possible to previously prevent the flatness from being deteriorated due to the strip crown control.

Further, in the flatness control by the flatness controllers as shown in FIGS. 3 and 4, the control can be executed at a predetermined period $T_{s1}$ or continuously.

[Third embodiment]

Figure 5:
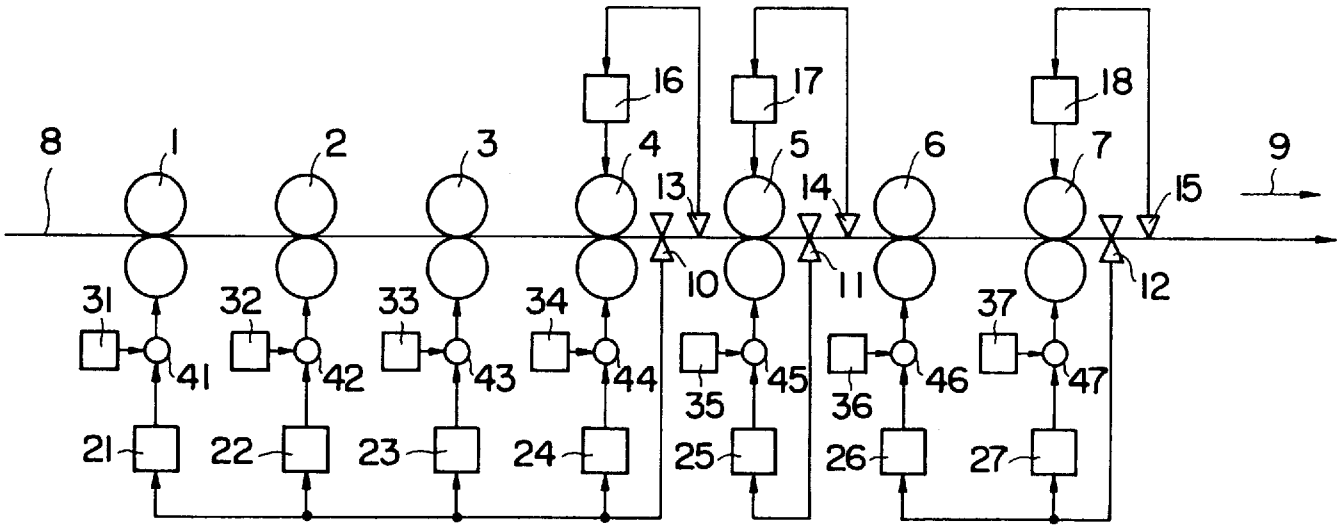
FIG. 5 is a block diagram showing a third embodiment of continuous rolling mills to which the method according to the present invention is applied.

FIG. 5 shows a third embodiment of the configuration of the continuous rolling mills together with the rolling system, in which the same reference numerals have been retained for similar sections having the same functions as with the case of the continuous rolling mills shown in FIG. 2. In this third embodiment, in addition to the above-mentioned control, a force following control can be executed to remove the strip crown caused by rolling force variation. In more detail, force following controllers 31 to 37 are provided in correspondence to the first to seventh stands, and the controlled variables of the work roll bending forces are applied to the benders via adders 41 to 47, respectively. The operation of this embodiment will be described hereinbelow.

In the setting calculation of an upper level computer (not shown), the command $p^L$ is switched between the strip end and other positions except the strip end, and further the measured rolling force value $P^{MEAS}$ differs according to the load cells (not shown). When a difference between the command $P^L$ and the measured rolling force values $p^{MEAS}$ increases, it is considered that the strip crown increases. Therefore, the rolling force deviation ΔP is obtained by the following equation:

$$\Delta P = P^{MEAS} - P^L \quad (51)$$

Further, the deviation amount $\Delta C_i$ of the strip crown due to the deviation amount $\Delta P_i$ of the rolling force $P_i$ and the deviation amount $\Delta F_{Bi}$ of the work roll bending force $F_{Bi}$ load can be obtained in accordance with equations (1) and (2) as follows:

$$\Delta C_i = (A_i \cdot \Delta P_i + D_i \cdot \Delta F_{Bi}) \cdot \alpha_i \quad (52)$$

Here, the following relationship can be established between the deviation amount $\Delta P_i$ of the rolling force and the deviation amount $\Delta F_{Bi}$ of the work roll bending force, on condition that the strip crown does not change (i.e., $\Delta C_i = 0$):

$$\Delta F_{Bi} = \frac{A_i}{D_i} \cdot \Delta P \quad (53)$$

The force following controllers 31 to 37 execute the calculations in accordance with equations (51) and (53), and obtain the controlled variables $\Delta F_{Bi}$ of the bending force by multiplying the calculated value by the control gain, to control the work roll benders via the adders 41 to 47, respectively. Further, in the force following control, the control can be executed at a predetermined period $T_{s1}$ or continuously. In this force following control, it is possible to control the strip crown caused by the rolling force variation at any time.

[Fourth embodiment]

Figure 6:
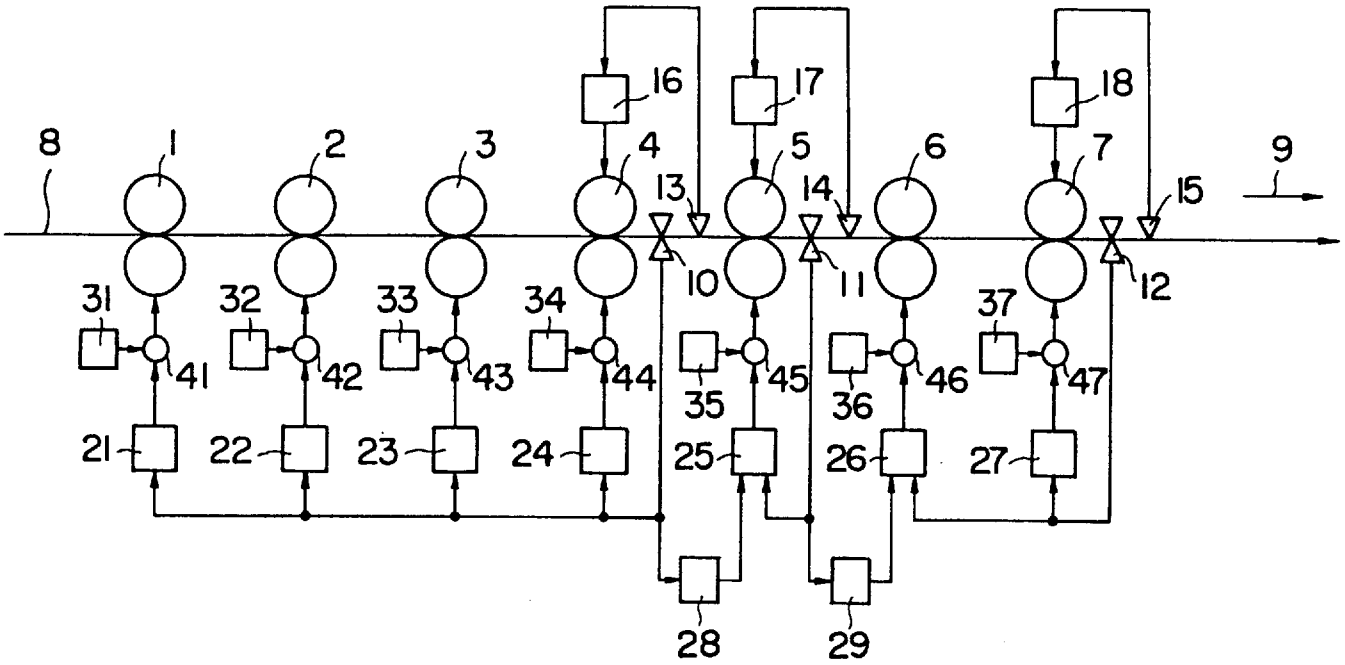
FIG. 6 is a block diagram showing a fourth embodiment of continuous rolling mills to which the method according to the present invention is applied.

FIG. 6 shows a fourth embodiment of the configuration of the continuous rolling mills, in which the same reference numerals have been retained for similar sections having the same functions as with the case of the continuous rolling mills shown in FIG. 5. In this fourth embodiment, in addition to the above-mentioned control shown in FIG. 4, feed-forward control can be executed for the strip crown.

In more detail, two feed-forward controllers 28 and 29 calculate control variables of the work roll bending force to remove the strip crown deviations, and apply the calculated controlled variables to the strip crown controllers 25 and 26 arranged on the stands arranged on the downstream side from the controllers 26 and 27, respectively.

Here, the feed-forward controller 28 obtains the deviation $\Delta C_4^{FF}$ between the target strip crown value $C_4^{REF}$ of the fourth stand and the measured value $C_4^{MEAS}$ of the profile gauge 10. Further, when this measurement point reaches the fifth stand, the feed-forward controller 28 applies the controlled variable $\Delta F_{B5}^{FF}$ of the work roll bending force obtained by the following equation to the strip crown controller 25:

$$\Delta F_{B5}^{FF} = \frac{G_5^{FF} \cdot \Delta C_4^{FF} \cdot \beta_5}{\alpha_5 \cdot D_5} \quad (54)$$

where $G_5^{FF}$:control gain

Further, when the above-mentioned measurement point reaches the profile gauge 11, the feed-forward controller 29 obtains the deviation $\Delta C_5^{FF}$ between the target strip crown value $C_5^{REF}$ of the fifth stand and the measured value $C_5^{MEAS}$ of the profile gauge 11. Further, when this measurement point reaches the sixth stand, the feed-forward controller 29 applies the controlled variable $\Delta F_{B6}^{FF}$ of the work roll bending force obtained by the following equation to the strip crown controller 26:

$$\Delta F_{B6}^{FF} = G_6^{FF} \frac{\Delta C_5^{FF} \cdot \beta_6 - \Delta C_4^{FF} \cdot \beta_6 \cdot \beta_5}{\alpha_6 \cdot D_6} \tag{55}$$

where $G_6^{FF}$:control gain

Further, when the feed-forward control is adopted, it is possible to control the strip crown in combination with the other control methods.

In the fourth embodiment shown in FIG. 6, since the continuous rolling mills are each provided with all the controllers for the simultaneous strip crown control, the delay control, the monitor control, the flatness control, the force following control, and the feed-forward control, when the continuous rolling mills are used, it is possible to maintain the strip crown and the flatness within the desired ranges, respectively in almost all the rolling schedule. However, it is not necessarily required to use all of the these control methods; that is, the numbers of control methods and the control modes can be selected freely according to the required control precision.

Further, in the above-mentioned embodiments, although the case where the roll benders and the cross angle controllers are provided as actuators for controlling the strip crown and the flatness have been described by way of example, even if the other actuators such as intermediate roll bending, work roll coolant, work roll shift, intermediate roll shift, etc. are provided for the six-stage roll rolling mills, it is possible to obtain the controlled variables for the actuators of these other types, by modifying and/or developing the aforementioned basic equations such as equation (1) for expressing the relationship between the mechanical strip crown and the elements exerting influence thereupon; equation (2) for expressing the relationship between the mechanical strip crown and the imprinting ratio, the inheritance coefficient; and equation (3) for expressing the relationship between the strip thickness and the imprinting ratio, the inheritance coefficient. Further, in the above-mentioned embodiments, although the continuous rolling mills have been explained by way of example, the above-mentioned control can be of course adopted to a single stand rolling mill or CVC (continuous Variable Crown) rolling mills.

Various methods of measuring and controlling strip crowns of any desired rolling mills (i.e., stands) of a plurality of tandem-arranged continuous rolling mills according to the present invention will be described hereinbelow with reference to the attached drawings. In the embodiment, the continuous rolling mills are provided with at least one actuator for controlling each strip crown of each rolling mill.

(First method)

Figure 7A:
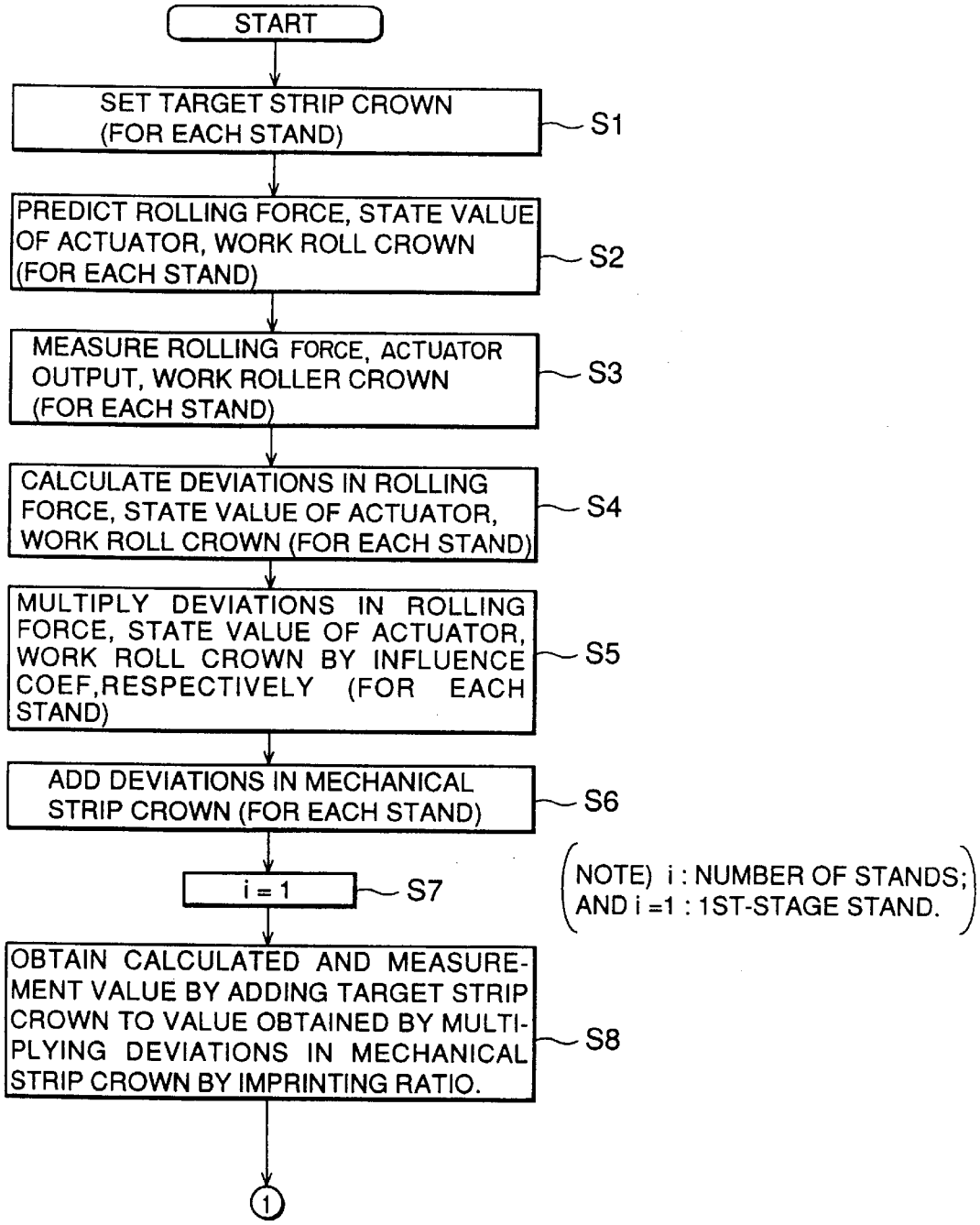
FIGS. 7A and 7B are flowcharts showing a first method of measuring strip crown of the continuous rolling mills according to the present invention.
Figure 7B:
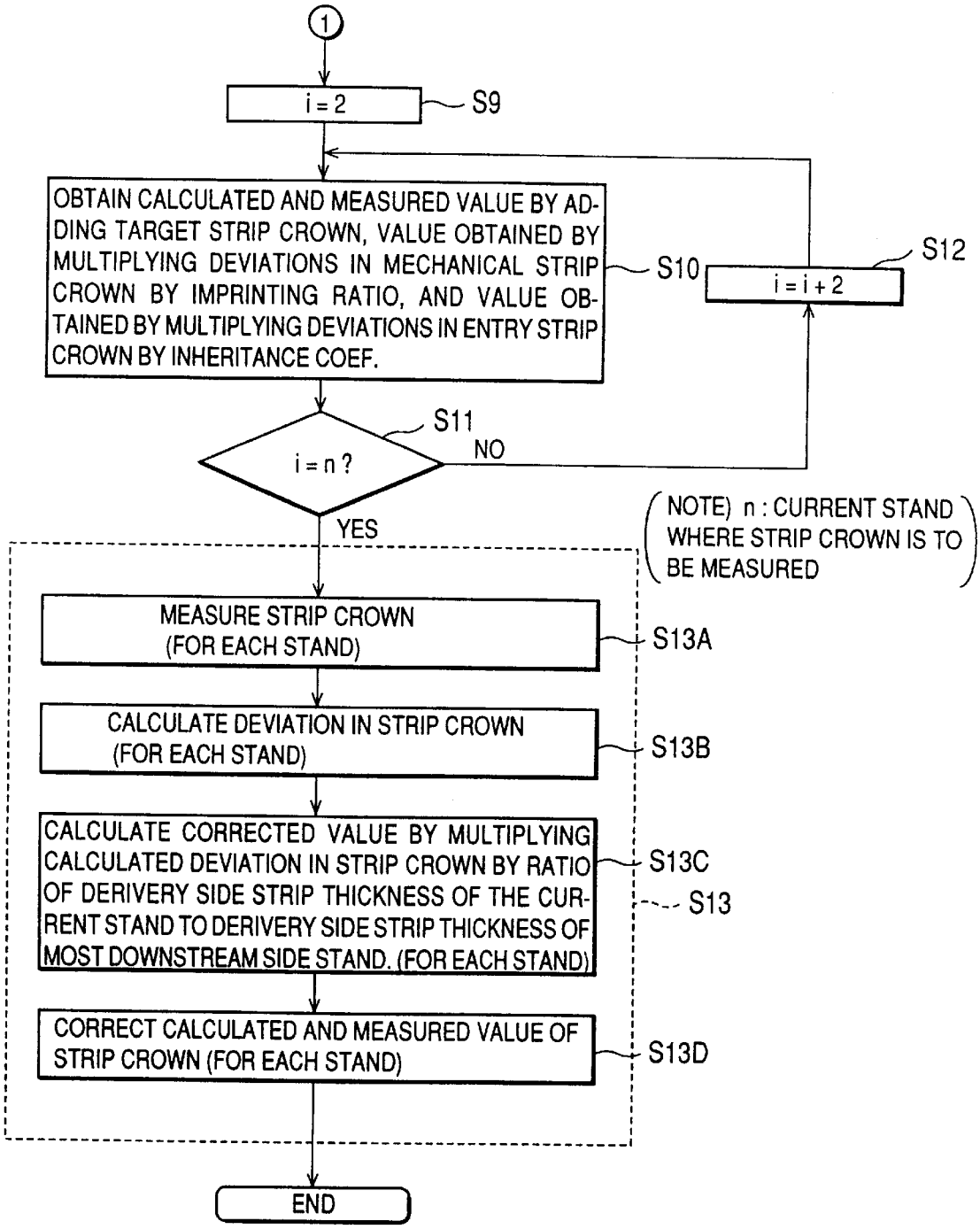

FIGS. 7A and 7B are flowcharts showing a first method of measuring the strip crown.

In step S1, controller calculates and sets a target strip crown of the rolling mill from a first stand, namely a first stage rolling mill to another rolling mill at which strip crown is to be measured, for each rolling mill.

In step S2, controller predicts a rolling force, an state value of the actuator, and a work roll crown, for each rolling mill.

In step S3, controller actually measures the rolling force, the state value of the actuator, and the work roll crown, for each rolling mill.

In step S4, controller calculates deviations in rolling force, state value of the actuator, and work roll crown between the predicted value and the actually measured value, for each rolling mill from the first stand to the rolling mill at which the strip crown is to be measured.

In step S5, controller multiplies each of the calculated deviations by an influence coefficient upon a mechanical strip crown, for each rolling mill.

In step S6, controller adds all the obtained multiplication results to obtain a total deviation in mechanical strip crown between the predicted value and the actually measured value, for each rolling mill.

In step S7, controller detects that the current rolling mill is the first rolling mill (i=1).

In step S8, target strip crown value controller adds the target strip crown value calculated by set up calculation function to a value obtained by multiplying the deviation in mechanical strip crown between the predicted value and the actually measured value by a imprinting ratio, to obtain a calculated measurement value of the strip crown.

In step S9, controller detects that the current rolling mill is the second rolling mill (i=2).

In step S10 adds the target strip crown calculated by set up calculation function, a value obtained by multiplying the deviation in mechanical strip crown between the predicted value and the actually measured value by a imprinting ratio, and a value obtained by multiplying the deviation in entry strip crown between the target value and the calculated measurement value by an inheritance coefficient, to obtain a calculated measurement value of the strip crown.

In step S11, controller checks whether the current rolling mill is the rolling mill at which the strip crown is measured by the profile gauge.

If not in step S11, in step S12 control proceeds to the succeeding rolling mill, returning to the step S10.

If yes in step S11, in step S13A controller measures the strip crown.

In step S13B, controller calculates the deviation in strip crown between the calculated measurement value and the actually measured value on an delivery side of the most downstream side of the rolling mill.

In step S13C, controller multiples the calculated deviation by a ratio of a strip thickness obtained on the delivery side of the rolling mill at which the strip crown is to be measured to a strip thickness obtained on the delivery side of the most downstream side rolling mill for each rolling mill, to correct the calculated measurement value of the strip crown of the rolling mill at which the strip crown is to be measured.

In step S13D, controller correct the calculated measurement value, for each rolling mill.

Therefore, in steps from S1 to S10, since the calculated measurement value of the strip crown of the first rolling mill is obtained by adding the target value to a value obtained by multiplying the deviation in strip crown between the predicted value and the measured value by a imprinting ratio, and further since the calculated measurement values of the strip crown of the second and after rolling mills are obtained by adding the target calculated strip crown value, a value obtained by multiplying the deviation in mechanical strip crown between the predicted value and the measured value by a imprinting ratio, and a value obtained by multiplying the deviation in entry strip crown between the target value and the calculated measurement value by an inheritance coefficient, it is possible to measure the strip crowns of the delivery side of the respective tandem-arranged rolling mills, irrespective of the presence or absence of the profile gauge.

Further, in steps from S13A to step S13D, since the profile gauge is equipped on the most downstream side rolling mill, when there exists a deviation in strip crown between the actually measured value and the calculated measurement value, since the calculated measurement value of the strip crown can be corrected on the basis of the deviation, it is possible to measure the strip crowns of the other rolling mills by use of only a single profile gauge.

(Second method)

Figure 8A:
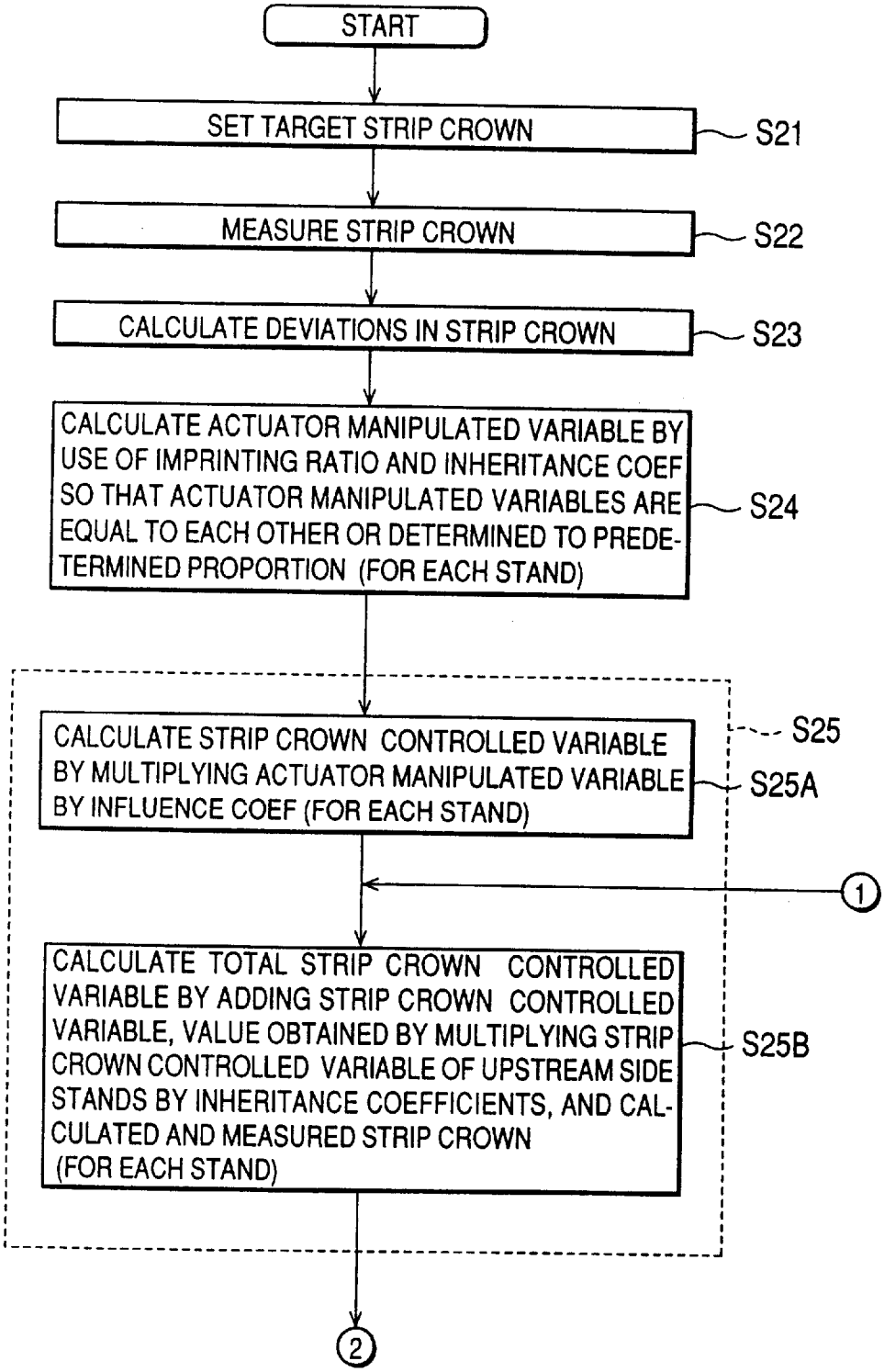
FIGS. 8A, 8B and 8C are flowcharts showing a second method of controlling strip crown of the continuous rolling mills according to the present invention.
Figure 8B:
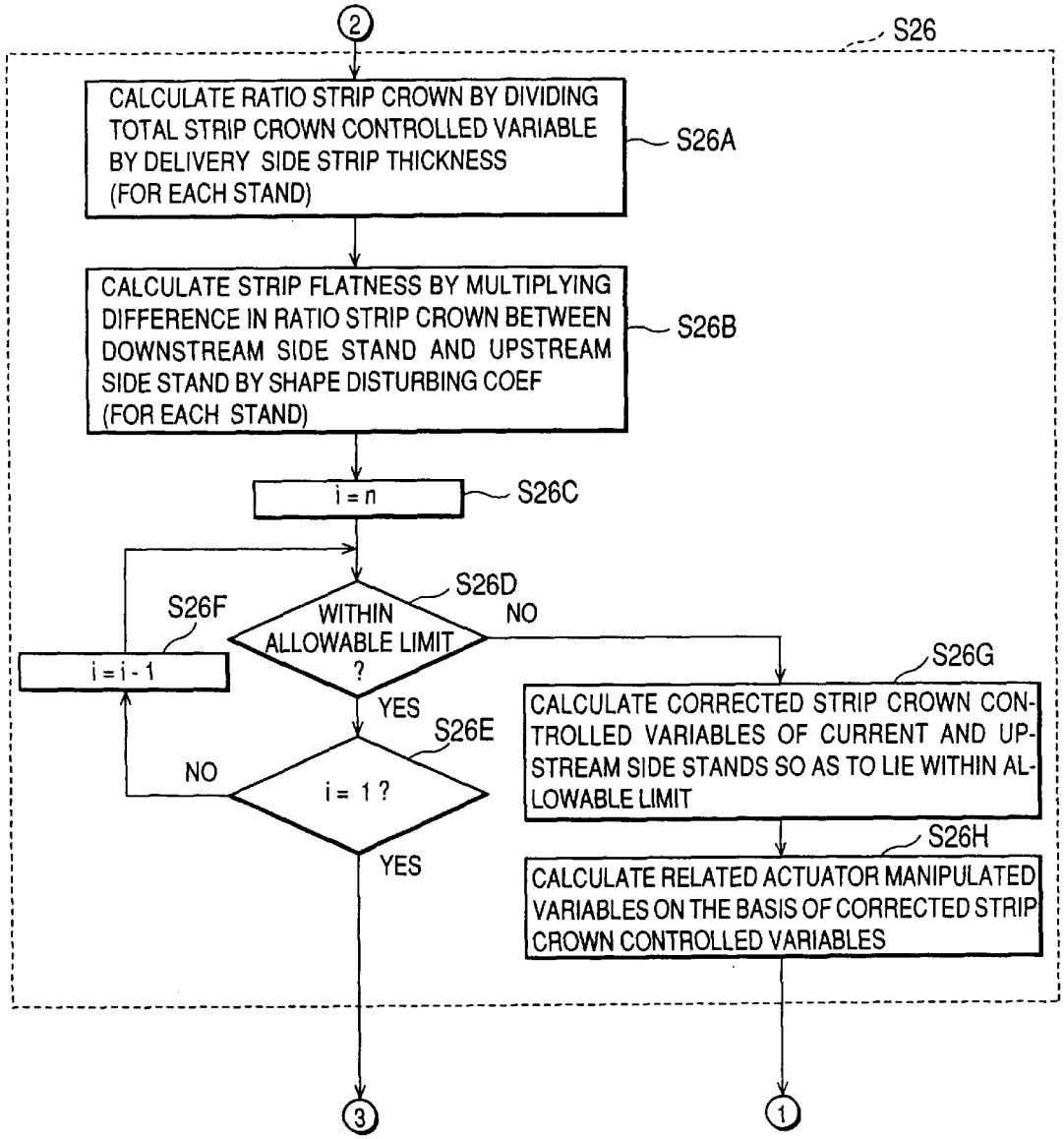
Figure 8C:
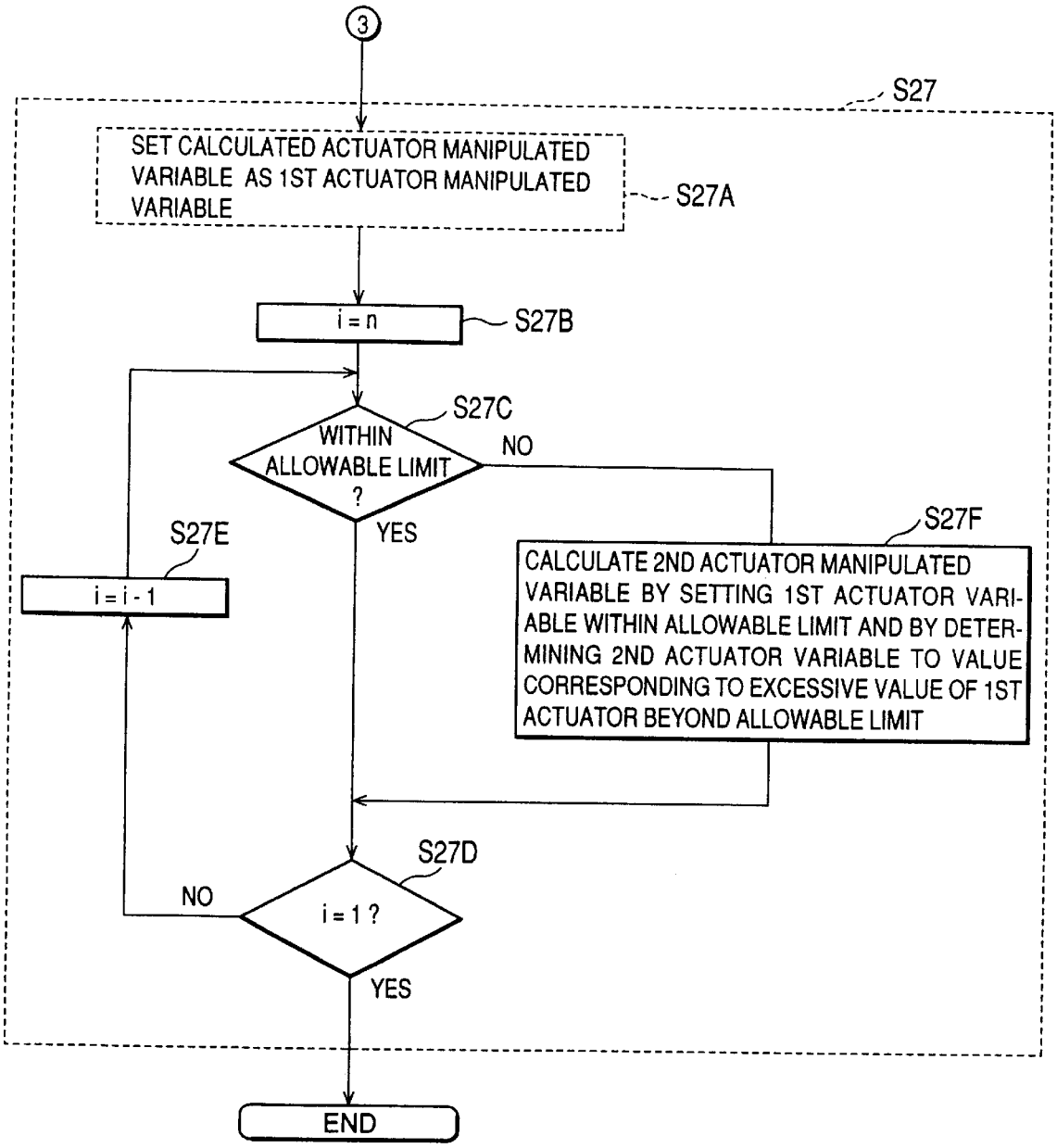

FIGS. 8A, 8B and 8C are flowcharts showing a second control method of controlling the strip crown.

In step S21, controller sets the target strip crown value.

In step S22, controller measures the strip crown.

In step S23, controller calculates a deviation in strip crown between the target value and the measured value.

In step S24, controller calculates an actuator manipulated variable by use of a imprinting ratio and an inheritance coefficient for each rolling mill, in such a way that the actuator manipulated variables of the rolling mills arranged on the upstream side of the rolling mill at which the profile gauge is equipped are equal to each other or determined to a predetermined proportion.

In step S25A, controller multiplies the manipulated variable of the actuator by a imprinting ratio and an influence coefficient upon the mechanical strip crown, to obtain the controlled variable of the delivery strip crown, for each rolling mill.

In step S25B, controller adds the controlled variable of the delivery strip crown, a value obtained by multiplying the controlled variable of the delivery strip crown of the adjacent upstream side rolling mill by the inheritance coefficient, and the previously calculated and measured strip crown value, to obtain the total controlled variable of the strip crown for each rolling mill.

In step S26A, controller divides the total controlled variable of the delivery strip crown by an delivery side strip thickness, to obtain a strip crown ratio for each rolling mill.

In step S26B, controller multiplies a difference in strip crown ratio between the adjacent downstream side rolling mill and the adjacent upstream side rolling mill by a shape disturbing-coefficient, to obtain a flatness for each rolling mill.

In step S26C, controller detects that the current rolling mill is the n-th rolling mill (i=n) at which the strip crown is measured.

In step S26D, controller checks whether the flatness lies with an allowable limit. If yes in step S26D, in step S26E controller checks whether the current rolling mill is the first rolling mill (i=1). If no in step S26E, in step S26F controller proceeds to the preceding rolling mill (i=i−1), to repeat the processing of step S26D again. If no in step S26D; that is, when the obtained flatness exceeds the allowable range, in step S26G controller calculates a modified control value of the delivery strip crown of the current and the upstream side rolling mills in sequence toward the upstream side, so that the obtained flatness lies within the allowable limit.

In step S26H, controller corrects the actuator manipulated variable on the basis of the modified control value of the delivery strip crown, for each related rolling mill.

In step S27A, controller sets the calculated actuator manipulated variable to the first actuator manipulated variable.

In step S27B, controller detects that the current rolling mill is the n-th rolling mill (i=n) at which the strip crown is measured.

In step S27C, controller checks whether the actuator manipulated variable lies within an allowable limit. If yes in step S27C, in step S27D controller checks whether the current rolling mill is the first rolling mill (i=1). If no in step S27D, in step S27E controller proceeds to the preceding rolling mill (i=i−1), to repeat the processing of step S27C again. If no in step S27C; that is, when the first actuator manipulated variable exceeds the allowable range, in step S27F controller calculates the first actuator manipulated variable within the allowable limit, and the second actuator manipulated variable which corresponds to an excessive value of the first actuator beyond the capability of the actuator.

Therefore, in steps from step S21 to S24, since the manipulated variables of the actuators of the rolling mills arranged on the upstream side from the profile gauge are calculated so as to be equal to each other or in a predetermined proportion by use of the imprinting ratio and the inheritance coefficient in correspondence to the deviation in strip crown between the actually measured value by the profile gauge and the previously calculated measurement value, it is possible to uniformalize the load of the actuator on the basis of the manipulated variable thereof.

Further, in steps from S25A to S25B, since the controlled variable on the delivery side is obtained for each rolling mill to obtain the total controlled variable and since the manipulated variable of the actuator is corrected on the basis of the total control variable,it is possible to increase the control precision of the strip crown.

Further, in steps from S26A to S26H, since the flatness is obtained on the basis of the total controlled variable of the strip crown and since the manipulated variable of the actuator is corrected within the capability of the actuator, it is possible to control the strip crown under consideration of the flatness, without disposing any flatness sensor.

Further, in steps from S27A to S27D, when the manipulated variable of the first actuator exceeds the capability of the actuator, since the second actuator is controlled on the basis of the controlled variable corresponding to the excessive value of the first actuator beyond the capability of the actuator, it is possible to control the strip crown securely and safely, even if the controlled variable of the strip crown is large.

(Third method)

Figure 9A:
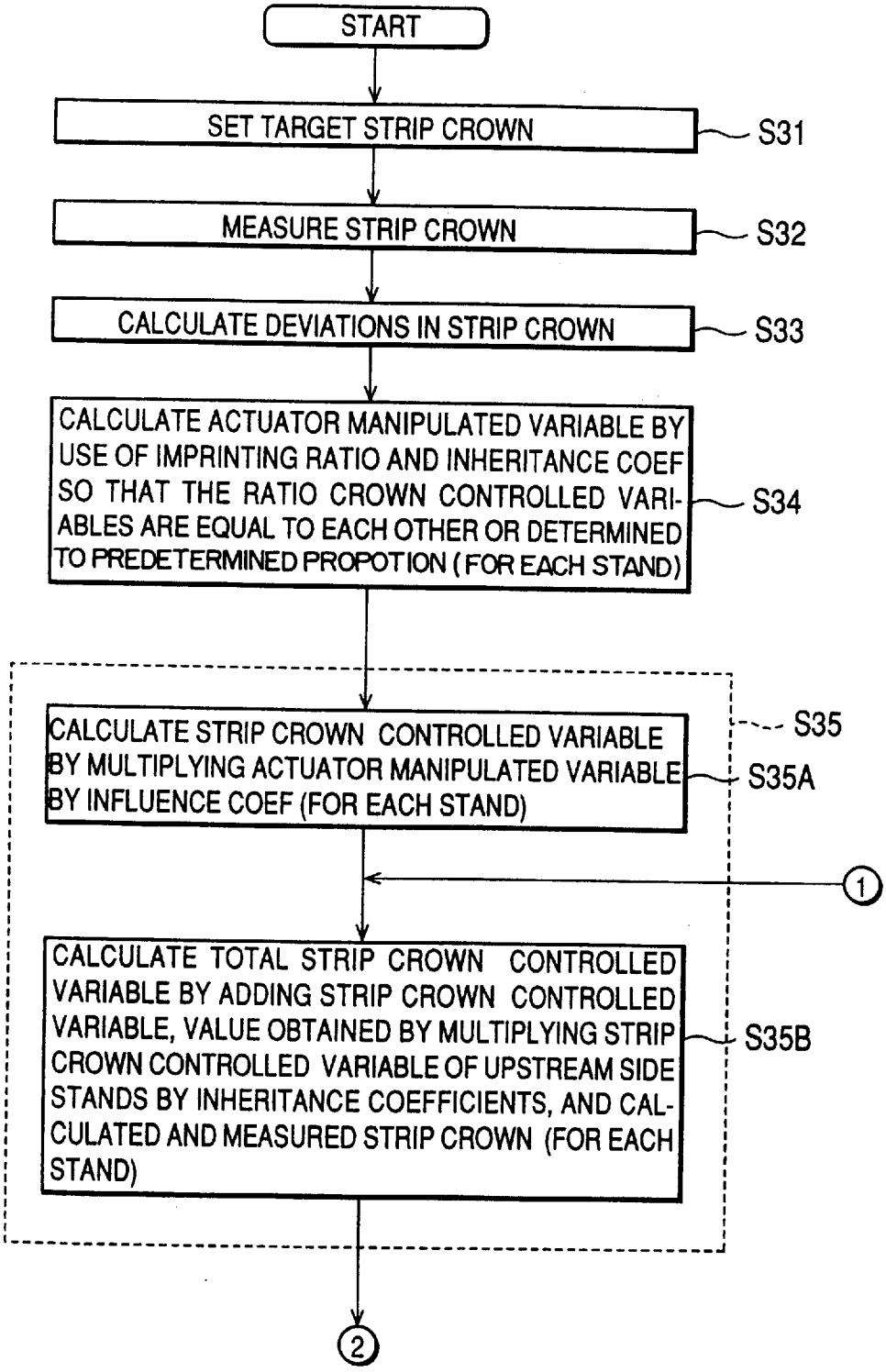
FIGS. 9A, 9B and 9C are flowcharts showing a third control method of controlling strip crown of the continuous rolling mills according to the present invention.
Figure 9B:
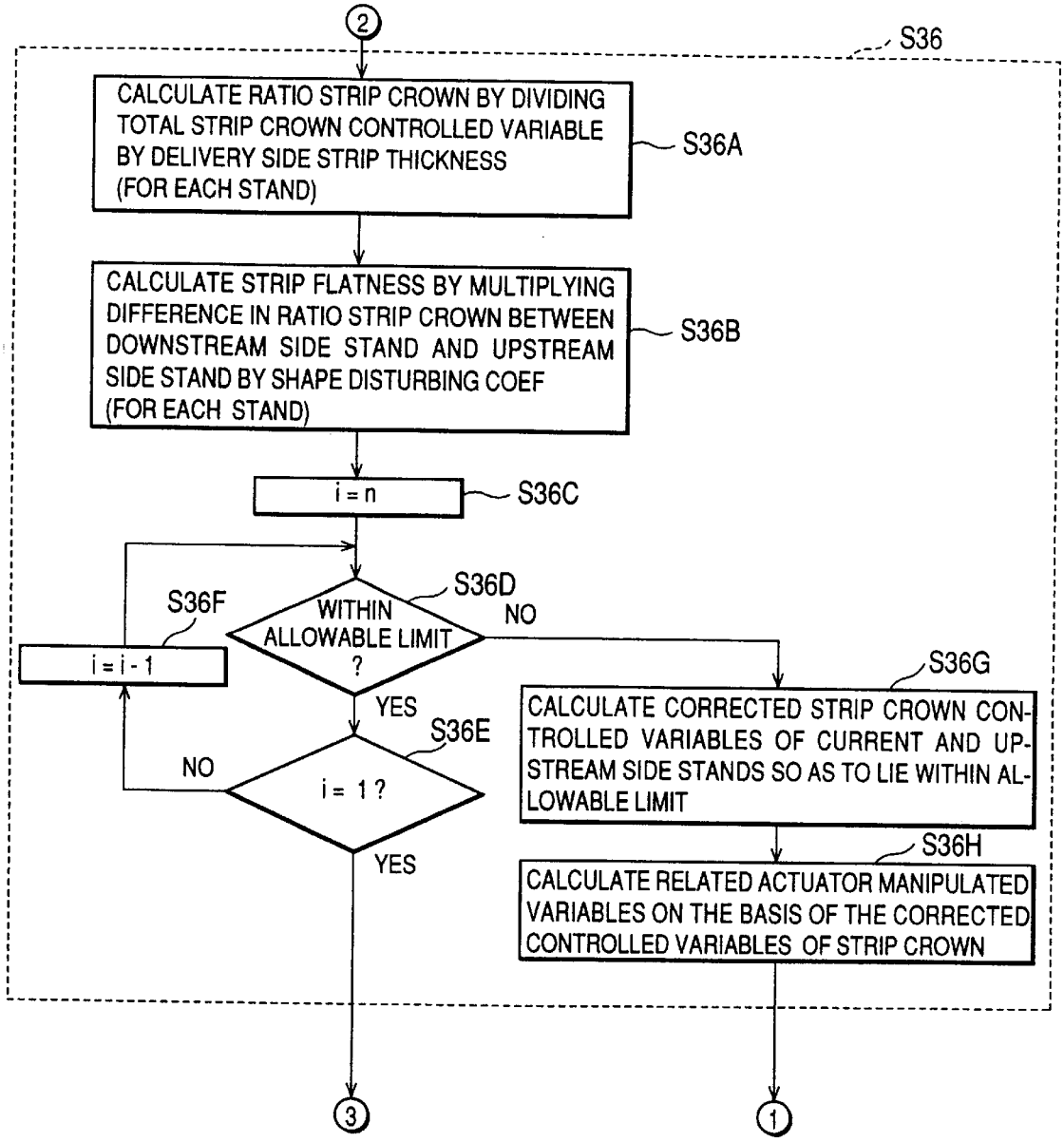
Figure 9C:
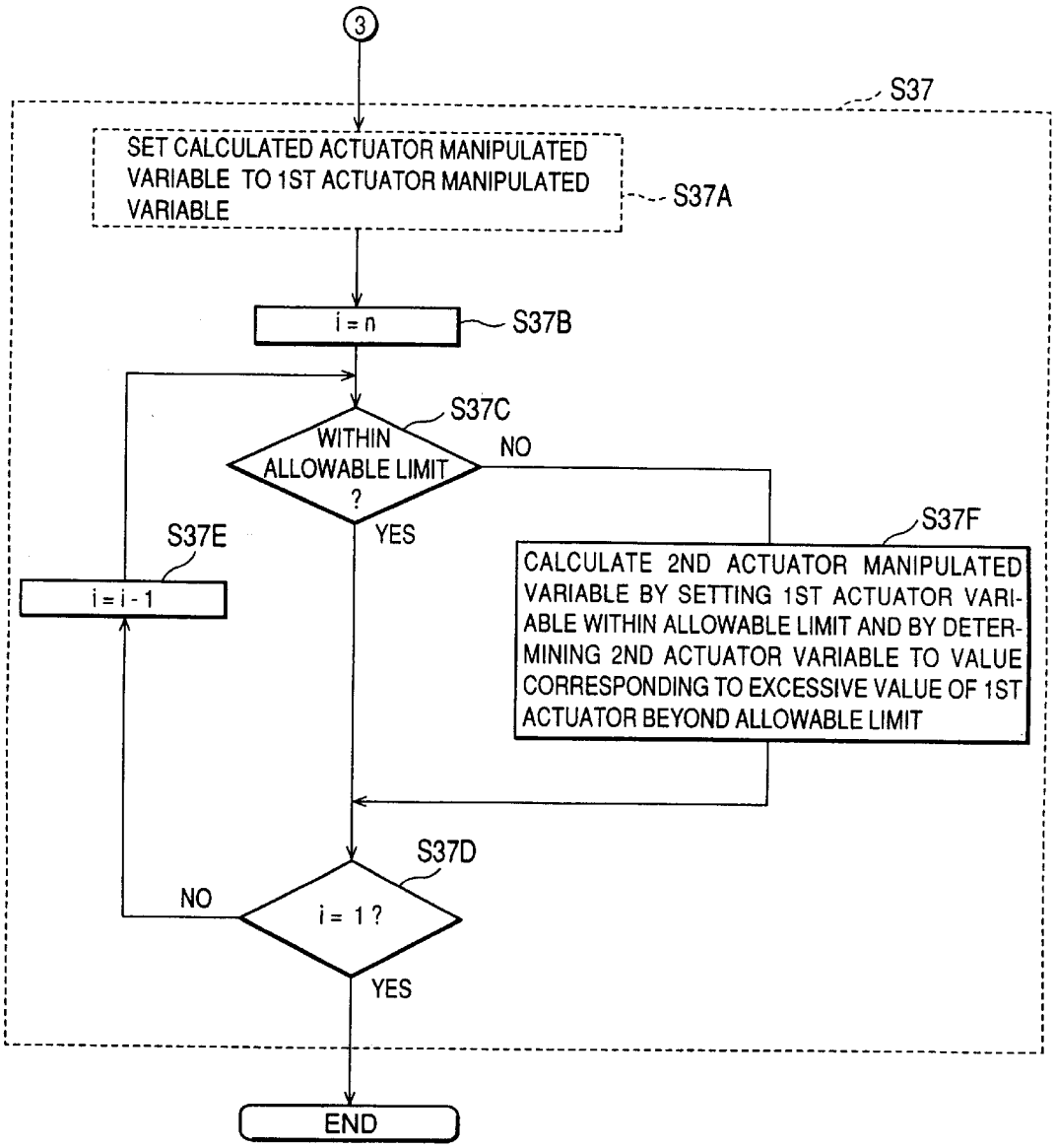

FIGS. 9A, 9B and 9C are flowcharts showing a third method of controlling the strip crown.

In step S31, controller sets the target strip crown value.

In step S32, controller measures the strip crown.

In step S33, controller calculates a deviation in strip crown between the target value and the measured value.

In step S34, controller calculates an actuator manipulated variable by use of a imprinting ratio and an inheritance coefficient for each rolling mill, in such a way that the strip crown ratio controlled variables of the rolling mills arranged on the upstream side of the rolling mill at which the profile gauge is equipped are equal to each other or determined to a predetermined proportion.

In step S35A, controller multiplies the manipulated variable of the actuator by a imprinting ratio and an influence coefficient upon the mechanical strip crown, to obtain the controlled variable of the delivery strip crown, for each rolling mill.

In step S35B, controller adds the controlled variable of the delivery strip crown, a value obtained by multiplying the controlled variable of the delivery strip crown of the adjacent upstream side rolling mill by the inheritance coefficient, and the previously calculated and measured strip crown value, to obtain the total controlled variable of the strip crown for each rolling mill.

In step S36A, controller divides the total controlled variable of the delivery strip crown by an delivery side strip thickness, to obtain a strip crown ratio for each rolling mill.

In step S36B, controller multiplies a difference in strip crown ratio between the adjacent downstream side rolling mill and the adjacent upstream side rolling mill by a shape disturbing-coefficient, to obtain a flatness for each rolling mill.

In step S36C, controller detects that the current rolling mill is the n-th rolling mill (i=n) at which the strip crown is measured.

In step S36D, controller checks whether the flatness lies within an allowable limit. If yes in step S36D, in step S36E controller checks whether the current rolling mill is the first rolling mill (i=1). If no in step S36E, in step S36F controller proceeds to the preceding rolling mill (i=i−1) to repeat the processing of step S36D again. If no in step S36D; that is, when the obtained flatness exceeds the allowable range, in step S36G, controller calculates a modified control value of the delivery strip crown of the current and the upstream side rolling mills in sequence toward the upstream side, so that the obtained flatness lies within the allowable limit.

In step S36H, controller corrects the actuator manipulated variable on the basis of the modified control value of the delivery strip crown, for each related rolling mill.

In step S37A, controller sets the calculated actuator manipulated variable to the first actuator manipulated variable.

In step S37B, controller detects that the current rolling mill is the n-th rolling mill (i=n) at which the strip crown is measured.

In step S37C, controller checks whether the actuator manipulated variable lies within an allowable limit. If yes in step S37C, in step S37D controller checks whether the current rolling mill is the first rolling mill (i=1). If no in step S37D, in step S37E controller proceeds to the preceding rolling mill (i=i−1) to repeat the processing of step S37C again. If no in step S37C; that is, when the first actuator manipulated variable exceeds the allowable range, in step S37F controller calculates the first actuator manipulated variable within the allowable limit, and the second actuator manipulated variable which corresponds to an excessive value of the first actuator beyond the capability of the actuator.

Therefore, in steps from step S31 to S34, since the controlled variables of the strip crown ratio of the rolling mills arranged on the upstream side from the profile gauge are calculated so as to be equal to each other or in a predetermined proportion by use of the imprinting ratio and the inheritance coefficient in correspondence to the deviation in strip crown between the actually measured value by the profile gauge and the previously calculated measurement value, it is possible to uniformalize the load of the actuator on the basis of the strip crown ratio thereof. Further, it is possible to control the strip crown, without disturbing the strip shape by the rolling mills arranged on the upstream side from the profile gauge.

Further, in steps from S35A to S35B, since the controlled variable on the delivery side is obtained for each rolling mill to obtain the total controlled variable and since the manipulated variable of the actuator is corrected on the basis of the total control variable, it is possible to increase the control precision of the strip crown.

Further, in steps from S36A to S36H, since the flatness is obtained on the basis of the total controlled variable of the strip crown and since the manipulated variable of the actuator is corrected within the capability of the actuator, it is possible to control the strip crown under consideration of the flatness, without disposing any flatness sensor.

Further, in steps from S37A to S37D, when the manipulated variable of the first actuator exceeds the capability of the actuator, since the second actuator is controlled on the basis of the controlled variable corresponding to the excessive value of the first actuator beyond the capability of the actuator, it is possible to control the strip crown securely and safely, even if the controlled variable of the strip crown is large.

(Fourth method)

Figure 10A:
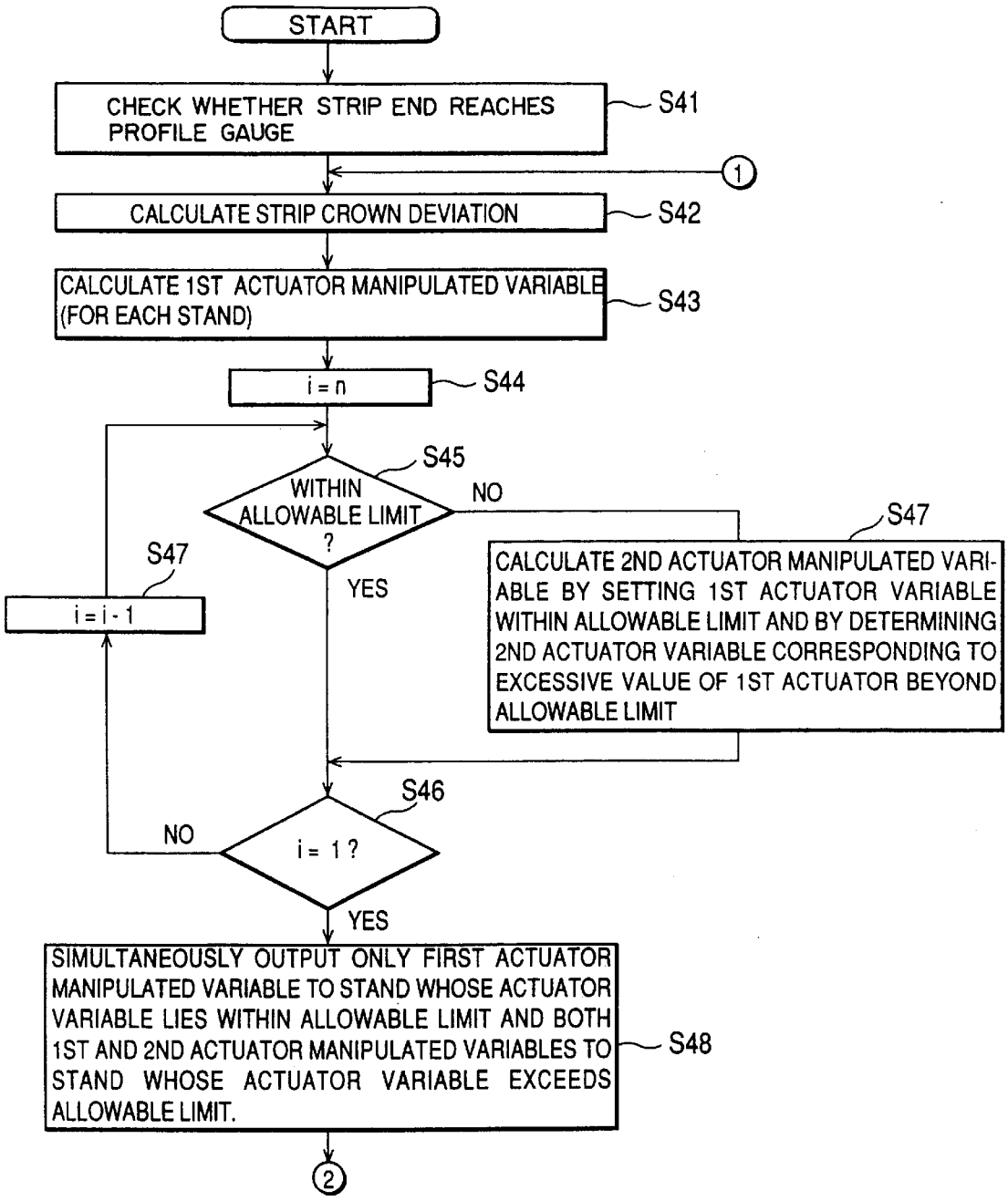
FIGS. 10A and 10B are flowcharts showing a fourth method of controlling strip crown of the continuous rolling mills according to the present invention.
Figure 10B:
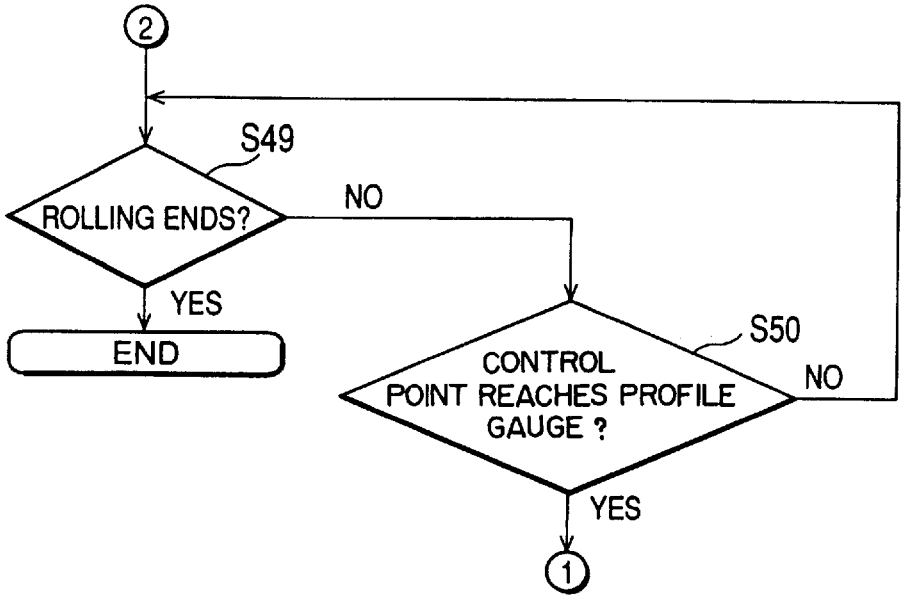

FIGS. 10A and 10B are flowcharts showing a fourth method of controlling the strip crown.

In step S41, controller detects that the strip end reaches the profile gauge.

In step S42, controller calculates a deviation in strip crown between the target value and the measured value.

In step S43, controller calculates manipulated variables of the first actuator of the rolling mill arranged on an upstream side from a position at which the profile gauge is equipped, on the basis of the deviation in strip crown, for each rolling mill.

In step S44, controller detects that the current rolling mill to the n-th rolling mill (i=n) at which the strip crown is measured.

In step S45, controller checks whether the actuator manipulated variable lies within an allowable limit. If yes in step S45, in step S46 controller checks whether the current rolling mill is the first rolling mill (i=1). If no in step S46, in step S47 controller proceeds to the preceding rolling mill (i=i−1), to repeat the processing of step S26D again. If no in step S45; that is, when the obtained actuator manipulated variable exceeds the allowable limit, in step S47 controller calculates the first actuator manipulated variable within the allowable limit, and the second actuator manipulated variable which corresponds to an excessive value of the first actuator beyond the capability of the actuator.

If yes in step S46, in step S48 controller controls only the first actuator of the rolling mills arranged on the upstream side of a position at which the profile gauge is equipped on the basis of the corresponding controlled variable, when the manipulated variable of the first actuator lies within the allowable limit; and simultaneously controls both the first and second actuators of the rolling mill arranged on the upstream side of the position at which the profile gauge is arranged on the basis of the corresponding controlled variables, respectively, when the manipulated variables of the first actuators exceeds the allowable limit.

In step S49, controller checks whether rolling ends. If no in step S49, in step S50 controller checks whether the control position of the strip reaches the profile gauge.

Therefore, when there exists a deviation in strip crown between the actually measured value and the previously calculated value, since the actuators of the upstream side rolling mills are simultaneously controlled on the basis of the corresponding controlled variable, respectively in such a way as to be repeated whenever the control point of the strip by the most upstream side rolling mill reaches the profile gauge, it is possible to control the strip crown of the strip by all the rolling mills arranged on the upstream side of the profile gauge at high response speed.

Further, FIG. 21 is a timing chart of the simultaneous output control executed by the respective rolling mills, in which the number of rolling mills is four and the profile gauge is equipped on the delivery side of the fourth rolling mill.

(Fifth method)

Figure 11A:
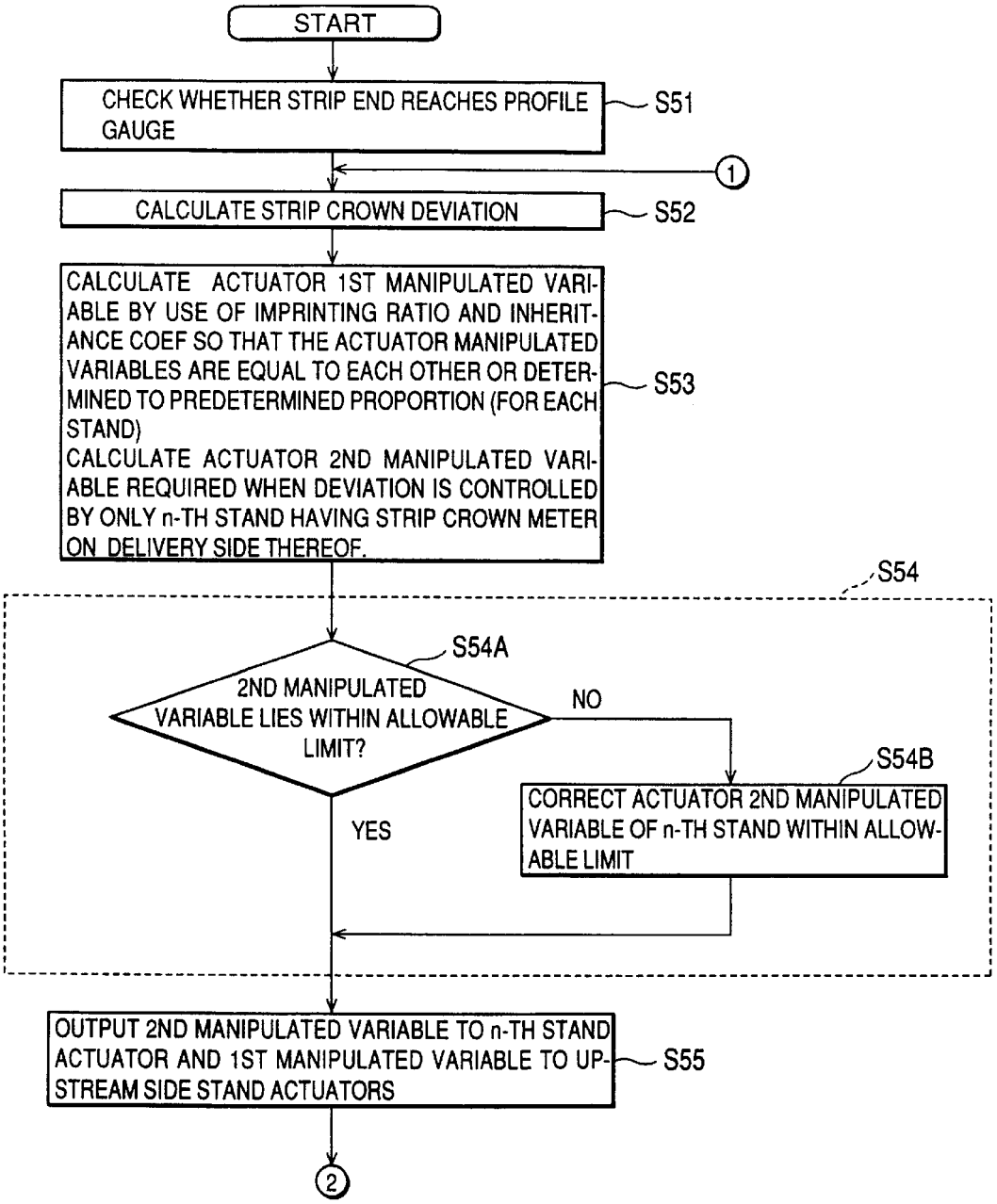
FIGS. 11A and 11B are flowcharts showing a fifth method of controlling strip crown of the continuous rolling mills according to the present invention.
Figure 11B:
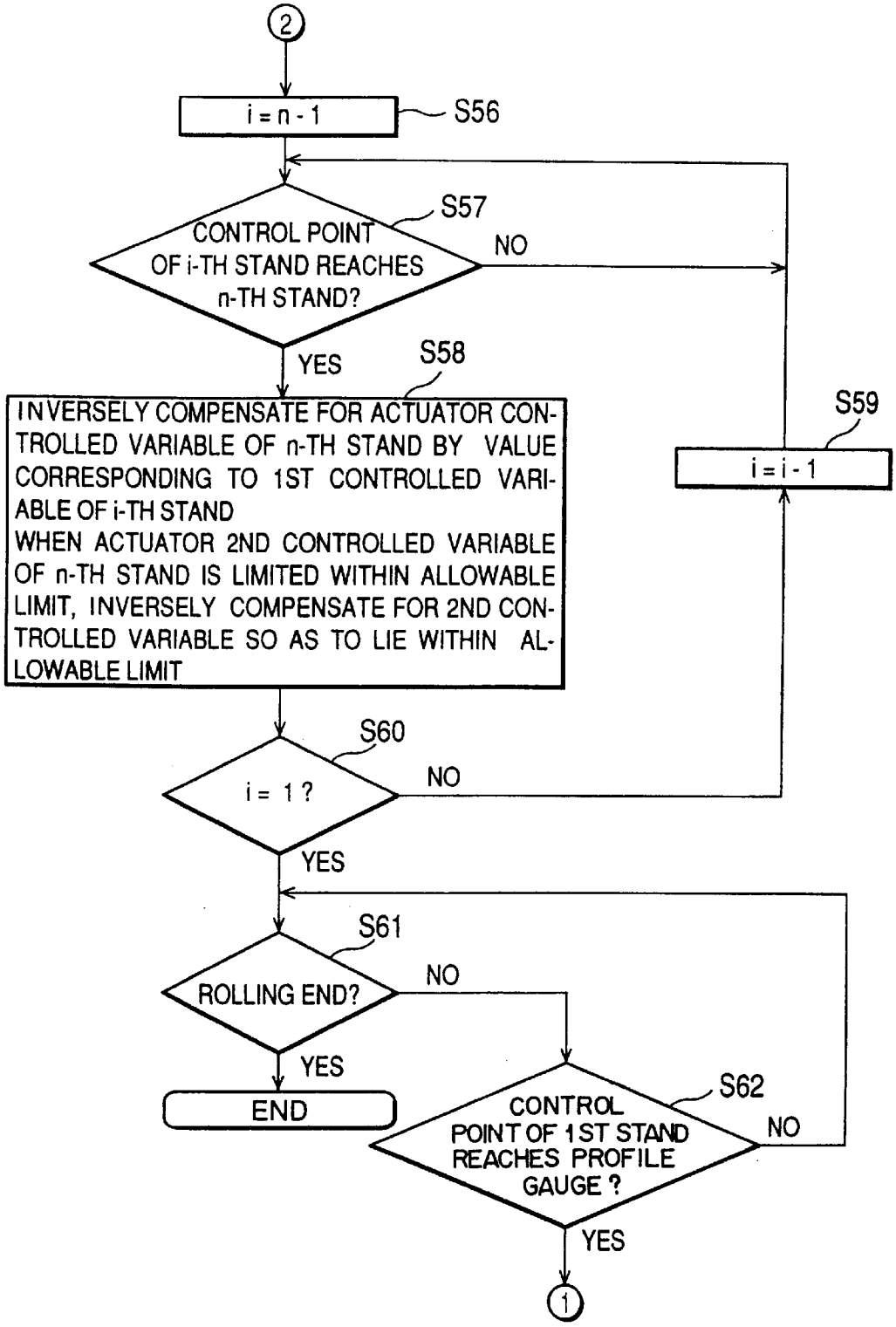

FIGS. 11A and 11B are flowcharts showing a fifth method of controlling the strip crown.

In step S51, controller detects that the strip end reaches the profile gauge.

In step S52, controller calculates a deviation in strip crown between the target value and the measured value.

In step S53, controller calculates the first manipulated variable of the actuator of the rolling mill on the basis of a imprinting ratio or an inheritance coefficient for each rolling mill, in such a way that the calculated manipulated variables of the actuators of the rolling mills arranged at and on an upstream side from the rolling mill on the delivery side of which the profile gauge is equipped are equal to each other or determined to a predetermined proportion.

Further, controller calculates the second manipulated variable of the actuator required when the deviation in the strip crown is controlled by only the rolling mill (n-th) on the delivery side of which the profile gauge is equipped.

In step S54A, controller checks whether the second manipulated variable lies within the capability of the actuator.

If no in step S54A; that is, when the manipulated variable of the actuator exceeds the allowable limit, in step S54B controller corrects the second manipulated variable of the actuator of the n-th rolling mill on the delivery side of which the profile gauge is equipped, within the capability of the actuator.

In step S55, controller outputs the second controlled variable to the rolling mill (n-th) on the delivery side of which the profile gauge is equipped, and first controlled variable to the rolling mills arranged on the upstream side of the n-th rolling mill.

In step S56, controller proceeds to the preceding rolling mill (i=n−1).

In step S57, controller checks whether the control point of the i-th rolling mill reaches the n-th rolling mill.

If yes in step S57, in step S58 controller inversely compensates for the manipulated variable of the actuator of the n-th rolling mill on the delivery side of which the profile gauge is equipped, by a value corresponding to the first controlled variables of the upstream side rolling mills (i-th).

Further, when the second manipulated variable of the actuator of the n-th rolling mill is limited within the capability of the actuator, inversely compensate for the controlled variable to limit it within the capability of the actuator.

In step S60, controller checks whether the rolling mill is the first rolling mill (i=1).

If no in step S60, controller proceeds to the preceding rolling mill (i=i−1). Further, if yes in step S60, controller checks whether rolling ends. Further, if no in step S61, in step S62 controller checks whether the control point of the first rolling mill reaches the profile gauge.

Therefore, in the control method, when there exists a deviation in strip crown between the actually measured value of the profile gauge and the previously calculated target value, the actuator is controlled so as to remove the deviation by the rolling mill on the delivery side of which the profile gauge is equipped. In this case, since the strip crown is controlled by the upstream side rolling machines, the manipulated variable of the actuator of the rolling mill having the profile gauge is inversely compensated for by a value corresponding to the manipulated variable of the actuators of the upstream side rolling mill so as that the control is not overlapped. Further, the actuator manipulated variables, the control and the inverse compensation are repeatedly executed whenever the control point of the most upstream side rolling mill reaches the rolling mill having the profile gauge. Therefore, it is possible to control the strip crown extending roughly all over the strip.

Therefore, in steps S54A and S54B, it is possible to suppress the manipulated variable of the actuator of the rolling mill on the delivery side of which the profile gauge is equipped, within the capability of the actuator.

Further, FIG. 22 is a timing chart of this first delay control executed by the respective rolling mills.

(Modification of Fifth method)

Figure 12A:
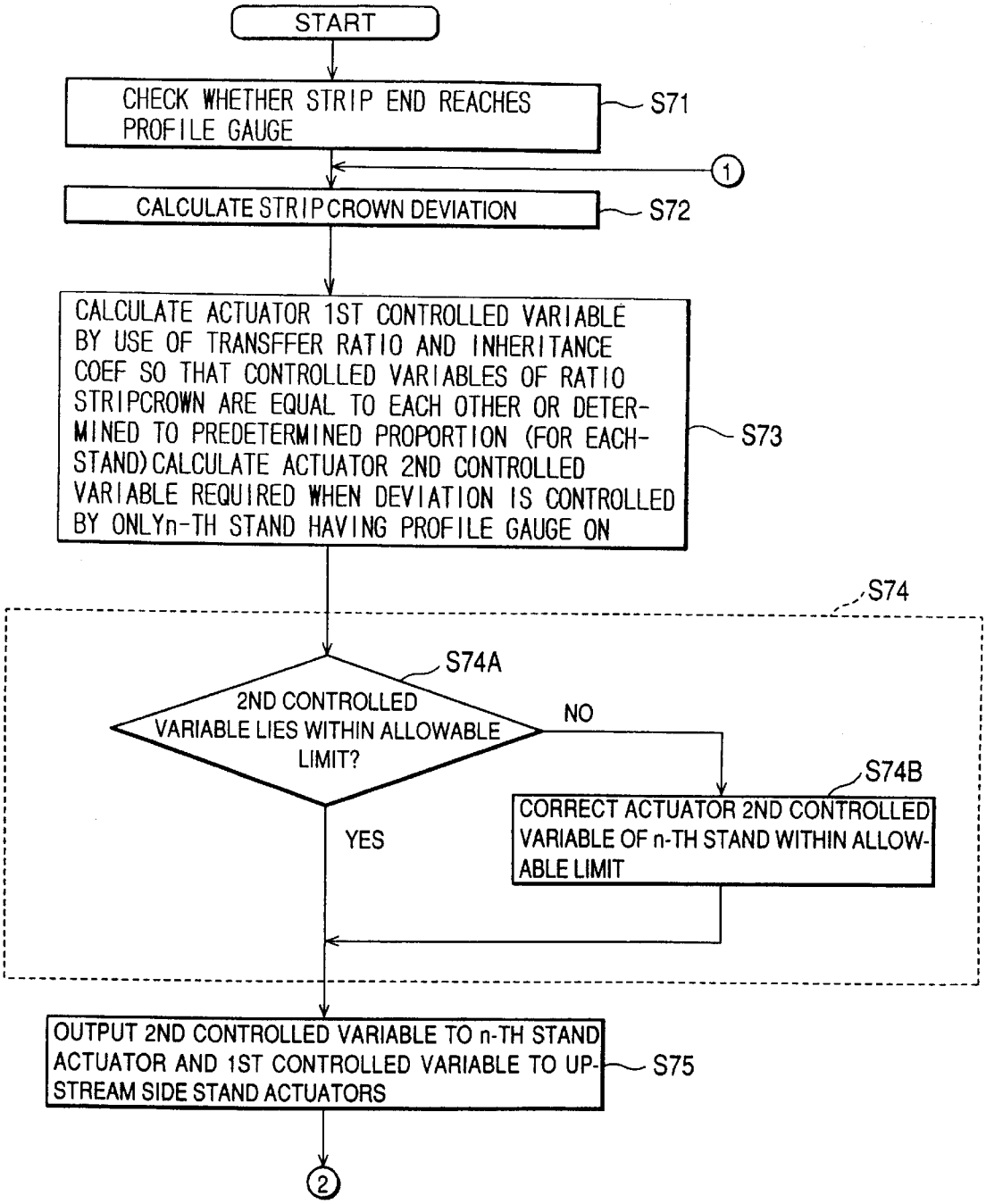
FIGS. 12A and 12B are flowcharts showing a modification of the fifth method of controlling strip crown of the continuous rolling mills according to the present invention.
Figure 12B:
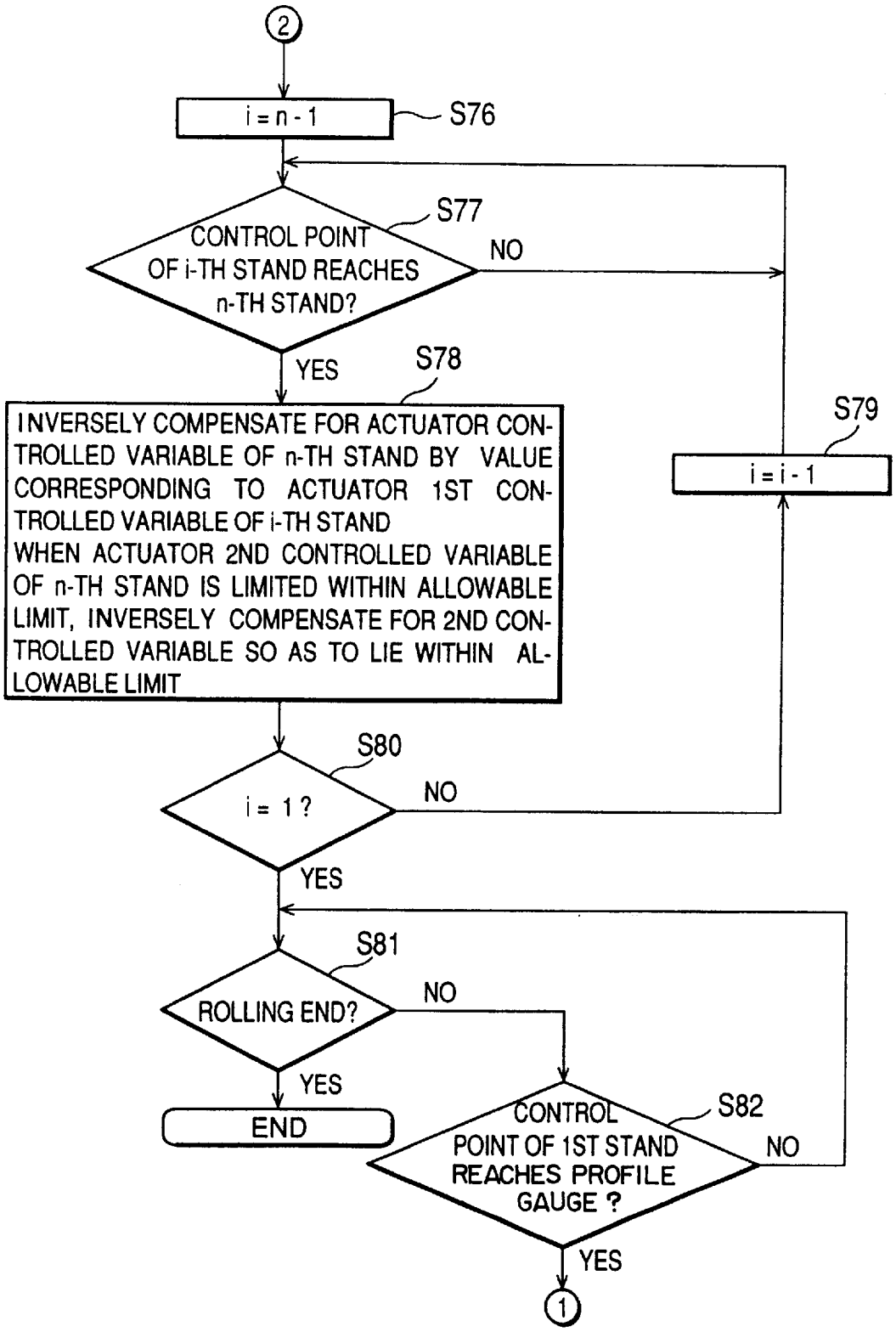

FIGS. 12A and 12B are flowcharts showing a modification of the fifth method of controlling the strip crown.

In step S71, controller detects that the strip end reaches the profile gauge.

In step S72, controller calculates a deviation in strip crown between the target value and the measured value.

In step S73, controller calculates the first manipulated variable of the actuator of the rolling mill on the basis of a imprinting ratio and an inheritance coefficient for each rolling mill, in such a way that the calculated controlled variables of the strip crown ratios of the rolling mills arranged at and on an upstream side from the rolling mill on the delivery side of which the profile gauge is equipped are equal to each other or determined to a predetermined proportion.

Further, controller calculates the second manipulated variable of the actuator required when the deviation in the strip crown is controlled by only the rolling mill (n-th) on the delivery side of which the profile gauge is equipped.

In step S74A, controller checks whether the second manipulated variable lies within the capability of the actuator.

If no in step S74A; that is, when the manipulated variable of the actuator exceeds the allowable limit, in step S74B controller corrects the second manipulated variable of the actuator of the n-th rolling mill on the delivery side of which the profile gauge is equipped, within the capability of the actuator.

In step S75, controller outputs the second manipulated variable to the actuator of the rolling mill (n-th) on the delivery side of which the profile gauge is equipped, and first manipulated variable to the actuator of the rolling mills arranged on the upstream side from the n-th rolling mill.

In step S76, controller proceeds to the preceding rolling mill (i=n−1).

In step S77, controller checks whether the control point of the i-th rolling mill reaches the n-th rolling mill.

If yes in step S77, in step S78 controller inversely compensates for the manipulated variable of the actuator of the n-th rolling mill on the delivery side of which the profile gauge is equipped, by a value corresponding to the first controlled variables of the upstream side rolling mills (i-th).

Further, when the second manipulated variable of the actuator of the n-th rolling mill is limited within the capability of the actuator, inversely compensate for the manipulated variable to limit it within the capability of the actuator.

In step S80, controller checks whether the rolling mill is the first rolling mill (i=1).

If no in step S80, in step S79 controller proceeds to the preceding rolling mill (i=i−1). Further, if yes in step S80, controller checks whether rolling ends. Further, if no in step S81, in step S82 controller checks whether the control point of the first rolling mill reaches the profile gauge.

Therefore, in the modification, since the manipulated variables of the actuators of the rolling mills arranged on the upstream side of the rolling mill on the delivery side of which the profile gauge is equipped are controlled in such a way that the strip crown ratio controlled variables are equal to each other or determined in a predetermined proportion, it is possible to control the strip crown in the consideration of the crown.

Further, in steps S74A and S74B, it is possible to suppress the manipulated variable of the actuator of the rolling mill on the delivery side of which the profile gauge is equipped, within the capability of the actuator.

Further, FIG. 22 is a timing chart of this first delay control executed by the respective rolling mills, in which the strip crown ratio is kept constant.

(Sixth method)

Figure 13A:
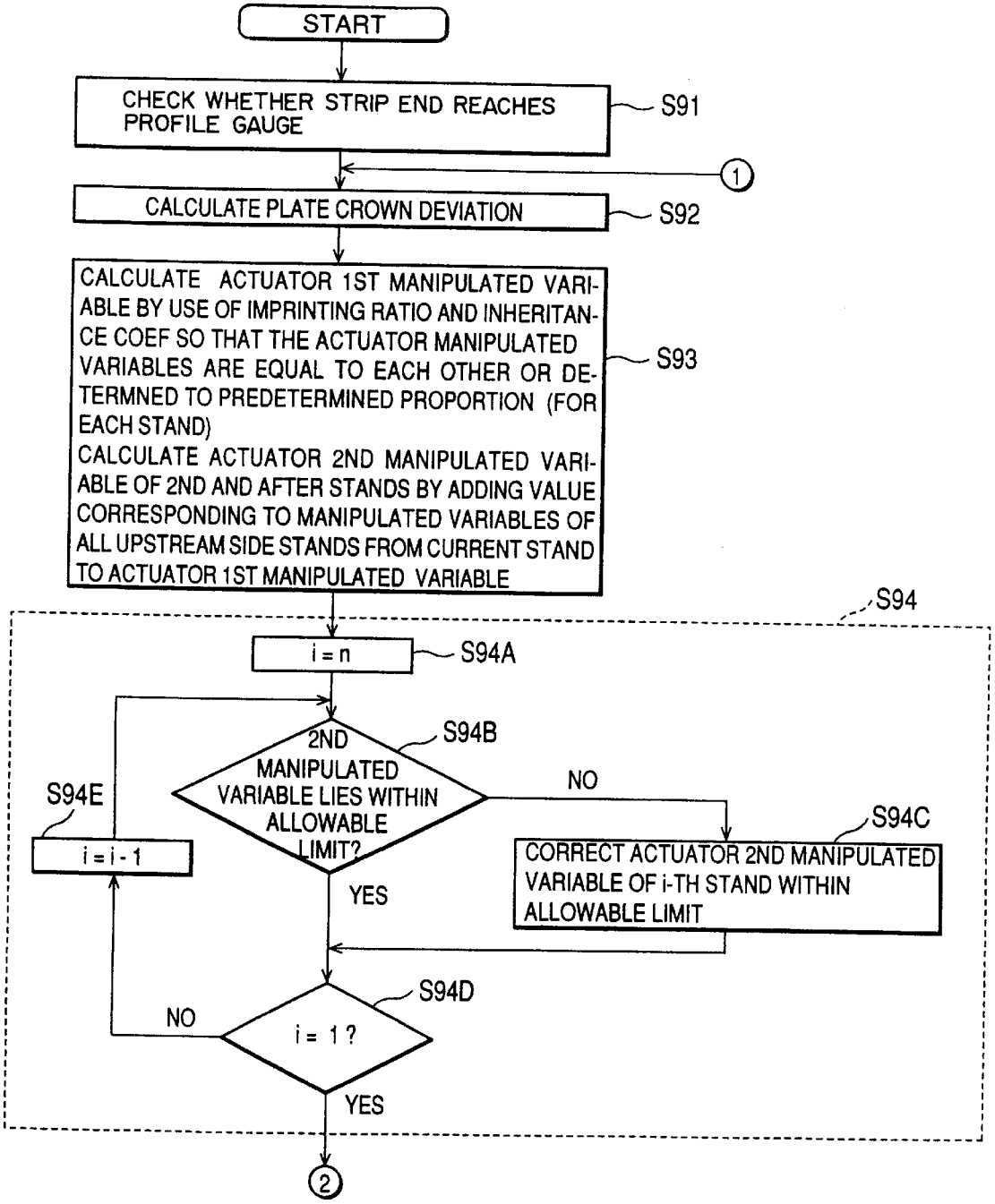
FIGS. 13A and 13B are flowcharts showing a sixth method of controlling strip crown of the continuous rolling mills according to the present invention.
Figure 13B:
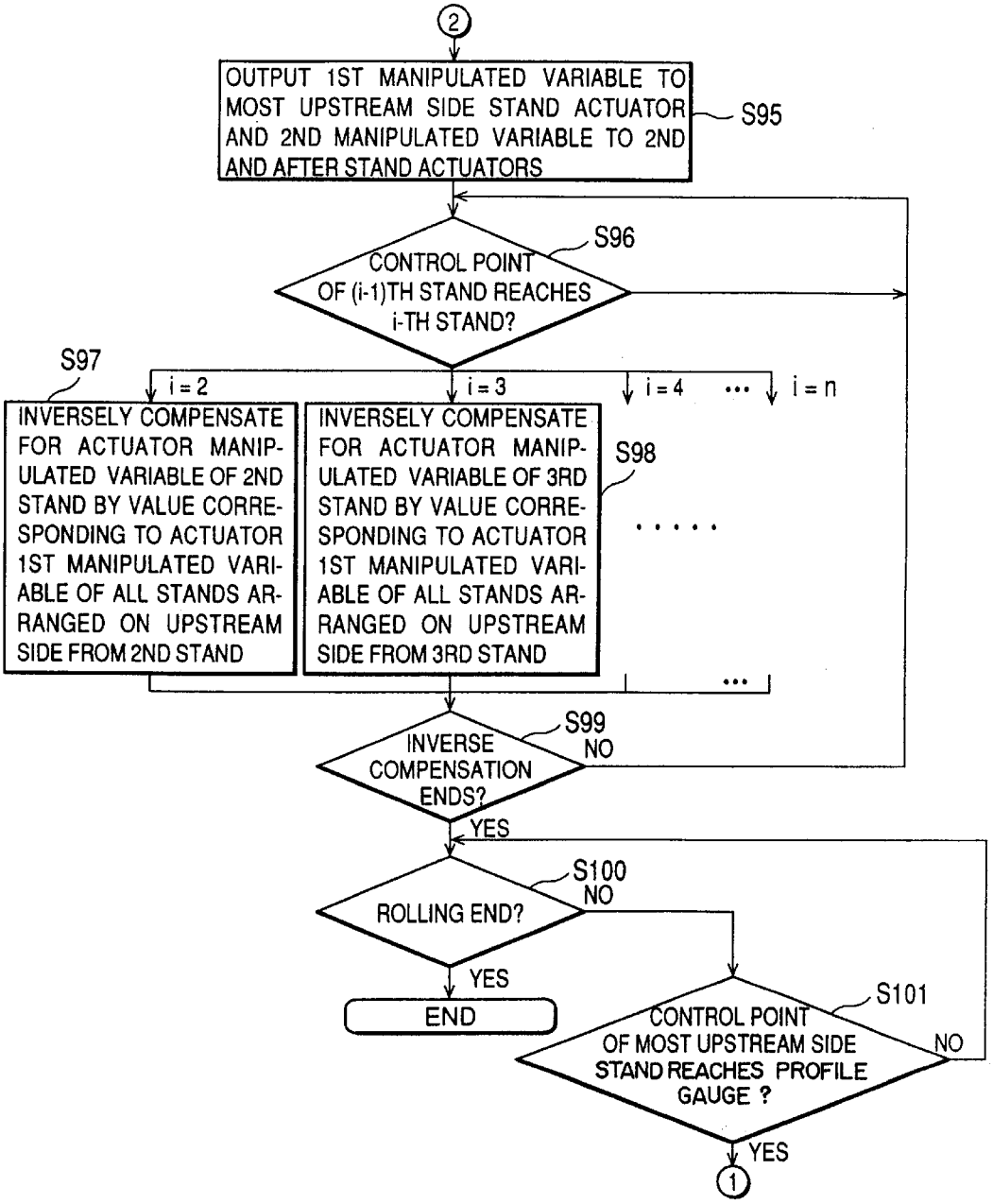

FIGS. 13A and 13B are flowcharts showing a sixth method of controlling the strip crown.

In step S91, controller detects that the strip end reaches the profile gauge.

In step S92, controller calculates a deviation in strip crown between the target value and the measured value, for each rolling mill.

In step S93, controller calculates the first manipulated variable of the actuator of the rolling mill on the basis of a imprinting ratio and an inheritance coefficient for each rolling mill, in such a way that the calculated manipulated variables of the actuators of the rolling mills arranged at and on an upstream side from the rolling mill on the delivery side of which the profile gauge is equipped are equal to each other or determined to a predetermined proportion.

Further, controller calculates the second controlled variables of the second and after rolling mills by adding a value corresponding to the controlled variables of all the upstream side rolling mills to the first controlled variable of the actuator of the current rolling mill.

In step S94A, controller detects that the current rolling mill is the n-th rolling mill (i=n) at which the strip crown is measured.

In step S94B, controller checks whether the second controlled variable lies within an allowable limit.

If yes in step S94B, in step S94D controller checks whether the current rolling mill is the first rolling mill (i=1). If no in step S94D, in step S94E controller proceeds to the preceding the rolling mill (i=i−1) to repeat the processing of step S94B again. If no in step S94B; that is, when the first actuator manipulated variable exceeds the allowable range, in step S94C controller corrects the second manipulated variable of the actuator of the i-th rolling mill, within the capability of the actuator.

In step S95, controller outputs the first controlled variable to the actuator of the most upstream side rolling mill, and second controlled variable to the actuators of the second and after rolling mills.

In step S96, controller checks whether the control point of the i-th rolling mill reaches the n-th rolling mill.

If yes in step S96, in step S97 controller inversely compensates for the manipulated variable of the actuator of the second rolling mill, by a value corresponding to the first manipulated variables of the actuators of all the rolling mills arranged on the upstream side from the second rolling mill.

In step S98, controller inversely compensates for the manipulated variable of the actuator of the third rolling mill, by a value corresponding to the first manipulated variables of the actuators of all the rolling mills arranged on the upstream side from the third rolling mill.

In step S99, controller checks whether the inverse compensation ends.

In step S100, controller checks whether rolling end.

In step S101, controller checks whether the control point of the most upstream side rolling mill reaches the profile gauge.

In the control method, when there exists a deviation in strip crown between the actually measured value and the previously calculated target value, since the deviation can be controlled by the actuators of the upstream side rolling mills from the rolling mill on the delivery side of which the profile gauge is equipped, it is possible to control the strip crown roughly all over the strip.

Further, in steps from S94A to S94D, it is possible to suppress the manipulated variable of the actuator of the rolling mill, within the capability of the actuator.

Further, FIG. 23 is a timing chart of this second delay control executed by the respective rolling mills.

(Modification of sixth method)

Figure 14A:
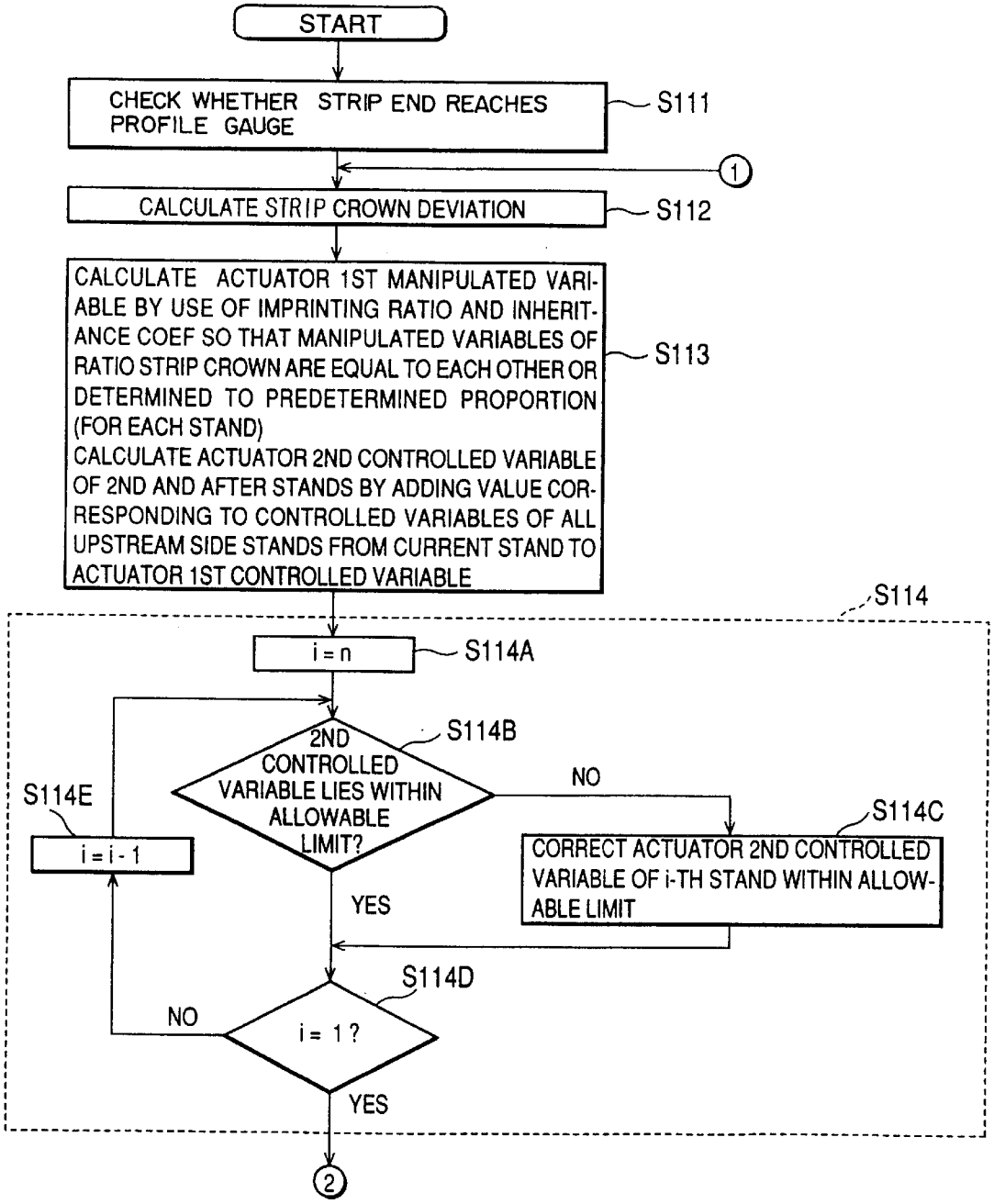
FIGS. 14A and 14B are flowcharts showing a modification of the sixth method of controlling strip crown of the continuous rolling mills according to the present invention.
Figure 14B:
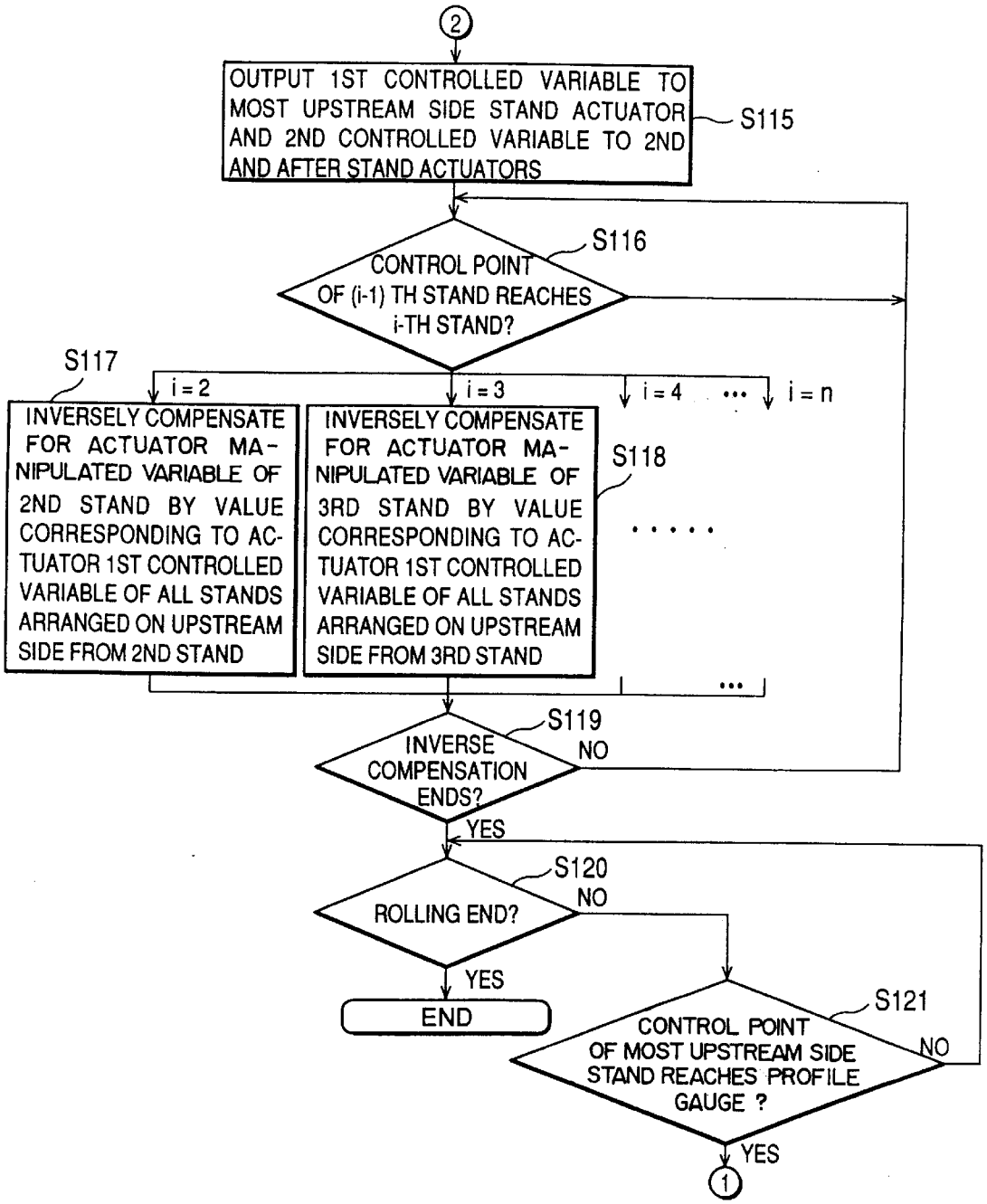

FIGS. 14A and 14B are flowcharts showing a modification of the sixth method of controlling the strip crown.

In step S111, controller detects that the strip end reaches the profile gauge.

In step S112, controller calculates a deviation in strip crown between the target value and the measured value.

In step S113, controller calculates the first manipulated variable of the actuator of the rolling mills on the basis of a imprinting ratio and an inheritance coefficient for each rolling mill, in such a way that the calculated controlled variables of the strip crown ratio of the rolling mills arranged at and on an upstream side from the rolling mill on the delivery side of which the profile gauge is equipped are equal to each other or determined to a predetermined proportion.

Further, controller calculates the second controlled variables of the second and after rolling mills by adding a value corresponding to the controlled variables of all the upstream side rolling mills to the first manipulated variable of the actuator of the current rolling mill.

In step S114A, controller detects that the current rolling mill to the n-th rolling mill (i=n) at which the strip crown is measured.

In step S114B, controller checks whether the second manipulated variable lies within an allowable limit.

If yes in step S114B, in step S114D controller checks whether the current rolling mill is the first rolling mill (i=1). If no in step S114D, in step S114E controller proceeds to the preceding rolling mill (i=i−1) to repeat the processing of step S114B again. If no in step S114B; that is, when the first actuator manipulated variable exceeds the allowable range, in step S114C controller corrects the second manipulated variable of the actuator of the i-th rolling mill, within the capability of the actuator.

In step S115, controller outputs the first controlled variable to the actuator of the most upstream side rolling mill, and second controlled variable to the actuators of the second and after rolling mills.

In step S116, controller checks whether the control point of the (i−1)-th rolling mill reaches the i-th rolling mill.

If yes in step S116, in step S117 controller inversely compensates for the controlled variable of the actuator of the second rolling mill, by a value corresponding to the first manipulated variables of the actuators of all the rolling mills arranged on the upstream side from the second rolling mill.

In step S118, controller inversely compensates for the manipulated variable of the actuator of the third rolling mill, by a value corresponding to the first manipulated variables of the actuators of all the rolling mills arranged on the upstream side from the third rolling mill.

In step S119, controller checks whether the inverse compensation ends.

In step S120, controller checks whether rolling end.

In step S121, controller checks whether the control point of the most upstream side rolling mill reaches the profile gauge.

Therefore, in the modification, since the manipulated variables of the actuators of the rolling mills arranged on the upstream side of the rolling mill on the delivery side of which the profile gauge is equipped can be controlled in such a way that the strip crown ratio controlled variables are equal to each other or determined in a predetermined proportion, it is possible to control the strip crown in consideration of strip crown ratio.

Further, in steps from S114A to S114D, it is possible to suppress the manipulated variable of the actuator of the rolling mill within the capability of the actuator.

Further, FIG. 23 is a timing chart of this second delay control executed by the respective rolling mills, in which the strip crown ratio is kept constant.

(Seventh method)

Figure 15A:
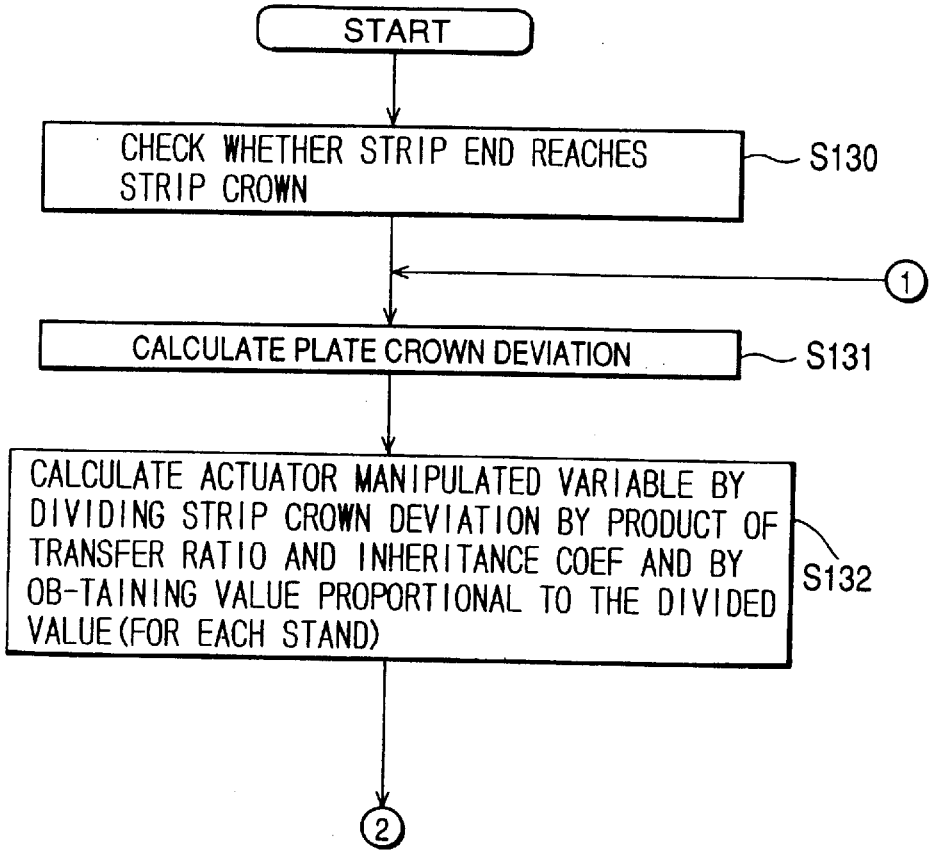
FIGS. 15A and 15B are flowcharts showing a seventh method of controlling strip crown of the continuous rolling mills according to the present invention.
Figure 15B:
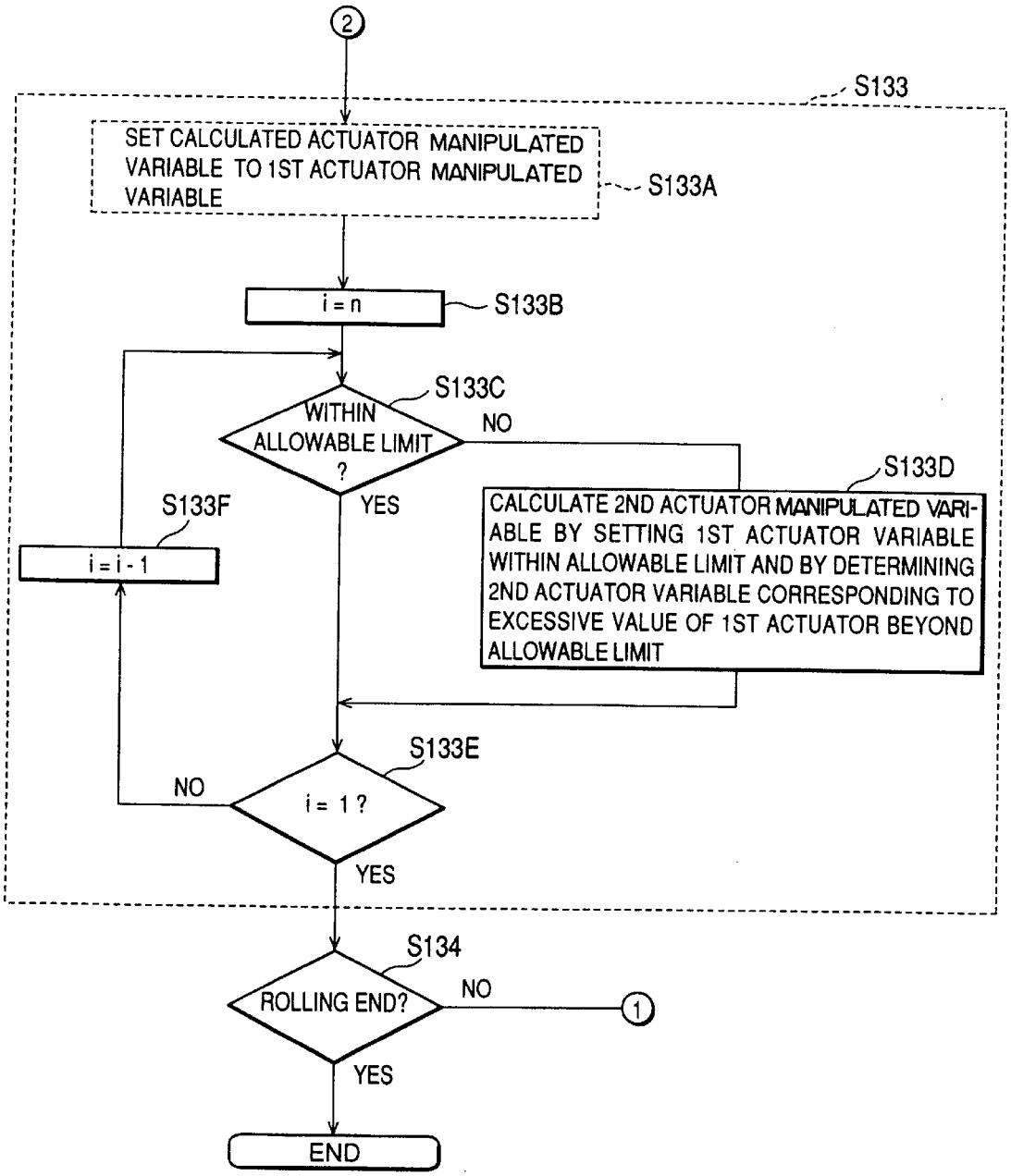

FIGS. 15A and 15B are flowcharts showing a seventh method of controlling the strip crown.

In step S130, controller detects that the strip end reaches the profile gauge.

In step S131, controller calculates the deviation of the rolling mill on the delivery side of which the profile gauge is equipped.

In step S132, controller divides the calculated deviation by a product of an influence coefficient of manipulated variable of the actuator upon a strip crown and a imprinting ratio, for each rolling mill, to obtain a manipulated variable of the actuator in proportion to the divided value, to control the corresponding actuator, for each rolling mill.

In step S133A, controller sets the calculated actuator manipulated variable to the first actuator manipulated variable.

In step S133B, controller detects that the current rolling mill is the n-th rolling mill (i=n) at which the strip crown is measured.

In step S133C, controller checks whether the actuator manipulated variable lies within an allowable limit. If yes in step S133C, in step S133E controller checks whether the current rolling mill is the first rolling mill (i=1).

If no in step S133E, in step S133E controller proceeds to the preceding rolling mill (i=i−1) to repeat the processing of step S133C again. If no in step S133C; that is, when the first actuator manipulated variable exceeds an allowable range, in step S133D controller calculates the first actuator manipulated variable within the allowable limit, and the second actuator manipulated variable which corresponds to an excessive value of the first actuator beyond the capability of the actuator.

If yes in step S133E, in step in S134 controller checks whether the rolling ends.

In the steps from step S130 to step S132, since the actuators of the upstream side rolling mills can be operated in such a way that the deviation in strip crown between the actually measured value and the target value is reduced down to zero, it is possible to control the strip crown rapidly.

Further, in the steps from step S133A to step S133E, since the manipulated variable of the first actuator is held with the capability of the actuator and further since the second actuator is manipulated on the basis of the controlled variable corresponding to the excessive value of the first actuator beyond the allowable limit, it is possible to control the strip crown securely and safely.

(First modification)

Figure 16:
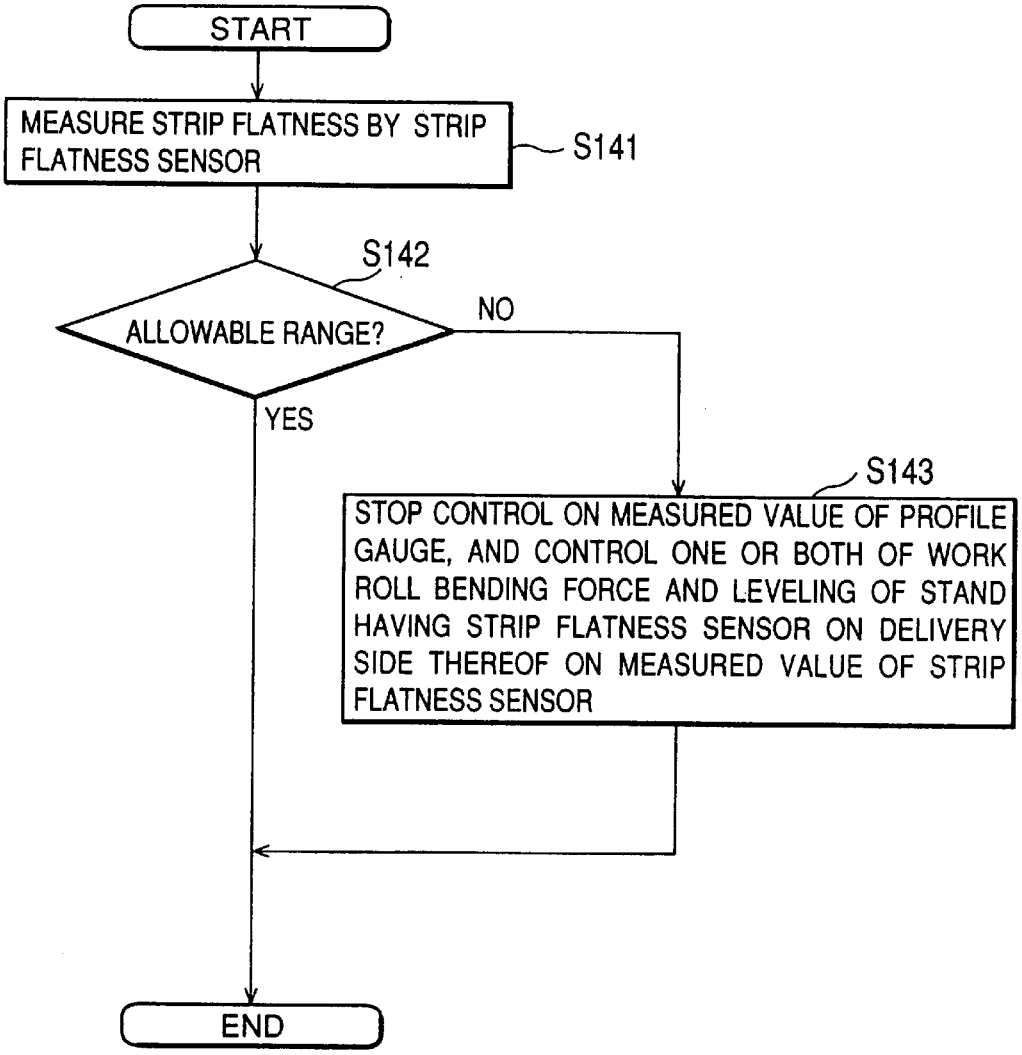
FIG. 16 is a flowchart showing a first modification of the control method of controlling strip crown of the continuous rolling mills according to the present invention.

FIG. 16 is a flowchart showing a first modification of the methods of controlling the strip crown.

In step S141, controller measures the flatness by a flatness sensor.

In step S142, controller checks whether the measured flatness within the allowable limit.

If no in step S142, in step S143 controller stops control executed on the basis of the measurement value of the strip crown, and controls any one of a work roll bending force and a work roll leveling of the rolling mill on an delivery side of which the flatness sensor is equipped, on the basis of the measurement value of the flatness sensor.

In this modification, when the flatness value measured by the flatness sensor exceeds the allowable value, since the control based upon the strip crown value measured by the profile gauge is stopped and since the control is executed for any one of a work roll bending force and a work roll leveling of the rolling mill on an delivery side of which the flatness sensor is equipped, on the basis of the measurement value of the flatness sensor, it is possible to previously prevent the flatness from being deteriorated by the strip crown control.

(Second modification)

Figure 17:
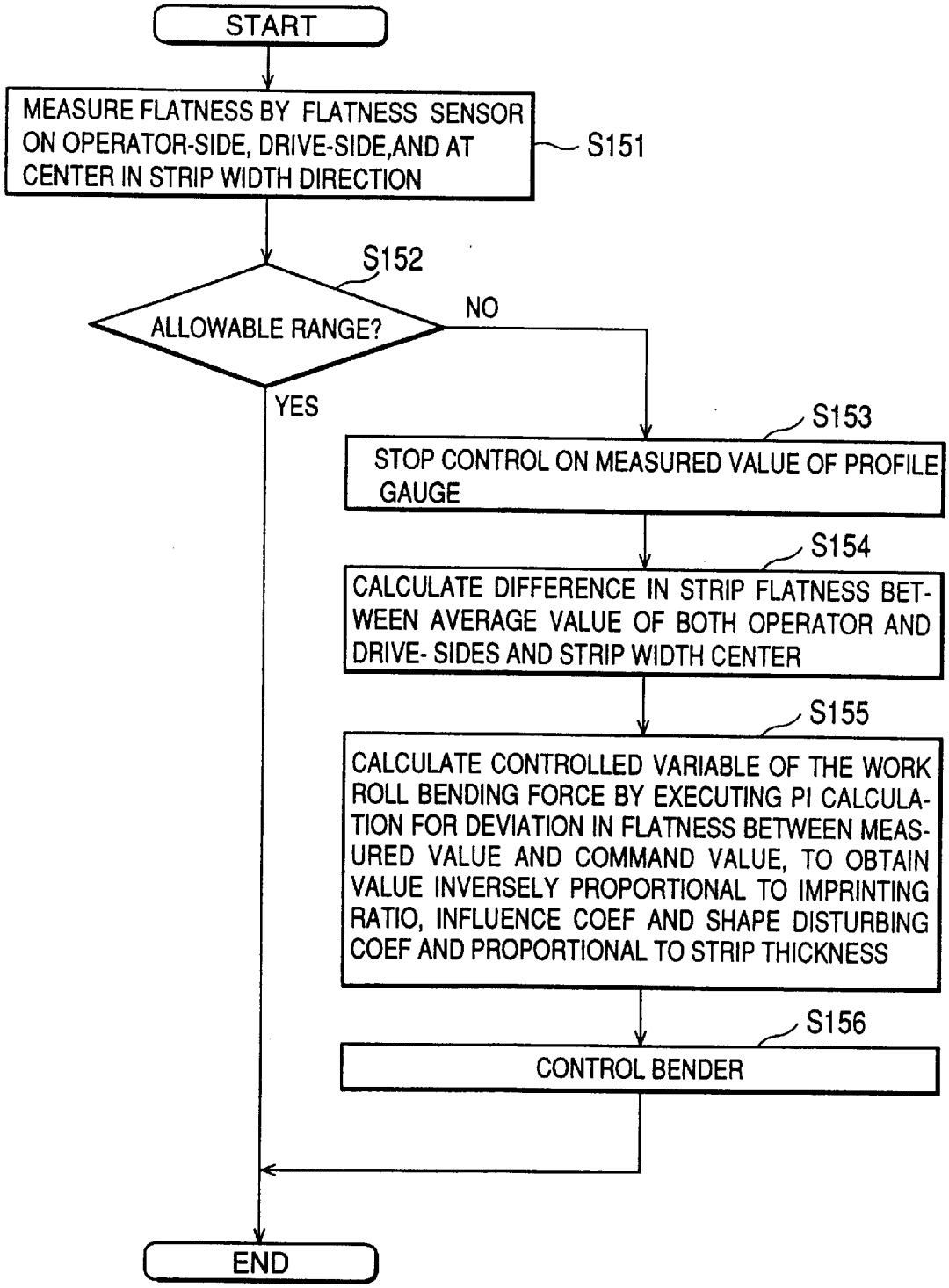
FIG. 17 is a flowchart showing a second modification of the control method of controlling strip crown of the continuous rolling mills according to the present invention.

FIG. 17 is a flowchart showing a second modification of the methods of controlling the strip crown.

In step S151, controller measures the flatness at least on the operator side, on the driver side, and at the center in the strip width direction by the flatness sensor, to control the work roll bending force.

In step S152, controller checks whether the measured flatness within the allowable limit.

If no in step S152, in step S153 controller stops the control on the basis of the measured value of the profile gauge.

In step S154, controller calculates a difference in flatness between an average value of both the operator-side flatness and the drive-side flatness, and a flatness at the center.

In step S155, controller executes PI calculation for a deviation between the obtained difference and a target flatness, and obtains a controlled variable of the roll bending force inversely proportional to the imprinting ratio, the influence coefficient and a shape disturbing-coefficient, and proportional to a strip thickness.

In step S156, controller controls the bender on the basis of the calculated controlled variable.

In this modification method, since the work roll bending force is controlled on the basis of the bending force controlled variable, it is possible to control the flatness more securely.

(Third modification)

Figure 18:
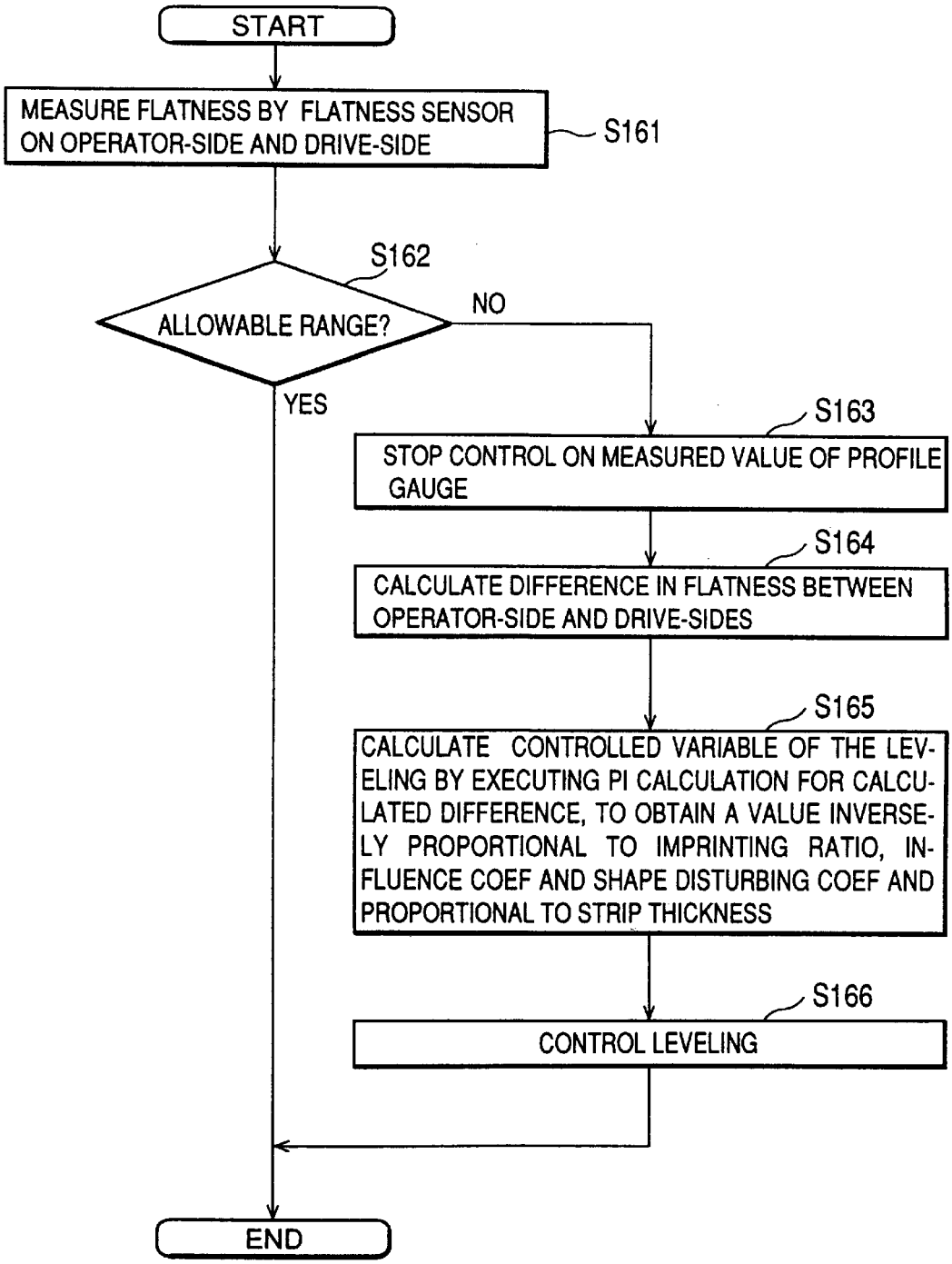
FIG. 18 is a flowchart showing a third modification of the control method of controlling strip crown of the continuous rolling mills according to the present invention.

FIG. 18 is a flowchart showing a third modification of the method of the controlling the strip crown.

In step S161, controller measures the flatness at least on the operator side and the driver side, by the flatness sensor, to control the work roll bending force.

In step S162, controller checks whether the measured flatness within the allowable limit.

If no in step S162, in step S163 controller stops the control on the basis of the measured value of the profile gauge.

In step S164, controller calculates a difference in flatness between the operator-side flatness and the drive-side flatness.

In step S165, controller executes PI calculation for a deviation between the obtained difference and a target flatness, and obtains a controlled variable of the roller leveling inversely proportional to the imprinting ratio, the influence coefficient and a shape disturbing-coefficient, and proportional to a strip thickness.

In step S166, controller controls the leveling on the basis of the calculated controlled variable.

In this third modification method, since the leveling is controlled on the basis of the leveling controlled variable, it is possible to control the flatness more securely.

(Eighth method)

Figure 19:
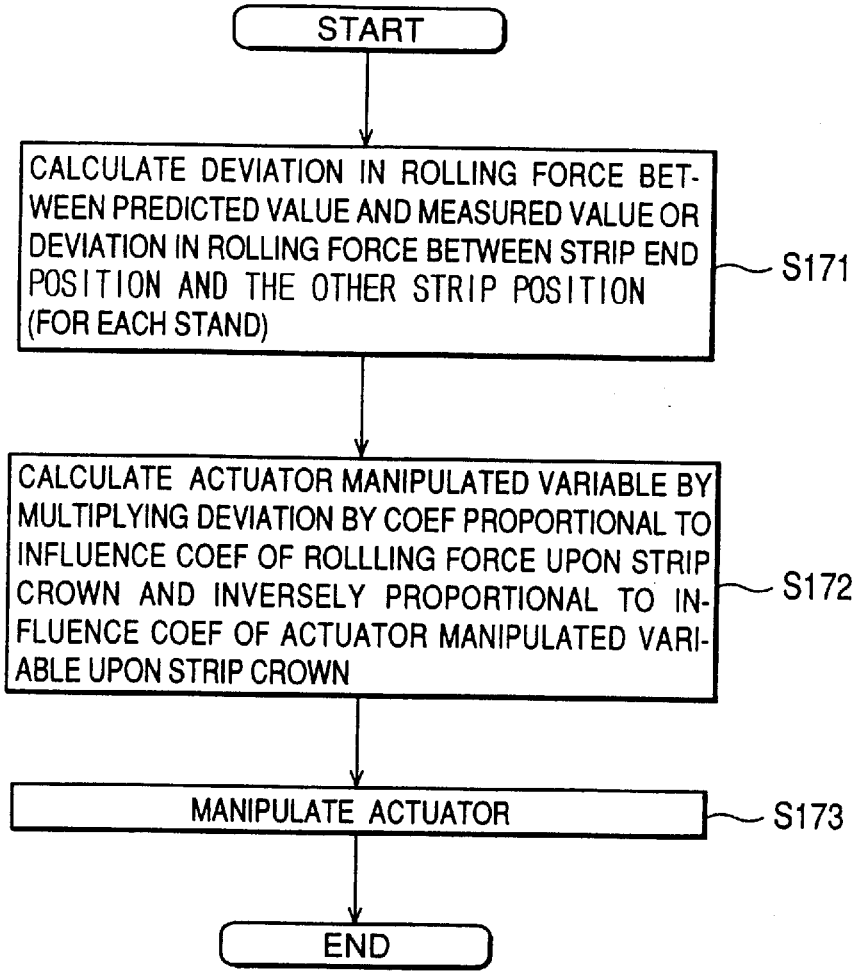
FIG. 19 is a flowchart showing an eighth method of controlling strip crown of the continuous rolling mills according to the present invention.

FIG. 19 is a flowchart showing the eighth method of controlling the strip crown.

In step S171, controller calculates a deviation in rolling force between a predicted value and a measured value or a deviation in rolling force between an strip end position and the other strip position, for each rolling mill.

In step S172, controller multiplies the obtained deviation by a coefficient proportional to an influence coefficient of the strip crown upon the rolling force and inversely proportional to an influence coefficient of manipulated variable of the actuator upon the strip crown, to obtain a manipulated variable of the actuator.

In step S173, controller controls the actuator on the basis of the obtained manipulated variable.

In the control method, it is possible to control the strip crown caused by change of rolling force at any time.

(Ninth method)

Figure 20:
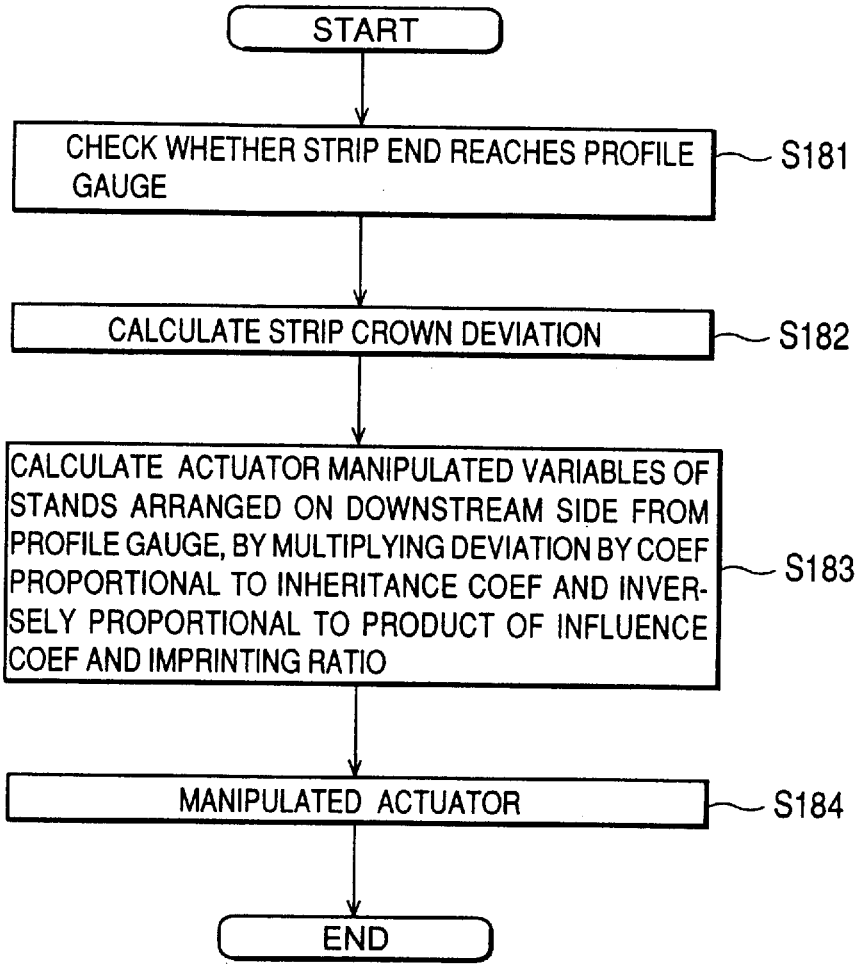
FIG. 20 is a flowchart showing a ninth method of controlling strip crown of the continuous rolling mills according to the present invention.

FIG. 20 is a flowchart showing the ninth method of controlling the strip crown.

In step S181, controller detects that the strip end reaches the profile gauge.

In step S182, controller a deviation in strip crown between the target value and the measured value.

In step S183, controller multiplies the obtained deviation by a coefficient proportional to an inheritance coefficient and inversely proportional to a product of an influence coefficient of the manipulated variable of the actuator to be controlled upon the strip crown and a imprinting ratio, for each rolling mill arranged on downstream side of the rolling machine at which the profile gauge is equipped, to obtain the manipulated variable of the actuator.

In step S184, controller controls the actuator on the basis of the obtained manipulated variable.

In this control method, since the strip crown is forward controlled, it is possible to combine this method with the other control methods.

What is claimed is:

1. A method of calculating and measuring strip crowns of any desired rolling mill of a plurality of tandem-arranged continuous rolling mills each provided with at least one actuator for controlling each strip crown, comprising the steps of:

calculating and setting a target strip crown of the rolling mill from a first stage rolling mill to another rolling mill at which strip crown is to be measured, for each rolling mill;

predicting a rolling force, state value of an actuator of said rolling mill, and a work roll crown, for each rolling mill;

actually measuring the rolling force, state value of an actuator of said rolling mill, and the work roll crown, for each rolling mill;

calculating deviations in rolling force, state value of an actuator of said rolling mill, and work roll crown between the predicted value and the actually measured value, for each rolling mill from the first stage rolling mill to the rolling mill at which the strip crown is to be measured;

multiplying each of the calculated deviations by an influence coefficient upon a mechanical strip crown, respectively;

adding all the obtained multiplication results to obtain a total deviation in mechanical strip crown between the predicted value and the actually measured value, for each rolling mill;

adding the target strip crown value to a value obtained by multiplying the deviation in mechanical strip crown between the predicted value and the actually measured value by a imprinting ratio, to obtain a calculated measurement value of the strip crown for the first stage rolling mill; and adding the target strip crown, a value obtained by multiplying the deviation in mechanical strip crown between the predicted value and the actually measured value by an imprinting ratio, and a value obtained by multiplying the deviation in entry side strip crown between the target value and the calculated measurement value by an inheritance coefficient, to obtain calculated measurement values of the strip crowns for the second and after rolling mills, the strip crowns of the rolling mills at which the strip crowns are to be measured being obtained by repeating the above-mentioned calculations from an upstream side rolling mill to the rolling mill at which the strip crown is to be measured.

2. The method of calculating and measuring strip crowns of claim 1, wherein a profile gauge is equipped on an exit side of the most downstream side rolling mill at each of which the strip crown is to be measured; and which further comprises the step of multiplying the calculated deviation in strip crown between the calculated measurement value and the actually measured value on an exit side of the most downstream side rolling mill, by a ratio of a strip thickness obtained on the delivery side of the rolling mill at which the strip crown is to be measured and a strip thickness obtained on the delivery side of the most downstream side rolling mill for each rolling mill, to correct the calculated measurement value of the strip crown of the rolling mill at which the strip crown is to be measured.

3. A method of controlling tandem-arranged continuous rolling mills each provided with at least one actuator for controlling each strip crown and having a profile gauge installed between stands or at the delivery side of the last stand, by reducing a deviation in strip crown between a value actually measured by the profile gauge and a previously calculated target value to zero, wherein a controlled variable of the actuator is obtained in correspondence to the deviation of the strip crown for each rolling mill, by use of an imprinting ratio and an inheritance coefficient for each rolling mill, in such a way that the controlled variables of the actuators of the rolling mills arranged on the upstream side of the rolling mill at which the profile gauge is equipped are equal to each other or determined to a predetermined proportion.

4. A method of controlling tandem-arranged continuous rolling mills each provided with at least one actuator for controlling each strip crown and having a profile gauge installed between stands or at the delivery side of the last stand, by reducing a deviation in strip crown between a value actually measured by the profile gauge and a previously calculated target strip crown to zero, wherein a controlled variable of the actuator is obtained in correspondence to the deviation of the strip crown for each rolling mill, by use of an imprinting ratio, an inheritance coefficient and a strip thickness of each rolling mill, in such a way that the controlled variables of the actuators of the rolling mills arranged on the upstream side of the profile gauge are equal to each other or determined to a predetermined proportion.

5. The method of controlling the tandem-arranged continuous rolling mills of claim 3, which further comprises the steps of:

multiplying the controlled variable of the actuator by a imprinting ratio and an influence coefficient upon the mechanical strip crown, to obtain the controlled variable of the delivery strip crown, for each rolling mill; and adding the controlled variable of the delivery strip crown, a value obtained by multiplying the controlled variable of the delivery strip crown of the adjacent upstream side stands by the inheritance coefficients, and the previously calculated and measured strip crown value, to obtain the total controlled variable of the strip crown for each rolling mill, the added total controlled variable of the strip crown being used to correct the controlled variable of the actuator for each rolling mill.

6. The method of controlling tandem-arranged continuous rolling mills of claim 4, which further comprises the steps of:

multiplying the controlled variable of the actuator by a imprinting ratio and an influence coefficient upon the mechanical strip crown, to obtain the controlled variable of the delivery strip crown, for each rolling mill; and adding the controlled variable of the delivery strip crown, a value obtained by multiplying the controlled variable of the delivery strip crown of the adjacent upstream side stands by the inheritance coefficients, and the previously calculated and measured strip crown value, to obtain the total controlled variable of the strip crown for each rolling mill, the added total controlled variable of the strip crown being used to correct the controlled variable of the actuator for each rolling mill.

7. The method of controlling tandem-arranged continuous rolling mills of claim 5, which further comprises the steps of:

dividing the total controlled variable of the delivery strip crown by an delivery side strip thickness, to obtain a strip crown ratio for each rolling mill;

multiplying a difference in strip crown ratio between the adjacent downstream side rolling mill and the adjacent upstream side rolling mill by a shape disturbing-coefficient, to obtain a flatness for each rolling mill;

when the obtained flatness exceeds an allowable range, calculating a modified control value of the delivery strip crown from the downstream side rolling mill to the upstream side rolling mill in sequence, so that the obtained flatness lies within the allowable range; and correcting the manipulated variable of the actuator on the basis of the modified control value of the delivery strip crown, for each related rolling mill.

8. The method of controlling tandem-arranged continuous rolling mills of claim 6, which further comprises the steps of:

dividing the total controlled variable of the delivery strip crown by an delivery side strip thickness, to obtain a strip crown ratio for each rolling mill;

multiplying a difference in strip crown ratio between the adjacent downstream side rolling mill and the adjacent upstream side rolling mill by a shape disturbing-coefficient, to obtain a flatness for each rolling mill;

when the obtained flatness exceeds an allowable range, calculating a modified control value of the delivery strip crown from the downstream side rolling mill to the upstream side rolling mill in sequence, so that the obtained flatness lies within the allowable range; and correcting the manipulated variable of the actuator on the basis of the modified control value of the delivery strip crown, for each related rolling mill.

9. The control method of tandem-arranged continuous rolling mills of claim 7, wherein the continuous rolling mills are provided with a first actuator and a second actuator, respectively; and which further comprises the steps of:

when the manipulated variable of the first actuator exceeds an capability of the actuator, calculating a manipulated variable of the second actuator corresponding to an excessive value of the first actuator beyond the capability of the actuator;

controlling the first actuator on the basis of the manipulated variable limited within the capability of the actuator; and controlling the second actuator on the basis of the calculated controlled variable of the second actuator, for each rolling mill.

10. The control method of tandem-arranged continuous rolling mills of claim 8, wherein the continuous rolling mills are provided with a first actuator and a second actuator, respectively; and which further comprises the steps of:

when the manipulated variable of the first actuator exceeds an capability of the actuator, calculating a manipulated variable of the second actuator corresponding to an excessive value of the first actuator beyond the capability of the actuator;

controlling the first actuator on the basis of the manipulated variable limited within the capability of the actuator; and controlling the second actuator on the basis of the calculated manipulated variable of the second actuator, for each rolling mill.

11. A method of controlling tandem-arranged continuous rolling mills each provided with a first actuator and a second actuator both for controlling each strip crown and having a profile gauge installed between stands or at the delivery side of the last stand to reduce a deviation in strip crown between a value actually measured by the profile gauge and a previously calculated target strip crown to zero, which comprises the steps of:

obtaining a manipulated variable of the first actuator of the rolling mill arranged on an upstream side from a position at which the profile gauge is equipped, on the basis of the deviation in strip crown, for each rolling mill;

when the obtained manipulated variable exceeds a capability of the actuator, obtaining the first actuator manipulated variable limited within the capability of the actuator and the second actuator manipulated variable corresponding to an excessive value of the first actuator beyond the capability of the actuator, for each rolling mill;

when the manipulated variable of the first actuator does not exceed the capability of the actuator, simultaneously controlling only the first actuators of the rolling mills arranged on the upstream side of the position at which the profile gauge is equipped, on the basis of the corresponding manipulated variable;

when the manipulated variable of the first actuator exceeds the capability of the actuator, simultaneously controlling both the first and second actuators of the rolling mill arranged on the upstream side of which the profile gauge is arranged, on the basis of the two corresponding manipulated variables, respectively; and repeating the simultaneous control whenever a control position on a strip controlled by the most upstream side rolling mill reaches the position at which the profile gauge is equipped.

12. A method of controlling tandem-arranged continuous rolling mills each provided with at least one actuator for controlling each strip crown and a profile gauge installed between stands or at the delivery side of the last stand, by reducing a deviation in strip crown between a value actually measured by the profile gauge and a previously calculated target strip to zero, which comprises the steps of:

calculating a first manipulated variable of the actuator of the rolling mill, on the basis of a imprinting ratio and an inheritance coefficient for each rolling mill, in such a way that the calculated manipulated variables of the actuators of the rolling mills arranged at and on an upstream side from the rolling mill on the delivery side of which the profile gauge is equipped are equal to each other or determined to a predetermined proportion;

obtaining a second manipulated variable of the actuator required when the strip crown is controlled by only the rolling mill on the delivery side of which the profile gauge is equipped;

simultaneously controlling the actuator of the rolling mill on the delivery side of which the profile gauge is equipped, on the basis of the second manipulated variable and the actuators of the rolling mills arranged on the upstream side of the rolling mill on the delivery side of which the profile gauge is equipped, on the basis of the first manipulated variables;

whenever a control point on a strip by the upstream side rolling mill reaches the rolling mill at which the strip crown meter is equipped, inversely compensating for the manipulated variable of the actuator of the rolling mill on the delivery side of which the profile gauge is equipped, by a value corresponding to the first controlled variables of the respective upstream side rolling mills; and whenever the control point of the strip by the most upstream side rolling mill is passed through the rolling mill on the delivery side of which the profile gauge is equipped, repeating the calculation of the control variables, the control, and the inverse compensation, respectively.

13. The method of controlling tandem-arranged continuous rolling mills of claim 12, wherein when the strip crown is controlled by only the rolling mill on the delivery side of which the profile gauge is equipped and further when the second manipulated variable of the actuator exceeds a capability of the actuator, the strip crown is controlled on the basis of the second manipulated variable limited within the capability of the actuator.

14. The method of controlling tandem-arranged continuous rolling mills of claim 12, which further comprises the step of: obtaining the control variable of the actuator of the rolling mill in such a way the controlled variables of strip crown ratios of the rolling mills at and on the upstream side of the rolling mill on the delivery side of which the profile gauge is equipped are equal to each other or determined in a predetermined proportion, instead of obtaining the manipulate variables of the actuator of the rolling mill in such a way the manipulated variables of the actuators of the rolling mills at and on the upstream side of the rolling mill on the delivery side of which the profile gauge is equipped are equal to each other or determined in a predetermined proportion.

15. The method of controlling tandem-arranged continuous rolling mills of claim 14, wherein when the strip crown is controlled by only the rolling mill on the delivery side of which the profile gauge is equipped and further when the second manipulated variable of the actuator exceeds a capability of the actuator, the strip crown is controlled on the basis of the second manipulated variable limited within the capability of the actuator.

16. A method of controlling tandem-arranged continuous rolling mills each provided with at least one actuator for controlling each strip crown and having a profile gauge installed between stands or at the delivery side of the last stand, by reducing a deviation in strip crown between a value actually measured by the profile gauge and a previously calculated target strip to zero, which comprises the steps of:

obtaining a first manipulated variable of the actuator of the rolling mill on the basis of an imprinting ratio and an inheritance coefficient for each rolling mill, in such a way that the calculated controlled variables of the rolling mills arranged at and on an upstream side of the rolling mill on the delivery side of which the profile gauge is equipped are equal to each other or determined to a predetermined proportion;

obtaining second manipulated variables of the actuators of the second and after rolling mills from the most upstream side rolling mill, to control all the strip crown deviations of the upstream side rolling mills;

simultaneously controlling the actuator of the most upstream side rolling mill on the basis of the first controlled variable and the actuators of the second and after rolling mills from the most upstream side rolling mill on the basis of the second controlled variables;

whenever a control point on a strip by the upstream side rolling mills reaches adjacent downstream side rolling mill, inversely compensating for the manipulated variable of the actuator by a value corresponding to the controlled variables of the respective upstream side rolling mill; and whenever a control point on the strip by the most upstream side rolling mill is passed through the rolling mill on the delivery side of which the profile gauge is equipped, repeating the calculation of the control variables, the control, and the inverse compensation.

17. The method of controlling tandem-arranged continuous rolling mills of claim 16, wherein when the second manipulated variable exceeds a capability of the actuator, the strip crown is controlled on the basis of the second manipulated variable limited within the capability of the actuator.

18. The method of controlling tandem-arranged continuous rolling mills of claim 16, which further comprises the step of: obtaining the control variable of the actuator of the rolling mill in such a way the controlled variables of strip crown ratios of the rolling mills at and on the upstream side of the rolling mill on the delivery side of which the profile gauge is equipped are equal to each other or determined in a predetermined proportion, instead of obtaining the control variable of the actuator of the rolling mill in such a way the manipulated variables of the actuators of the rolling mills at and on the upstream side of the rolling mill on the delivery side of which the profile gauge is equipped are equal to each other or determined in a predetermined proportion.

19. The method of controlling tandem-arranged continuous rolling mills of claim 18, wherein when the second manipulated variable exceeds an capability of the actuator, the strip crown is controlled on the basis of the second manipulated variable limited within the capability of the actuator.

20. A method of controlling tandem-arranged continuous rolling mills each provided with at least one actuator for controlling each strip crown and a profile gauge installed between stands or at the delivery side of the last stand, by reducing a deviation in strip crown between a value actually measured by the profile gauge and a previously calculated target strip to zero, which comprises the steps of:

calculating the deviation of the rolling mill on the delivery side of which the profile gauge is equipped for each rolling mill; and dividing the calculated deviation by a product of an influence coefficient of manipulated variable of the actuator upon a strip crown and a imprinting ratio, for each rolling mill; and obtaining a manipulated variable of the actuator in proportion to the divided value, to control the corresponding actuator, for each rolling mill.

21. The control method of tandem-arranged continuous rolling mills of claim 20, wherein the continuous rolling mills are each provided with a first actuator and a second actuator respectively; and which further comprises the steps of:

when the manipulated variable of the first actuator exceeds a capability of the actuator, maintaining the manipulated variable of the first actuator within the capability of the actuator, and calculating a manipulated variable of the second actuator corresponding to an excessive value of the first actuator beyond the capability of the actuator; and controlling the second actuator on the basis of the calculated controlled variable.

22. The method of calculating and measuring strip crowns of any desired rolling mills of a plurality of tandem-arranged continuous rolling mills of claim 1, wherein a flatness sensor and a profile gauge are provided between the stands, and which further comprises the steps of:

when a flatness value measured by the flatness sensor exceeds an allowable range, stopping control executed on the basis of the measurement value of the strip crown; and controlling any one of work roll bending force and work roll leveling of the rolling mill on an delivery side of which the flatness sensor is equipped, on the basis of the measurement value of the flatness sensor.

23. The method of controlling tandem-arranged continuous rolling mills of claim 3, wherein a flatness sensor is equipped between the rolling mills at each of which the profile gauge is equipped, and which further comprises the steps of:

when a flatness value measured by the flatness sensor exceeds an allowable range, stopping control executed on the basis of the measurement value of the strip crown; and controlling any one of work roll bending force and work roll leveling of the rolling mill on an delivery side of which the flatness sensor is equipped, on the basis of the measurement value of the flatness sensor.

24. The method of controlling tandem-arranged continuous rolling mills of claim 4, wherein a flatness sensor is equipped between the rolling mills at each of which the profile gauge is equipped, and which further comprises the steps of:

when a flatness value measured by the flatness sensor exceeds an allowable range, stopping control executed on the basis of the measurement value of the strip crown; and controlling any one of work roll bending force and work roll leveling of the rolling mill on an delivery side of which the flatness sensor is equipped, on the basis of the measurement value of the flatness sensor.

25. The method of controlling tandem-arranged continuous rolling mills of claim 11, wherein a flatness sensor is equipped between the rolling mills at each of which the profile gauge is equipped, and which further comprises the steps of:

when a flatness value measured by the flatness sensor exceeds an allowable range, stopping control executed on the basis of the measurement value of the strip crown; and controlling any one of work roll bending force and work roll leveling of the rolling mill on an delivery side of which the flatness sensor is equipped, on the basis of the measurement value of the flatness sensor.

26. The method of controlling tandem-arranged continuous rolling mills of claim 12, wherein a flatness sensor is equipped between the rolling mills at each of which the profile gauge is equipped, and which further comprises the steps of:

when a flatness value measured by the flatness sensor exceeds an allowable range, stopping control executed on the basis of the measurement value of the strip crown; and controlling any one of work roll bending force and work roll leveling of the rolling mill on an delivery side of which the flatness sensor is equipped, on the basis of the measurement value of the flatness sensor.

27. The method of controlling tandem-arranged continuous rolling mills of claim 16, wherein a flatness sensor is equipped between the rolling mills at each of which the profile gauge is equipped, and which further comprises the steps of:

when a flatness value measured by the flatness sensor exceeds an allowable range, stopping control executed on the basis of the measurement value of the strip crown; and controlling any one of work roll bending force and work roll leveling of the rolling mill on an delivery side of which the flatness sensor is equipped, on the basis of the measurement value of the flatness sensor.

28. The method of controlling tandem-arranged continuous rolling mills of claim 20, wherein a flatness sensor is equipped between the rolling mills at each of which the profile gauge is equipped, and which further comprises the steps of:

when a flatness value measured by the flatness sensor exceeds an allowable range, stopping control executed on the basis of the measurement value of the strip crown; and controlling any one of work roll bending force and work roll leveling of the rolling mill on an delivery side of which the flatness sensor is equipped, on the basis of the measurement value of the flatness sensor.

29. The method of calculating and measuring strip crowns of any desired rolling mills of a plurality of tandem-arranged continuous rolling mills of claim 22, which comprises the steps of:

measuring an operator-side flatness, a drive-side flatness, and strip flatness at the center in strip width direction by the flatness sensor, to control a work roll bending force;

obtaining a difference in flatness between an average value of both the operator-side flatness and the drive-side flatness, and a flatness at the center;

executing PI calculation for a deviation between the obtained difference and a target flatness; and obtaining a controlled variable of the roll bending force inversely proportional to the imprinting ratio, the influence coefficient and a shape disturbing-coefficient, and proportional to a strip thickness.

30. The method of controlling tandem-arranged continuous rolling mills of claim 23, which comprises the steps of:

measuring an operator-side flatness, a drive-side flatness, and a flatness at the center in strip width direction by the flatness sensor, to control a work roll bending force;

obtaining a difference in flatness between an average value of both the operator-side flatness and the drive-side flatness, and a flatness at the center;

executing PI calculation for a deviation between the obtained difference and a target flatness; and obtaining a controlled variable of the roll bending force inversely proportional to the imprinting ratio, the influence coefficient and a shape disturbing-coefficient, and proportional to a strip thickness.

31. The method of controlling tandem-arranged continuous rolling mills of claim 24, which comprises the steps of:

measuring an operator-side flatness, a drive-side flatness, and a flatness at the center in strip width direction by the flatness sensor, to control a work roll bending force;

obtaining a difference in flatness between an average value of both the operator-side flatness and the drive-side flatness, and a flatness at the center;

executing PI calculation for a deviation between the obtained difference and a target flatness; and obtaining a controlled variable of the roll bending force inversely proportional to the imprinting ratio, the influence coefficient and a shape disturbing-coefficient, and proportional to a strip thickness.

32. The method of controlling tandem-arranged continuous rolling mills of claim 25, which comprises the steps of:

measuring an operator-side flatness, a drive-side flatness, and a flatness at the center in strip width direction by the flatness sensor, to control a work roll bending force;

obtaining a difference in flatness between an average value of both the operator-side flatness and the drive-side flatness, and a flatness at the center;

executing PI calculation for a deviation between the obtained difference and a target flatness; and obtaining a controlled variable of the roll bending force inversely proportional to the imprinting ratio, the influence coefficient and a shape disturbing-coefficient, and proportional to a strip thickness.

33. The method of controlling tandem-arranged continuous rolling mills of claim 26, which comprises the steps of:

measuring an operator-side flatness, a drive-side flatness, and a flatness at the center in strip width direction by the flatness sensor, to control a work roll bending force;

obtaining a difference in flatness between an average value of both the operator-side flatness and the drive-side flatness, and a flatness at the center;

executing PI calculation for a deviation between the obtained difference and a target flatness; and obtaining a controlled variable of the roll bending force inversely proportional to the imprinting ratio, the influence coefficient and a shape disturbing-coefficient, and proportional to a strip thickness.

34. The method of controlling tandem-arranged continuous rolling mills of claim 27, which comprises the steps of:

measuring an operator-side flatness, a drive-side flatness, and a flatness at the center in strip width direction by the flatness sensor, to control a work roll bending force;

obtaining a difference in flatness between an average value of both the operator-side flatness and the drive-side flatness, and a flatness at the center;

executing PI calculation for a deviation between the obtained difference and a target flatness; and obtaining a controlled variable of the roll bending force inversely proportional to the imprinting ratio, the influence coefficient and a shape disturbing-coefficient, and proportional to a strip thickness.

35. The method of controlling tandem-arranged continuous rolling mills of claim 28, which comprises the steps of:

measuring an operator-side flatness, a drive-side flatness, and a flatness at the center in strip width direction by the flatness sensor, to control a work roll bending force;

obtaining a difference in flatness between an average value of both the operator-side flatness and the drive-side flatness, and a flatness at the center;

executing PI calculation for a deviation between the obtained difference and a flatness command; and obtaining a controlled variable of the roll bending force inversely proportional to the imprinting ratio, the influence coefficient and a shape disturbing-coefficient, and proportional to a strip thickness.

36. The method of calculating and measuring strip crowns of any desired rolling mills of a plurality of tandem-arranged continuous rolling mills of claim 22, which further comprises the steps of:

measuring an operator-side flatness and a drive-side flatness by the flatness sensor, to control the work roll leveling;

obtaining a difference in flatness between the operator-side flatness and the drive-side flatness;

executing PI calculation for the obtained difference; and obtaining a controlled variable of leveling inversely proportional to the imprinting ratio, the influence coefficient, and a shape disturbing-coefficient, and proportional to a strip thickness.

37. The method of controlling tandem-arranged continuous rolling mills of claim 23, which further comprises the steps of:

measuring an operator-side flatness and a drive-side flatness by the flatness sensor, to control the work roll leveling;

obtaining a difference in flatness between the operator-side flatness and the drive-side flatness;

executing PI calculation for the obtained difference; and obtaining a controlled variable of leveling inversely proportional to the imprinting ratio, the influence coefficient, and a shape disturbing-coefficient, and proportional to a strip thickness.

38. The method of controlling tandem-arranged continuous rolling mills of claim 24, which further comprises the steps of:

measuring an operator-side flatness and a drive-side flatness by the flatness sensor, to control the work roll leveling;

obtaining a difference in flatness between the operator-side flatness and the drive-side flatness;

executing PI calculation for the obtained difference; and obtaining a controlled variable of leveling inversely proportional to the imprinting ratio, the influence coefficient, and a shape disturbing-coefficient, and proportional to a strip thickness.

39. The method of controlling tandem-arranged continuous rolling mills of claim 25, which further comprises the steps of:

measuring an operator-side flatness and a drive-side flatness by the flatness sensor, to control the work roll leveling;

obtaining a difference in flatness between the operator-side flatness and the drive-side flatness;

executing PI calculation for the obtained difference; and obtaining a controlled variable of leveling inversely proportional to the imprinting ratio, the influence coefficient, and a shape disturbing-coefficient, and proportional to a strip thickness.

40. The method of controlling tandem-arranged continuous rolling mills of claim 26, which further comprises the steps of:

measuring an operator-side flatness and a drive-side flatness by the flatness sensor, to control the work roll leveling;

obtaining a difference in flatness between the operator-side flatness and the drive-side flatness;

executing PI calculation for the obtained difference; and obtaining a controlled variable of leveling inversely proportional to the imprinting ratio, the influence coefficient, and a shape disturbing-coefficient, and proportional to a strip thickness.

41. The method of controlling tandem-arranged continuous rolling mills of claim 27, which further comprises the steps of:

measuring an operator-side flatness and a drive-side flatness by the flatness sensor, to control the work roll leveling;

obtaining a difference in flatness between the operator-side flatness and the drive-side flatness;

executing PI calculation for the obtained difference; and obtaining a controlled variable of leveling inversely proportional to the imprinting ratio, the influence coefficient, and a shape disturbing-coefficient, and proportional to a strip thickness.

42. The method of controlling tandem-arranged continuous rolling mills of claim 28, which further comprises the steps of:

measuring an operator-side flatness and a drive-side flatness by the flatness sensor, to control the work roll leveling;

obtaining a difference in flatness between the operator-side flatness and the drive-side flatness;

executing PI calculation for the obtained difference; and obtaining a controlled variable of leveling inversely proportional to the imprinting ratio, the influence coefficient, and a shape disturbing-coefficient, and proportional to a strip thickness.

43. A method of controlling tandem-arranged continuous rolling mills each provided with an actuator for controlling each strip crown, which comprises the steps of:

obtaining a deviation in rolling force between a predicted value and a measured value or a deviation in rolling force between an strip end position and the other strip position, for each rolling mill;

multiplying the obtained deviation by a coefficient proportional to an influence coefficient of the strip crown upon the rolling force and inversely proportional to an influence coefficient of manipulated variable of the actuator upon the strip crown, to obtain a manipulated variable of the actuator; and controlling the actuator on the basis of the obtained manipulated variable.

44. A method of controlling tandem-arranged continuous rolling mills each provided with an actuator for controlling each strip crown and having a profile gauge installed between stands or at the delivery side of the last stand, by feed-forward controlling the actuators arranged on the downstream side of the rolling mill having the profile gauge on the basis of a deviation in strip crown between a value actually measured by the profile gauge and a previously calculated target value, which comprises the steps of:

when an end of a strip reaches a position at which the profile gauge is equipped, obtaining a deviation in strip crown between a target value and a measured value;

multiplying the obtained deviation by a coefficient proportional to an inheritance coefficient and inversely proportional to a product of an influence coefficient of the manipulated variable of the actuator to be controlled upon the strip crown and a imprinting ratio, for rolling mill arranged on downstream side of the rolling mill at which the profile gauge is equipped; and controlling the actuator on the basis of the obtained manipulated variable.

* * * * *